United States Patent [19]

Nakamura et al.

[11] Patent Number: 4,740,453

[45] Date of Patent: Apr. 26, 1988

[54] SILVER HALIDE PHOTOSENSITIVE MATERIAL CONTAINING A COMPOUND CAPABLE OF RELEASING A PHOTOGRAPHICALLY USEFUL GROUP

[75] Inventors: Koki Nakamura; Shigeo Hirano; Tadashi Ikeda; Keiji Mihayashi; Mitsunori Ono; Toshiro Takahashi; Ken-ichi Kuwabara; Morio Yagihara; Isamu Itoh, all of Kanagawa, Japan

[73] Assignee: Fuji Photo Film Co., Ltd., Kanagawa, Japan

[21] Appl. No.: 813,308

[22] Filed: Dec. 24, 1985

[30] Foreign Application Priority Data

Dec. 27, 1984 [JP] Japan ..... 59-278853
Apr. 4, 1985 [JP] Japan ..... 60-71768

[51] Int. Cl.[4] ..... G03C 1/40; G03C 5/54

[52] U.S. Cl. ..... 430/505; 430/566; 430/957

[58] Field of Search ..... 430/505, 564, 566, 955, 430/957, 959, 960

[56] References Cited

U.S. PATENT DOCUMENTS

| | | | |
|---|---|---|---|
| 4,369,243 | 1/1983 | Credner et al. | 430/223 |
| 4,522,917 | 6/1985 | Ichijima et al. | 430/505 |
| 4,526,863 | 7/1985 | Mihayashi et al. | 430/505 |
| 4,533,626 | 8/1985 | Ono et al. | 430/223 |
| 4,536,472 | 8/1985 | Kato et al. | 430/505 |
| 4,564,586 | 1/1986 | Aoki et al. | 430/505 |
| 4,629,683 | 12/1986 | Itoh et al. | 430/223 |
| 4,636,456 | 1/1987 | Takahashi et al. | 430/266 |

FOREIGN PATENT DOCUMENTS 15136 2/1975 Japan ..... 430/505

*Primary Examiner*—John L. Goodrow
*Attorney, Agent, or Firm*—Sughrue, Mion, Zinn, Macpeak, and Seas

[57] ABSTRACT

A silver halide photosensitive material is described, comprising a support and at least one silver halide emulsion layer, wherein said emulsion layer or another layer contains a compound represented by formula (I)

(I)

wherein X represents an atomic group forming a redox center of benzene type having substituents by linking with $C_A$ and $C_B$, and which does not enable Time-PUG to be released until the redox center is oxidized during development processing; EWG represents an electron withdrawing group having a Hammet's $\sigma$ para value exceeding 0.3; $C_A$ and $C_B$ each represents a carbon atom; $R_1$ and $R_2$ each represents a hydrogen atom or a suitable substituent; Time represents a timing group connecting to $C_B$ through a sulfur, nitrogen, or selenium atom thereof, t is an integer of 0 or 1, and when t=0, Time is a chemical bond; PUG represents a photographically useful group and connects to $C_B$ through a sulfur, nitrogen, or selenium atom thereof when t=0; and n is an integer of 0 or 1.

16 Claims, No Drawings

SILVER HALIDE PHOTOSENSITIVE MATERIAL CONTAINING A COMPOUND CAPABLE OF RELEASING A PHOTOGRAPHICALLY USEFUL GROUP

FIELD OF THE INVENTION

The present invention relates to a silver halide photosensitive material, and more particularly, to a silver halide photosensitive material containing a compound capable of releasing a photographically useful group to an image pattern during development processing.

BACKGROUND OF THE INVENTION

As compounds which release photographically useful groups in correspondence to image density during development, there are known hydroquinone derivatives (the so-called DIR hydroquinones) which release development inhibitors in proportion to image density, those which release solvents for silver halides in proportion to image density and those or sulfonamide phenol derivatives which release diffusive dyes in proportion to the amount of the silver developed.

Examples of compounds heretofore known as DIR hydroquinones include those described in U.S. Pat. Nos. 3,379,529, 3,620,746, 4,377,634, and 4,332,878 and Japanese Patent Application (OPI) No. 129536/74 (the term "OPI" as used herein refers to a "published unexamined Japanese patent application) corresponding to U.S. Pat. No. 3,930,863. As hydroquinone derivatives which release solvents for silver halides, those described, e.g., in U.S. Pat. No. 4,459,351 are known. As hydroquinone derivatives which release diffusive dyes, those described, e.g., in U.S. Pat. Nos. 3,698,897 and 3,725,062 are known, and as sulfonamide phenol derivatives having the same property as the hydroquinone derivatives, those described, e.g., in the *The Journal of Organic Synthetic Chemistry,* (Japan), Vol. 39, p. 331 (1981), *Kagaku-no-Ryoiki,* Vol. 39, p. 617 (1981), *Kino Zairyo,* Vol. 3, p. 66 (1983), *Photogr. Sci. Eng.,* Vol. 20, p. 155 (1976), *Angew. Chem. Inter. ed. Eng.,* Vol. 22, p. 191 (1983), *The Journal of Organic Synthetic Chemistry,* (Japan), Vol. 40, p. 176 (1982), and *The Japan Chemical Industry Association, Monthly,* Vol. 35 (11), Vol. 29 (1982) are known.

Although the hitherto known compounds described in the above references have a large variety of applications depending on the photographic effects of photographically useful groups released, the function required for the redox center conducting redox reaction, reduction and oxidation reaction, by which the photographically useful groups are released has many common features. In other words, as a matter required for the overall photography of these days, steady obtaining with promptitude and ease of a picture of high quality is becoming more and more important, which results from the fact that these compounds are used as elements to achieve such objects or to effect auxiliary action. It can be said, therefore, that the performance required for these redox centers is how the photographically useful groups can be released quickly, in a short time, in good timing and efficiently.

The performance required for these redox centers will be described in more detail as follows.

First, the rate at which these redox centers effect cross redox reaction with the oxidant of a developing agent or of an auxiliary developing agent produced during development or that at which they themselves are changed to oxidants by reducing silver halides and other silver salts should be sufficiently high, in order that they may exhibit sufficient activity during the development processing.

Secondly, the photographically useful groups should be released from the oxidants of the redox centers thus produced very rapidly and efficiently.

Thirdly, these redox centers should be so stable during storage that they are not decomposed by oxygen in the air or by other substances so as to adversely affect photographic utility.

As for the first aspect, it is considered that acceleration of the rate at which the redox centers are oxidized can generally be accomplished by lessening their oxidation potential. However, as described in *Journal of American Chemical Society,* Vol. 60, p. 2084 (1938), if the oxidation potential is lessened, the rate at which the redox centers are oxidized by oxygen in the air will generally be increased, which gives an unfavorable effect from the third point of view. Therefore, it is difficult to aim at coexistence of rapid preservation of the function during the processing and the stability of the redox centers during the storage by lessening the oxidation potential.

On the other hand, measures are sometimes taken to protect the redox center from the standpoint of preventing oxygen in the air from oxidizing it. Such measures can be taken with relative effectiveness when the pH of the developer is high, when remarkable accelerating effect by the composition of processing solution described in Japanese Patent Application (OPI) Nos. 197037/84, 201057/84 (EP 125523A) can be ideally utilized, or when the processing time is very long. However, the protection of the redox center will generally result in a somewhat longer time being needed from the start of the development to the exhibition of the desired function because one or more additional reaction steps are required for the redox center to exhibit its function, often leading to adverse effects on a sufficient exhibition of the function. Considering the fact that further accelerated processing speeds will be desired in future, there seems to be many difficulties in aiming at the coexistence of a sufficient exhibition of the desired function with the stability of the redox center during storage.

As for the second viewpoint, the heretofore known compounds described in the above cited patents are not fully satisfactory with respect to the rate and efficiency at which the photographically useful groups are released from the oxidant of the redox center. Thus, the exhibition of the desired function may be thought to be greatly promoted if the rate and efficiency could be raised.

SUMMARY OF THE INVENTION

An object of the present invention is to provide a silver halide photosensitive material containing a photographic reagent which rapidly and effectively releases a photographically useful group after being oxidized in development processing.

The inventors have been conducting extensive studies on compounds which release photographically useful groups in proportion to image density during development, and have found that a marked promotion in the exhibition of the function can be achieved only when the oxidant has an electron withdrawing group at the 2-position or vinylogy-position relative to the photographically useful group released. In other words, the linkage bonding the oxidant of the redox center to the photographically useful group is ruptured during the stage at which the photographically useful group is released from the hitherto known redox center. For the occurrence of this rupture, the addition of nucleophilic substances which exist during the development such as hydroxyl ions to the carbon to which the photographically useful group is bonded and the subsequent cleavage of the linkage between the photographically useful group and the carbon bonded thereto are necessary. It was found, however, that the hitherto known compounds are insufficient in respect of rate and efficiency in any stage for the rupture to occur. The inventors have found, as a result of extensive studies, that when the oxidant of the redox center has an electron withdrawing group at the 2-position of vinylog-position relative to the photographically useful group and the bond between the redox center and the photographically useful group is carbon-sulfur, carbon-nitrogen or carbon-selenium, the bond between the redox center and the photographically useful group is ruptured at an unexpectedly excellent rate, and efficiently, thereby causing the photographically useful group to be released. Further, it has been unexpectedly discovered that the redox center which has an electron withdrawing group at the 2-position or vinylog-position relative to the photographically useful group thus released is so stable without protection during storage that it can be out into practical use, to say nothing of the case where the redox center is protected as occasion demands.

The present invention has been completed on the basis of these discoveries, which provides a silver halide photosensitive material having contained in a silver halide emulsion layer or other hydrophilic colloid layers a compound represented by formula (I) which releases a photographically useful group to image pattern after being oxidized.

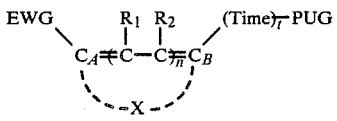

(I)

wherein X represents an atomic group which forms a redox center of benzene type having substituents by linking with $C_A$ and $C_B$ and which does not enable Time-PUG to be released until the redox center is oxidized during development processing; EWG expresses an electron withdrawing group having a Hammet's $\sigma$ para value exceeding 0.3; $C_A$ and $C_B$ each represents carbon atom (which conjugate EWG to Time-PUG through a substituted ethylenic bond or its vinylog); $R_1$ and $R_2$ each expresses hydrogen atom or a suitable substituent; Time represents a timing group connecting to $C_B$ through sulfur, nitrogen, or selenium atom thereof; t is an integer of 0 or 1, and when t=0 Time is a chemical bond; PUG represents a photographically useful group and connects to $C_B$ through sulfur, nitrogen, or selenium atom thereof when t=0 (i.e., when Time is a chemical bond); and n is an integer of 0 or 1.

DETAILED DESCRIPTION OF THE INVENTION

Examples of X are set forth below in the form including

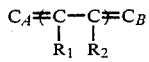

as follows.

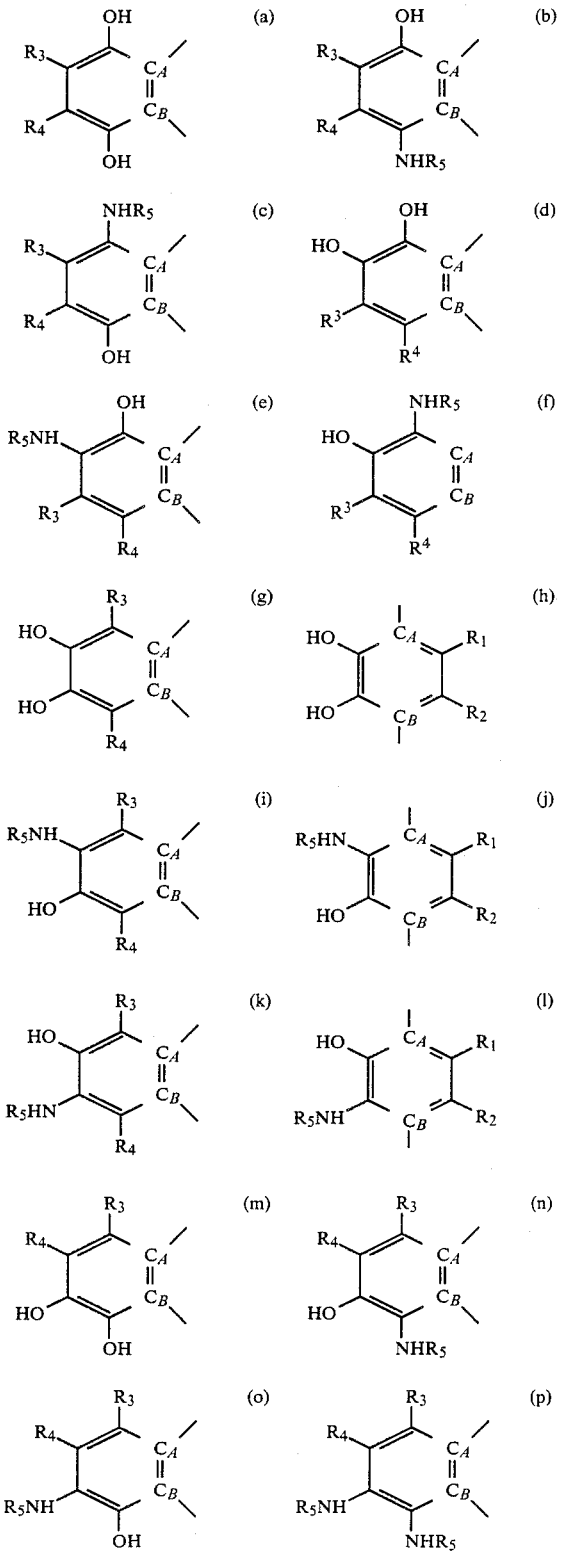

-continued (q)

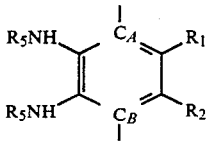

(r)

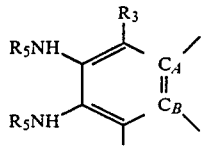

(s)

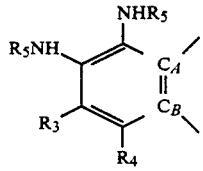

(t)

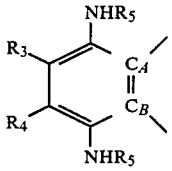

Of the above atomic groups (a) to (t), (a), (b), (c), (d), (e), (f), (h), (j), (l), (m), (n), (o) and (t) are preferred, (a), (b), (c), (d) and (f) being more preferred and (a) being the most preferred.

In the above formulae, $R_1$, $R_2$, $R_3$, and $R_4$ each represents hydrogen atom, substituted or unsubstituted alkyl groups having from 1 to 30 carbon atoms, such as methyl, ethyl, isopropyl, 2-decyl, t-octyl, octadecyl, benzyl, phenethyl and 3-ethoxycarbonylpropyl groups, substituted or unsubstituted aryl groups having from 1 to 30 carbon atoms, such as phenyl, 3-chlorophenyl, 4-cyanophenyl and naphthyl groups, substituted or unsubstituted alkylthio groups having from 1 to 30 carbon atoms, such as methylthio, ethylthio, n-octylthio, 2-octylthio, dodecylthio, 1-ethoxycarbonyl-1-decylthio and 2-cyanoethylthio groups, substituted or unsubstituted arylthio groups having from 1 to 30 carbon atoms, such as phenylthio, 4-chlorophenylthio, 2-n-octyloxy-5-t-octylphenylthio, 4-t-butylphenylthio and 1-naphthylthio groups, substituted or unsubstituted alkoxy groups having from 1 to 30 carbon atoms, such as methoxy, ethoxy, allyloxy, 2-propyloxy, octadecyloxy, and benzyloxy groups, substituted or unsubstituted aryloxy groups having from 1 to 30 carbon atoms, such as phenoxy, 4-chlorophenoxy, 4-acetylaminophenoxy, 2-acetylamino-4-butanesulfonylphenoxy, 3-cyanophenoxy, 3-dodecyloxyphenoxy and 3-pentadecylphenoxy groups, substituted or unsubstituted amino groups having from 1 to 30 carbon atoms, such as dimethylamino, diethylamino, n-hexylamino, cyclohexylamino and bis(2-cyanoethyl)amino groups, substituted or unsubstituted amide groups having from 1 to 30 carbon atoms, such as acetylamino, chloroacetylamino, trifluoroacetylamino, dodecenylsuccinimide, 2-hexadecenyl-3-carboxypropionylamino, pivaloylamino and 2-(2,4-di-t-pentylphenoxy)butyroylamino groups, substituted or unsubstituted sulfonamide groups having from 1 to 30 carbon atoms, such as benzenesulfonylamino, 4-chlorophenylsulfonylamino, N-methyl-4-methoxyphenylsulfonylamino, methanesulfonylamino, n-octanesulfonylamino and 4-methylphenylsulfonylamino groups, substituted or unsubstituted alkoxycarbonylamino groups having from 1 to 30 carbon atoms, such as ethoxycarbonylamino, ethoxycarbonyl-N-methylamino, N-ethylphenoxycarbonylamino, isobutyloxycarbonylamino and benzyloxycarbonylamino groups, substituted or unsubstituted ureido groups having from 1 to 30 carbon atoms, such as 3,3-diethylureido, 3-cyclohexylureido, morpholinocarbonylamino, 3-(4-cyanophenyl)ureido, 3-n-octyl-1-methylureido and 1,3-diphenylureido groups, substituted or unsubstituted carbamoyl groups having from 1 to 30 carbon atoms, such as methylcarbamoyl, ethylcarbamoyl, butylcarbamoyl, 4-methoxyphenylcarbamoyl, 3-(2,4-di-t-pentylphenoxy)propylcarbamoyl, pyrrolidinocarbamoyl, hexadecylcarbamoyl and di-n-octylcarbamoyl groups, substituted or unsubstituted alkoxycarbonyl groups having from 1 to 30 carbon atoms, such as methoxycarbonyl, ethoxycarbonyl, phenoxycarbonyl and hexadecyloxycarbonyl groups, substituted or unsubstituted aulfamoyl groups having from 1 to 30 carbon atoms, such as methylsulfamoyl, diethylsulfamoyl, 3-(2,4-di-t-pentylphenoxy)propysulfamoyl, N-methyl-N-octadecylsulfamoyl, bis(2-methoxyethyl)-sulfamoyl, 3-chlorophenylsulfamoyl and morpholinosulfonyl groups, substituted or unsubstituted sulfonyl groups having from 1 to 30 carbon atoms, such as methanesulfonyl, propylsulfonyl, dodecylsulfonyl, 4-methylphenylsulfonyl, 2-ethoxy-5-t-butylphenylsulfonyl and 2-carboxyphenylsulfonyl groups, a cyano group, halogen atoms, such as fluorine, chlorine, bromine and iodide atoms, substituted or unsubstituted acyl groups having from 1 to 30 carbon atoms, such as formyl, acetyl, trichloroacetyl, 2-phenoxypropionyl, benzoyl and 3-acetylaminobenzoyl groups, a carboxyl group, a sulfo group, a nitro group, heterocyclic residues having from 1 to 30 carbon atoms, such as 1-tetrazolyl, 1,2,4-triazole-1-yl, 5-nitroindazole-1-yl, 5-methylbenzotriazole-1-yl and benzoxazole-2-yl groups, sulfur residues bonded to a heterocyclic group having from 1 to 30 carbon atoms, such as 1-phenyltetrazole-5-ylthio, benzothiazole-2-ylthio and 6-methyl-1,3,3a,7-tetraazaindene-4-ylthio groups, -PUG or -Time-PUG.

Further, when possible, $R_1$ and $R_2$, and $R_3$ and $R_4$ may link together to form a saturated or unsaturated carbocyclic group (except that which forms an naphthalene ring with the benzene ring of X), or a saturated or unsaturated heterocyclic group. Preferable examples of such carbocyclic or heteocyclic forming groups are:

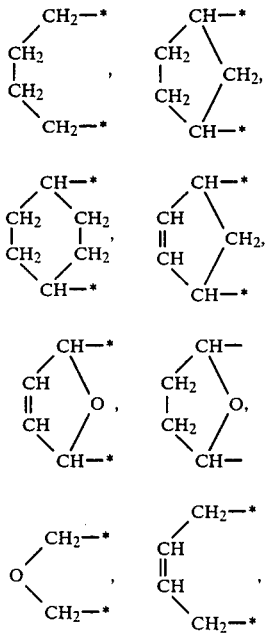

-continued

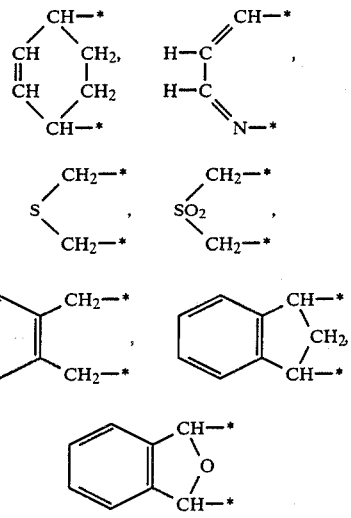

wherein symbol * expresses the position at which $R_1$, $R_2$, $R_3$, or $R_4$ is bonded.

$R_5$ is substituted or unsubstituted sulfonyl groups having from 1 to 30 carbon atoms, such as 4-methylphenylsulfonyl, methanesulfonyl, n-octylsulfonyl, 2-chloro-5-acetylaminophenylsulfonyl, 2-(2-methoxyethyl)-5-nitrophenylsulfonyl and 4-chlorophenylsulfonyl groups and substituted or unsubstituted acyl groups having from 1 to 30 carbon atoms, such as acetyl, benzoyl, 2-ethoxycarbonylbenzoyl, 4-nitrobenzoyl, chloroacetyl and 3,4-dimethoxybenzoyl groups, of which the sulfonyl group is preferred. Moreover, the two R's may link together to form a ring in the above (q), (r), and (s).

EWG represents an electron withdrawing substituent bonded to $C_A$, having a Hammet's $\sigma$ para value exceeding 0.3. Preferable examples of EWG are a cyano group, a nitro group, substituted or unsubstituted carbamoyl groups having from 1 to 30 carbon atoms, such as methylcarbamoyl, ethylcarbamoyl, 4-methoxyphenylcarbamoyl, N-methyl-N-octadecylcarbamoyl, 3-(2,4-di-pentylphenoxy)propylcarbamoyl, pyrrolidinocarbonyl, hexadecylcarbamoyl and di-n-octylcarbamoyl groups, substituted or unsubstituted sulfamoyl groups having from 1 to 30 carbon atoms, such as methylsulfamoyl, diethylsulfamoyl, 3-(2,4-di-t-pentylphenoxy)propylcarbamoyl, phenylsulfamoyl, pyrrolidinosulfonyl and morpholinosulfonyl groups, substituted or unsubstituted alkoxycarbonyl groups having from 1 to 30 carbon atoms, such as methoxycarbonyl, ethoxycarbonyl, phenoxycarbonyl, 2-methoxyethoxycarbonyl, and hexadecyloxycarbonyl groups, substituted or unsubstituted sulfonyl groups having from 1 to 30 carbon atoms, such as methanesulfonyl, 4-methylphenylsulfonyl and dodecylsulfonyl groups, substituted or unsubstituted acyl groups having from 1 to 30 carbon atoms, such as acetyl, hexanoyl, benzoyl and 4-chlorobenzoyl groups, a trifluoromethyl group, a carboxyl group, and substituted or unsubstituted heterocyclic residues having from 1 to 30 carbon atoms, such as benzoxazole-2-yl and 5,5-dimethyl-2-oxazoline-2-yl groups, of which the carbamoyl, alkoxycarbonyl and sulfamoyl groups are the most desirable.

The amino and hydroxyl groups of X may be protected by a protective group which can be removed during development. Exemplary protective groups are acyl groups, such as acetyl, chloroacetyl, dichloroacetyl, benzoyl, 4-cyanobenzoyl, and 4-oxopentanoyl groups, alkoxycarbonyl groups, such as ethoxycarbonyl, phenoxycarbonyl, and 4-methoxybenzyloxycarbonyl groups, aminocarbonyl groups, such as methylaminocarbonyl, 4-nitrophenylaminocarbonyl, 2-pyridylaminocarbonyl, and 1-imidazolylcarbonyl groups, and the protective groups described in Japanese Patent Application (OPI) Nos. 197037/84, 201057/84 (EP 125523A). Further the protective group may, if possible, link with $R_1$, $R_2$, $R_3$, $R_4$, or $R_5$ to form 5- to 7-membered rings such as

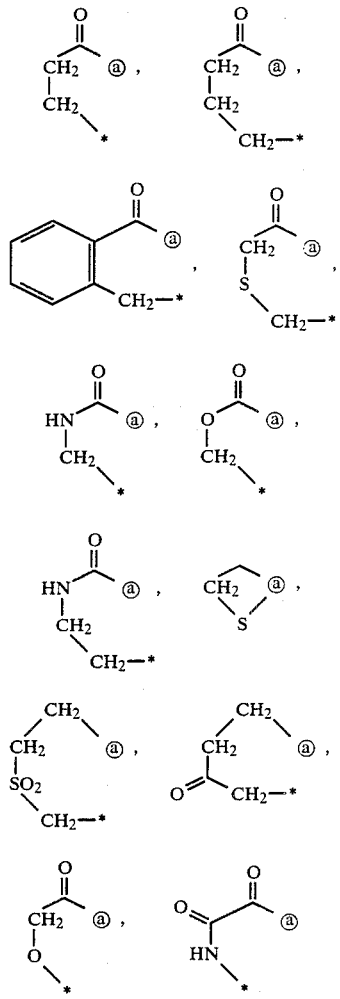

wherein ⓐ is bonded to phenolic oxygen or the nitrogen atom of the amino group attached to an aromatic ring, and symbol * represents the position at which $R_1$, $R_2$, $R_3$, $R_4$, or $R_5$ is bonded.

Next, an explanation will be made in detail about Time-PUG. -Time-PUG is a group which is not released as ⊖Time-PUG until the redox center expressed by

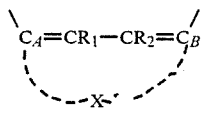

in formula (I) causes a cross oxidation reaction during development to change into an oxidant.

As the timing group in the Time, groups may be exemplified which cause PUG to be released from the ⊖Time-PUG released during the development through one or more reaction stages, but they may be photographically useful as ⊖Time-PUG or H-Time-PUG.

Particularly preferable timing groups of Time in formula (I) are represented by the following formulae wherein symbol * expresses the position at which the redox center is bonded, and symbol ** expresses the position at which the PUG is bonded. The Time may be the combination of the following two or more formulae.

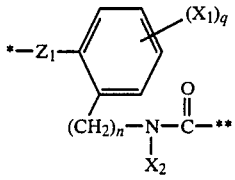

(T-1)

wherein $Z_1$ represents

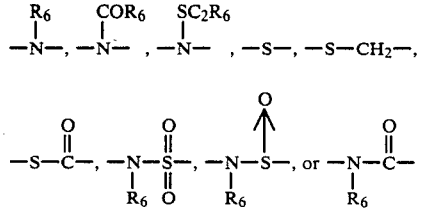

wherein $R_6$ is a hydrogen atom, an aliphatic, aromatic, or heterocyclic group; $X_1$ represents a hydrogen atom, an aliphatic, aromatic or heterocyclic group,

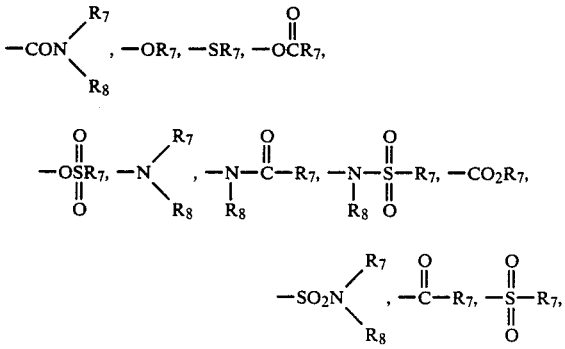

a cyano group, halogen atoms (e.g., fluorine, chlorine, bromine, and iodine) or a nitro group wherein $R_7$ and $R_8$ may be or may not be identical and express the same groups as described for $R_6$; $X_2$ represents the same groups as described for $R_6$; q represents an integer of from 1 to 4, and when q is 2 or more, the substituent represented by $X_1$ may be or may not be identical, and when q is 2 or more, $X_1$ may link to each other to form a ring; and n represents 0, 1 or 2.

The groups represented by formula (T-1) are, for example, described in U.S. Pat. No. 4,248,962.

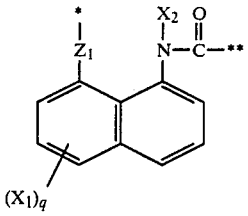

(T-2)

wherein $Z_1$, $X_1$, $X_2$ and q denote the same meanings as those defined for formula (T-1).

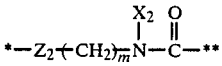

(T-3)

wherein $Z_2$ represents

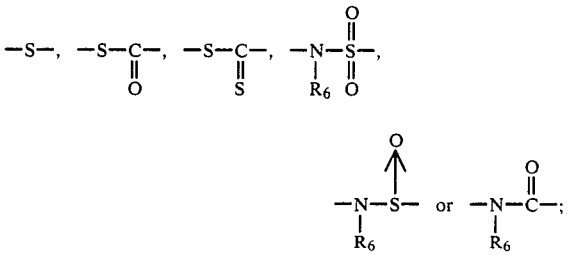

m is an integer of from 1 to 4, preferably being 1, 2 or 3; and $R_6$ and $X_2$ denote the same meanings as those defined for formula (T-1).

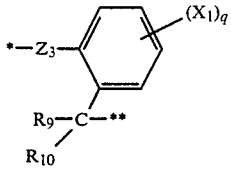

(T-4)

wherein $Z_3$ represents —S— or

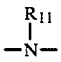

wherein $R_{11}$ expresses an aliphatic, aromatic, acyl, sulfonyl or heterocyclic group; $R_9$ and $R_{10}$ denote the same meanings as $R_6$ defined for formula (T-1); and $X_1$ and q denote the same meanings as those defined for formula (T-1).

An example of the group represented by formula (T-4) is the timing group described in U.S. Pat. No. 4,409,323.

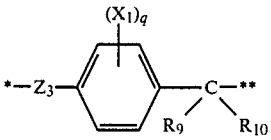

(T-5)

wherein $Z_3$, $X_1$, $R_9$, $R_{10}$, and q denote the same meanings as those defined for formula (T-4).

(T-6)

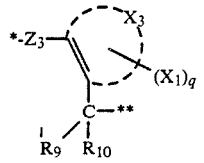

wherein $X_3$ is an atomic group which comprises at least one atom selected from the class consisting of carbon, nitrogen, oxygen and sulfur and which is necessary to form a 5- to 7-membered heterocycle, which may be further condensed with a benzene ring or a 5- to 7-membered heterocycle, exemplarily preferable heterocycles being pyrrole, pyrazole, imidazole, triazole, furan, oxazole, thiophene, thiazole, pyridine, pyridazine, pyrimidine, pyrazine, azepin, oxepin, indole, benzofuran, and quinoline; and $R_9$, $R_{10}$, $Z_3$, $X_1$ and q denote the same meanings as those defined for formula (T-4).

An example of the group represented by formula (T-6) is the timing group described in British Pat. No. 2,096,783.

(T-7)

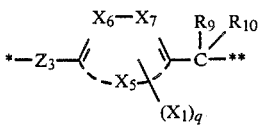

wherein $X_5$ is an atomic group which comprises at least one atom selected from the class consisting of carbon, nitrogen, oxygen, and sulfur and which is necessary to form a 5- to 7-membered heterocycle, which may be condensed further with a benzene ring or a 5- to 7-membered heterocycle, exemplarily preferable heterocycles including pyrrole, imidazole, triazole, furan, oxazole, oxadiazole, thiophene, thiazole, thiadiazole, pyridine, pyridazine, pyrimidine, pyrazine, azepin, oxepin, and isoquinoline; $X_6$ and $X_7$ is

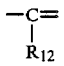

or —N= wherein $R_{12}$ expresses a hydrogen atom, an aliphatic or aromatic group; and $R_9$, $R_{10}$, $Z_3$, $X_1$ and q denote the same meanings as those defined for formula (T-4).

(T-8)

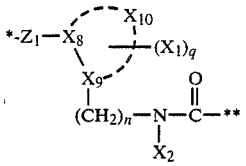

wherein $X_{10}$ is an atomic group which comprises at least one atom selected from the class consisting of carbon, nitrogen, oxygen, and sulfur and which is necessary to form a 5- to 7-membered heterocycle, which may be further condensed with a benzene ring or a 5- to 7-membered heterocycle, exemplarily preferable heterocycles being pyrrolidine, piperidine, and benzotriazole besides those given for formula (T-6); $X_8$ and $X_9$ are

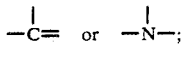

and $Z_1$, $X_1$, $X_2$, n and q denote the same meanings as those defined for formula (T-1).

(T-9)

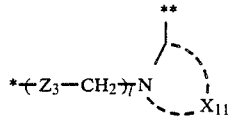

wherein $X_{11}$ denotes the same meaning as $X_{10}$ defined for formula (T-8); $Z_3$ denotes the same meaning as that defined for formula (T-4) and l expresses 0 or 1. Exemplarily preferable heterocycles of $X_{11}$ are as follows.

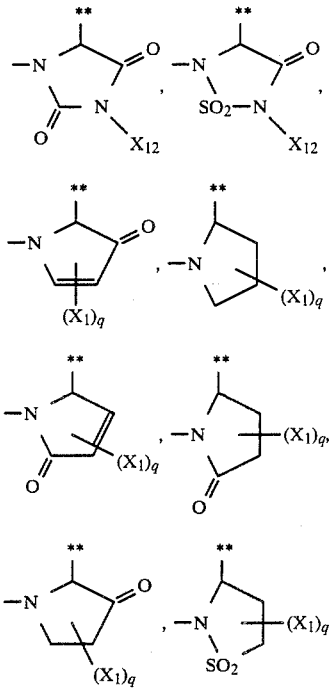

wherein $X_1$ and q denote the same meanings as those defined for formula (T-1), and $X_{12}$ represents a hydrogen atom, an aliphatic, aromatic, acyl, sulfonyl, alkoxycarbonyl, sulfamoyl, heterocyclic, or carbamoyl group.

(T-10)

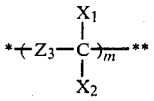

wherein $X_1$ and $X_2$ denote the same meanings as those defined for formula (T-1), $Z_3$ denotes the same meaning as that for formula (T-4) and m denotes the same meaning as that for formula (T-3) and is preferably 1 or 2.

In the above formulae (T-1) to (T-10), $X_1$, $X_2$, $R_6$ to $R_{12}$ have preferably from 1 to 20 carbon atoms and may be saturated or unsaturated, substituted or unsubstituted, chain-like or cyclic, straight or branched chain when they contain a portion of an aliphatic group. The above $X_1$, $X_2$, $R_6$ to $R_{12}$ have from 6 to 20, preferably from 6 to 10 carbon atoms, and are preferably a substituted or unsubstituted phenyl group when they contain a portion of an aromatic group. The above $X_1$, $X_2$, $R_6$ to $R_{12}$ are 5- or 6-membered heterocycles having as hetero atoms at least one member of the group consisting of nitrogen, oxygen and sulfur atoms when they contain a portion of a heterocyclic group. Examples of the preferable heterocyclic groups are a pyridyl, furyl, thienyl, triazolyl, imidazolyl, pyrazolyl, thiadiazolyl, oxadiazolyl or pyrrolidinyl group.

Examples of the preferred timing groups are as follows:

(1)

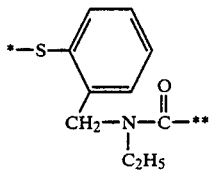

(2)

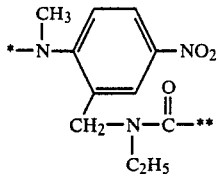

(3)

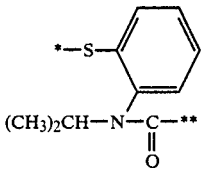

(4)

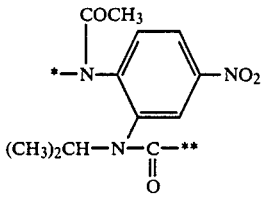

(5)

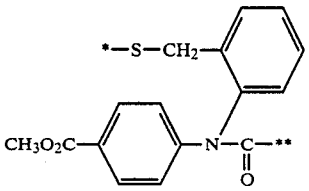

(6)

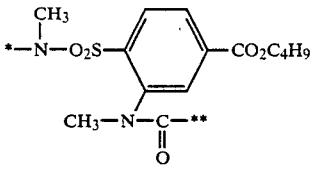

(7)

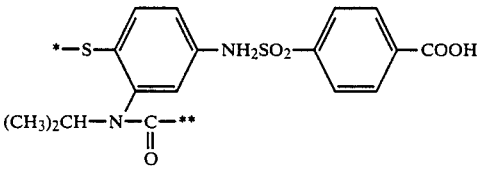

-continued (8)

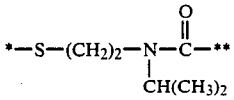

(9)

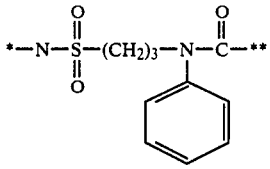

(10)

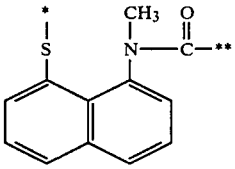

(11)

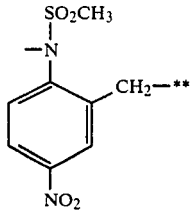

(12)

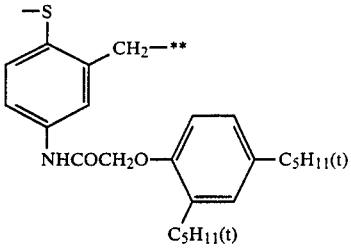

(13)

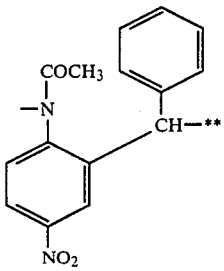

(14)

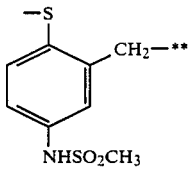

(15)

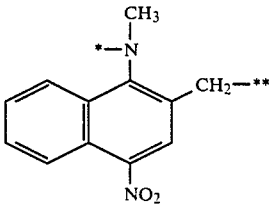

-continued
(16)
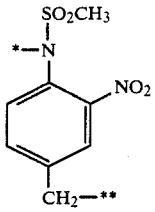
(17)
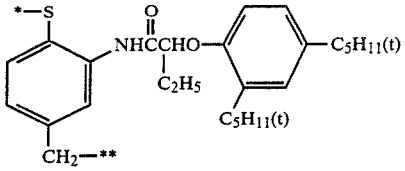
(18)
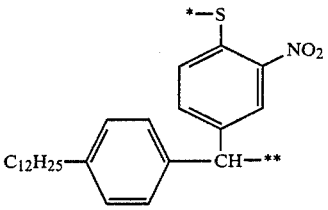
(19)
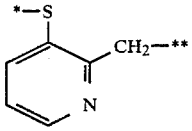
(20)
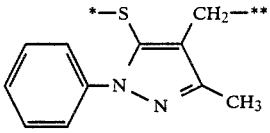
(21)
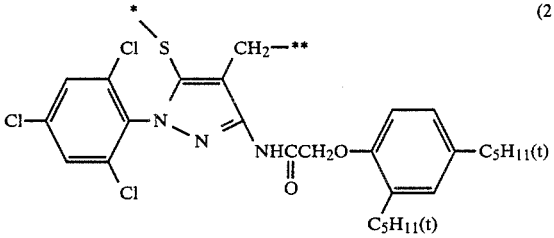
(22)
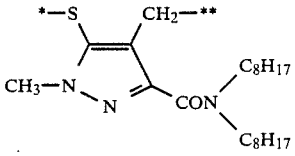
(23)
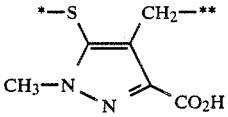
(24)
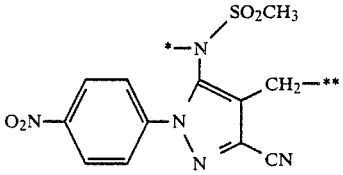
-continued
(25)
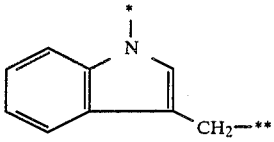
(26)
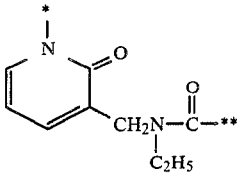
(27)
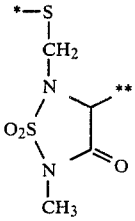
(28)
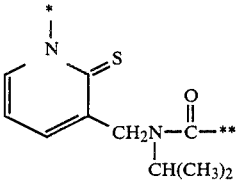
(29)
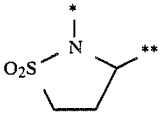
(30)
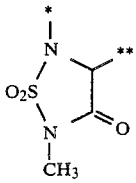
(31)
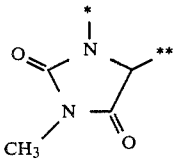
(32)
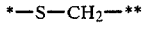
(33)
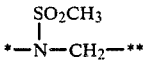
(34)
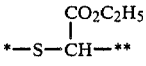
(35)
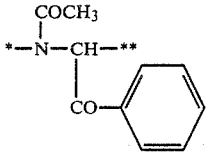

-continued

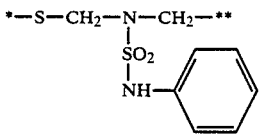

(36)

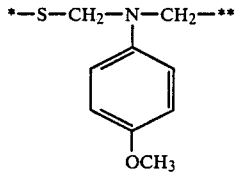

(37)

PUG represents a photographically useful group as H-Time-PUG, ⊖Time-PUG or PUG.

Examples of the photographically useful groups include development inhibitors, development accelerators, fogging agents, couplers, coupler releasing couplers, diffusive or undiffusive dyes, desilverization accelerators, desilverization inhibitors, solvents for silver halides, competitive compounds, developing agents, auxiliary developing agents, fixation accelerators, fixation inhibitors, image stabilizers, color toning agents, processing-dependency improvers, dot improvers, color image stabilizers, desensitizers, chemical sensitizers, UV absorbers and fluorescent whitening agents. The photographically useful groups may also be the precursors of these agents. As these photographically useful groups frequently overlap in respect of utility, a concrete explanation will be given for representative examples. (PUG may be attached to Time at any position as long as the bond of Time to PUG is ruptured at this position during the development, but when Time is simply a chemical bond, the PUG is attached to $C_B$ through a sulfur, nitrogen, or selenium atom.)

Exemplary development inhibitors include: compounds having a mercapto group attached to a hetero ring, such as substituted or unsubstituted mercaptoazoles (specifically, 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,2,4-triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-[3-(3-methylureido)-phenyl]-5-mercaptotetrazole, 1-(4-nitrophenyl)-5-mercaptotetrazole, and 5-(2-ethylhexanoylamino)-2-mercaptobenzimidazole), substituted or unsubstituted mercaptoazaindenes (specifically, 6-methyl-4-mercapto-1,3,3a,7-tetraazaindene, 6-methyl-2-benzyl-4-mercapto-1,3,3a,7-tetraazaindene, 6-phenyl-4-mercaptotetraazaindene, and 4,6-dimethyl-2-mercapto-1,3,3a,7-tetraazaindene), substituted or unsubstituted mercaptopyrimidines (specifically, 2-mercaptopyrimidine, 2-mercapto-4-methyl-6-hydroxypyrimidine, and 2-mercapto-4-propylpyrimidine), heterocyclic compounds which are able to form iminosilver, such as substituted or unsubstituted benzotriazoles (specifically, benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butylbenzotriazole, 5-nitro-6-chlorobenzotriazole, 5,6-dimethylbenzotriazole, and 4,5,6,7-tetrachlorobenzotriazole), substituted or unsubstituted indazoles (specifically, indazole, 5-nitroindazole, 3-nitroindazole, 3-chloro-5-nitroindazole, 3-cyanoindazole, 3-n-butylcarbamoylindazole, and 5-nitro-3-methanesulfonylindazole) and substituted or unsubstituted benzimidazoles (specifically, 5-nitrobenzimidazole, 4-nitrobenzimidazole, 5,6-dichlorobenzimidazole, 5-cyano-6-chlorobenzimidazole, and 5-trifluoromethyl-6-chlorobenzimidazole).

The following formula (III) may be given for an example of the PUG in the case of its being a development accelerator.

$$***-L_1\text{-}(L_2)_k A \qquad \text{(III)}$$

wherein symbol * expresses the position of bond to the Time when the Time is present and expresses that to $C_B$ when the Time is absent, and when there are two or more symbols *, the PUG bonds to the Time or $C_B$ at any one position expressed by symbol ***; $L_1$ expresses a group which can be further released from the released Time; $L_2$ is a divalent bonding group; k is an integer of 0 or 1; and A is a group which substantially exhibits a fogging action against a silver halide emulsion in a developer.

Preferable examples of $L_1$ include aryloxy, heterocyclic oxy, arylthio, alkylthio, heterocyclic thio and azolyl groups.

The following are the specific compounds of $L_1$.

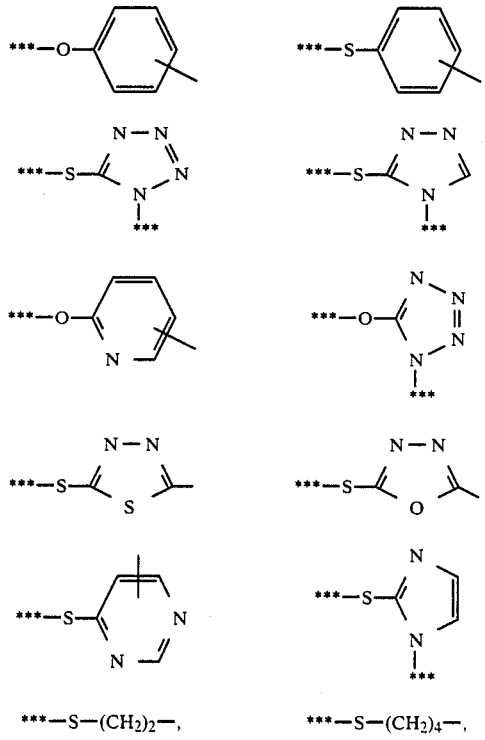

*—S—$(CH_2)_2$—, *—S—$(CH_2)_4$—,

-continued

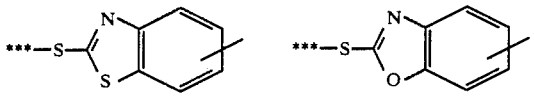

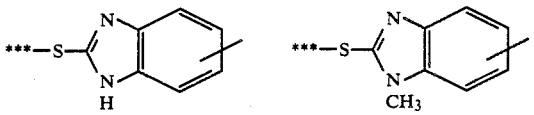

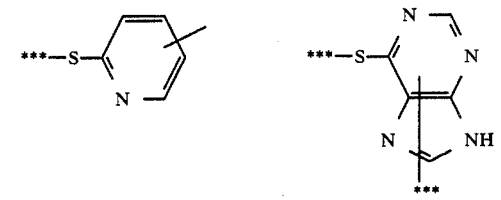

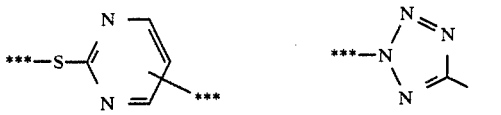

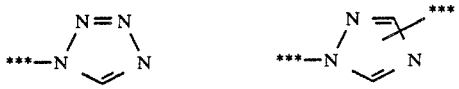

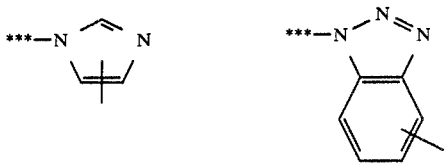

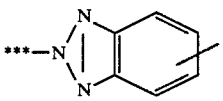

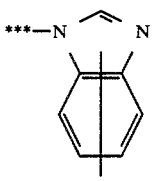

Examples of $L_2$ include alkylene, alkenylene, arylene, divalent heterocyclic, —O—, —S—, imino, —COO—, —CONH—, —NHCONH—, —NHCOO—, —$SO_2$NH—, —CO—, —$SO_2$—, —SO—, —NH-$SO_2$NH— groups and the complexes of these groups.

Preferable examples of A include reducing groups such as those having a partial structure of hydrazine, hydrazide, hydrazone, hydroxylamine, polyamine, enamine, hydroquinone, catechol, p-aminophenol, o-aminophenol, aldehyde or acetylene, groups capable of acting on silver halides during development to form a developable silver sulfide center, such as those having a partial structure of thiourea, thioamide, thiocarbamate, dithiocarbamate, thiohydantoin or rhodanine, and quaternary salts such as pyridinium salt.

Of the groups represented by A, particularly useful one is that represented by formula (IV).

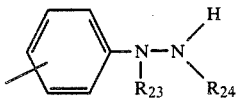

(IV)

wherein $R_{23}$ represents a hydrogen atom, a sulfonyl or alkoxycarbonyl group, and $R_{24}$ represents an acyl, sulfonyl, carbamoyl, alkoxycarbonyl, sulfamoyl, thioacyl, thiocarbamoyl, or heterocyclic group. The benzene ring of formula (IV) may overlap with the benzene ring of $L_1$ of formula (III). Preferable specific examples of formula (III) will be given below.

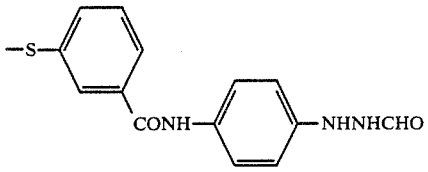

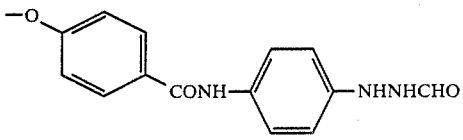

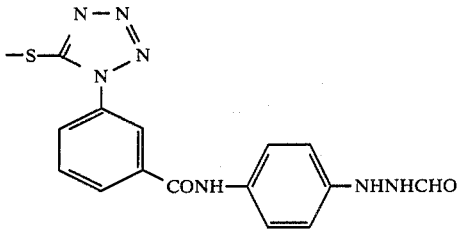

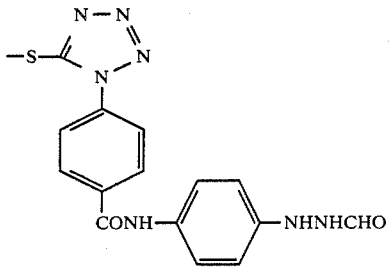

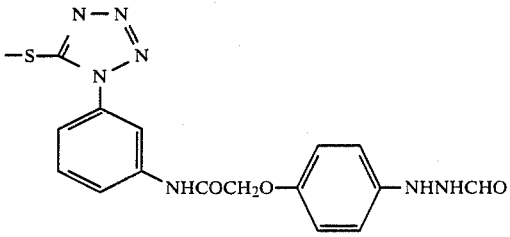

-continued

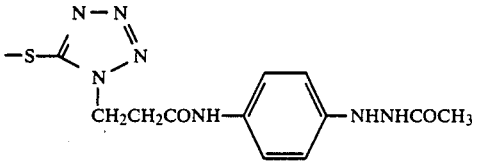

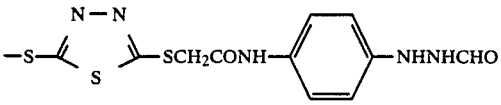

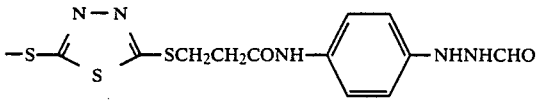

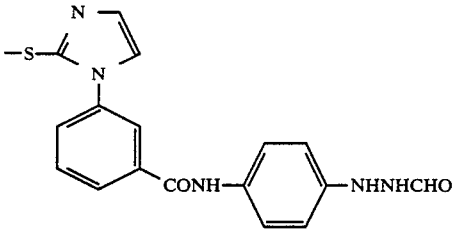

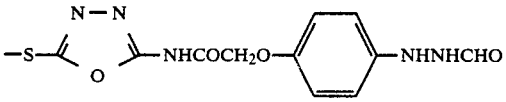

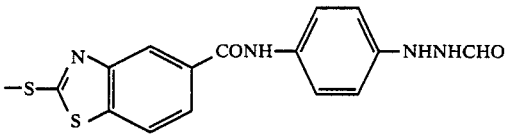

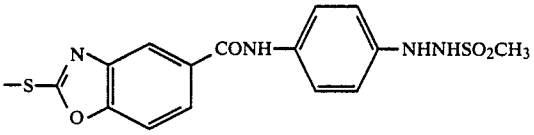

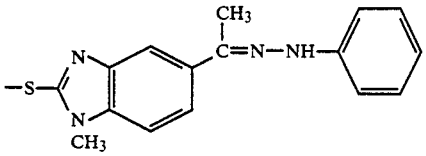

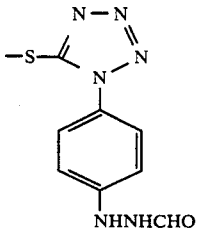

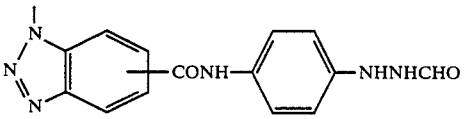

-continued

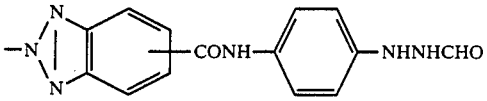

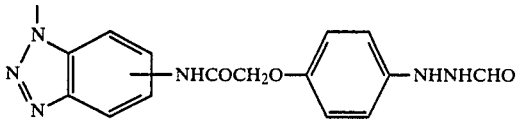

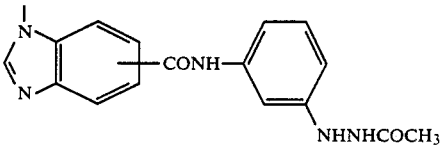

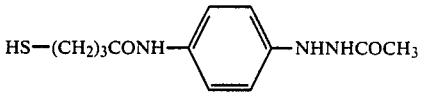

The groups represented below by formulae (V), (VI), and (VII) are examples of PUG in the case of PUG being a solvent for silver halides. In these formulae, the symbol (*)(*)(*) expresses the position of bond to the Time.

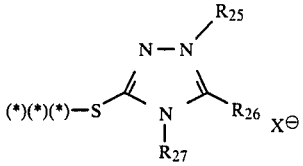

(V)

wherein $R_{25}$ and $R_{27}$ each represents a substituted or unsubstituted alkyl, aryl, amino, alkoxy, or heterocyclic group; $R_{26}$ represents a hydrogen atom, a substituted or unsubstituted alkyl, aryl, or heterocyclic group; $X^-$ represents an organic or inorganic anion; and $R_{25}$ and $R_{26}$ or $R_{26}$ and $R_{27}$ may link with each other to form a saturated or unsaturated carbocyclic or heterocyclic ring.

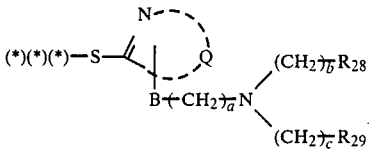

(VI)

wherein Q represents a heterocyclic formed by atoms selected from carbon, nitrogen, oxygen, and sulfur atoms; $R_{28}$ and $R_{29}$ each represents a hydrogen atom, a hydroxyl, carboxyl, sulfo, sulfamoyl, carbamoyl, sulfonamide, acylamino, or amino group; B represents a chemical bond or an oxygen or sulfur atom; a represents an integer of 0, 1, 2 or 3; and b and c each represents an integer of 0, 1, or 2.

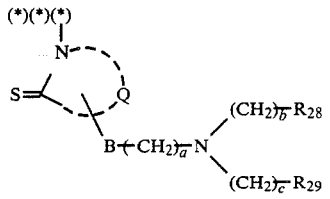
(VII)
wherein Q, B, $R_{28}$, $R_{29}$, a, b and c have the same meanings as those defined for formula (VI).
Examples of compounds represented by formulae (V), (VI), and (VII) are set forth below.
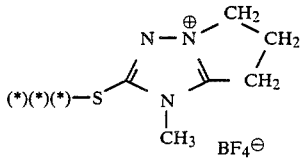
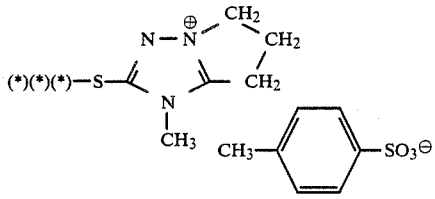
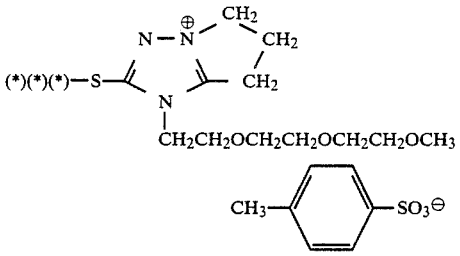
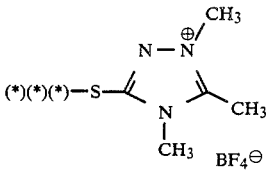
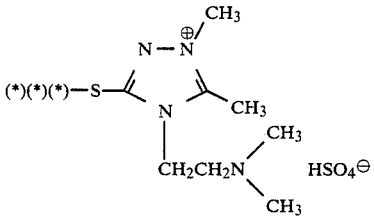
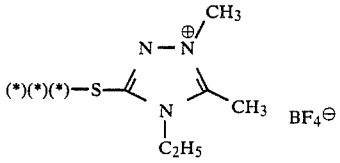
-continued
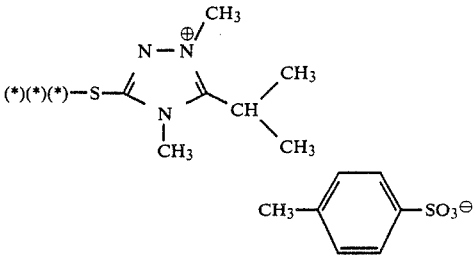
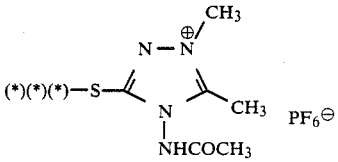
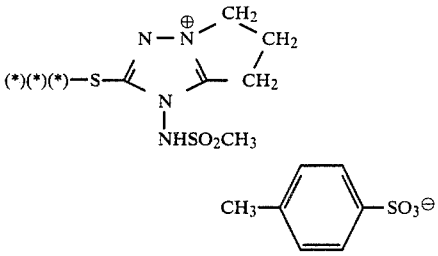
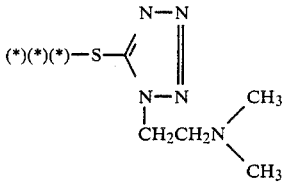
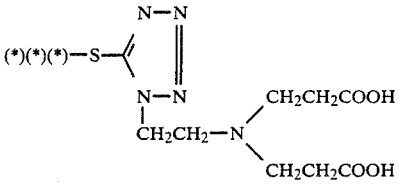
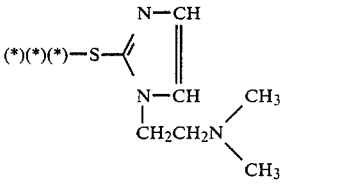
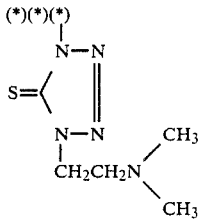

-continued

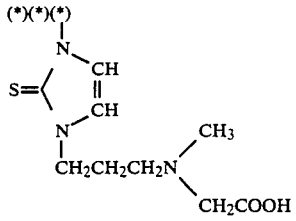

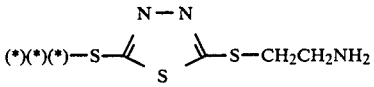

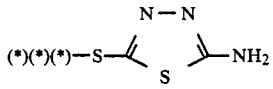

Examples of PUG as a diffusible or non-diffusible dye include dyes such as azo, azomethine, azopyrazolone, indoaniline, indophenol, anthraquinone, triarylmethane, alizarine, nitro, quinoline, indigo, and phthalocyanine. Leuco compounds thereof, i.e., compounds whose absorption wavelength is temporarily shifted, and dye precursors such as tetrazolium salts may also be included. Further, such dyes may form chelate dyes with suitable metals. Such dyes are described, for example, in U.S. Pat. Nos. 3,880,658, 3,931,144, 3,932,380, 3,932,381, and 3,942,987.

The preferred dyes and dye precursors are azo, azomethine, and indoaniline dyes and their precursors. Specific examples of the preferable dye and dye precursors are set forth below.

1.

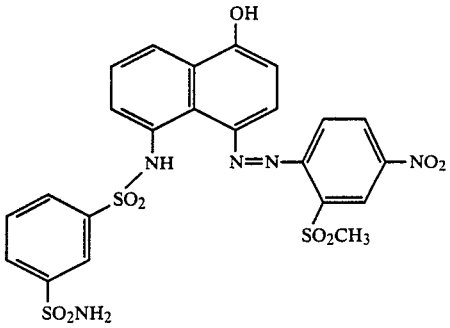

2.

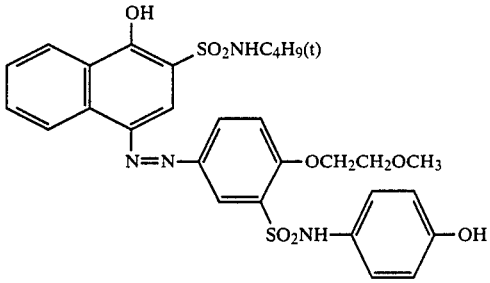

3.

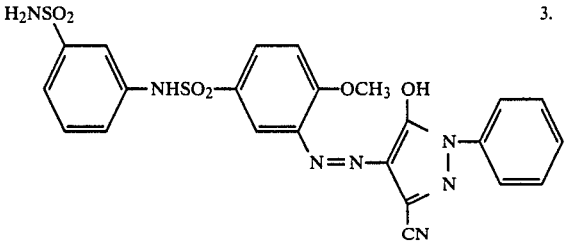

4.

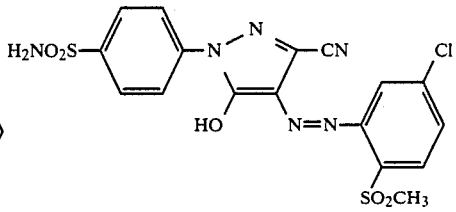

5.

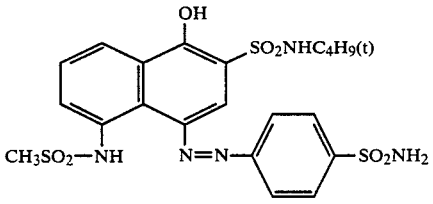

6.

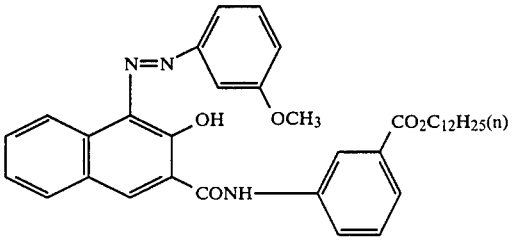

7.

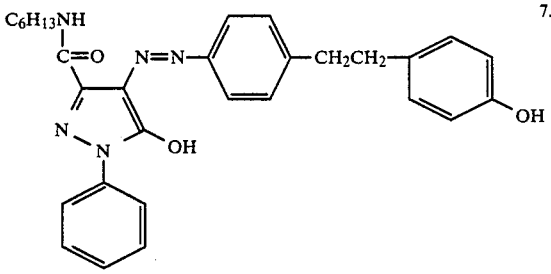

8.

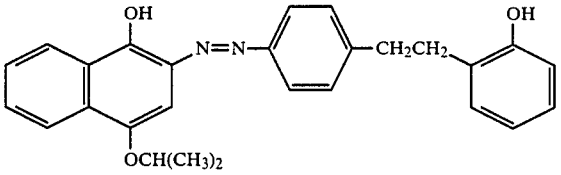

-continued
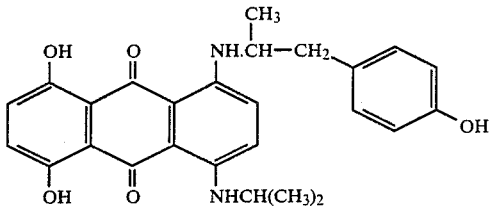
9.
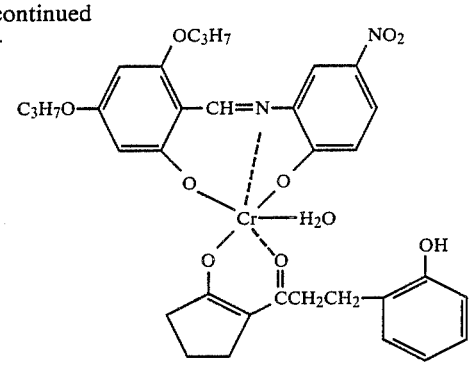
10.
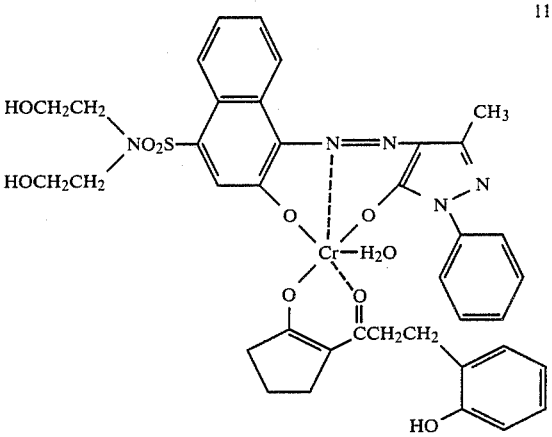
11.
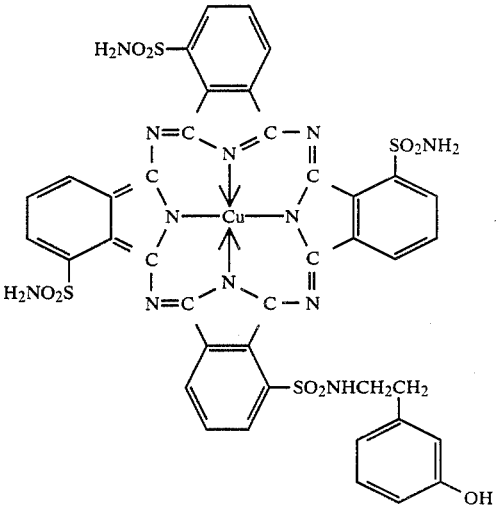
12.
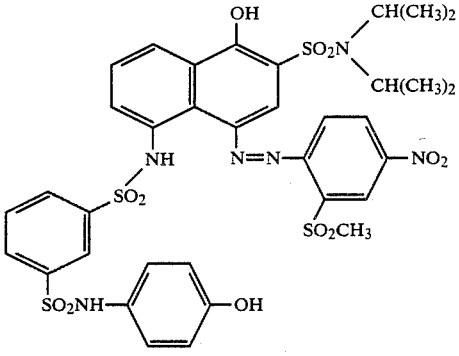
13.
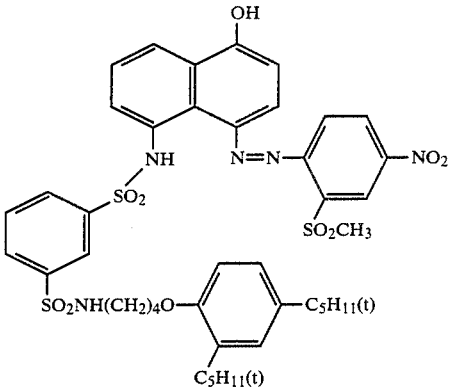
14.
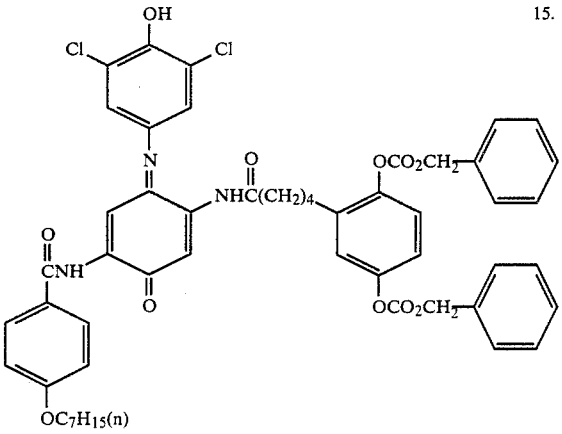
15.
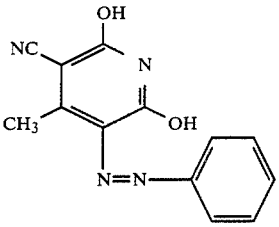
16.

-continued
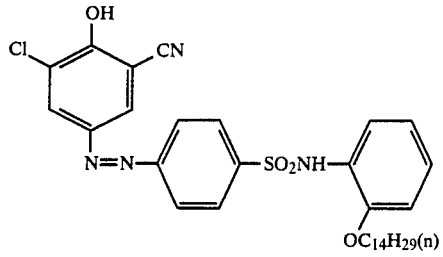
17.
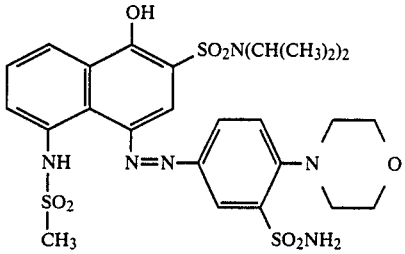
18.
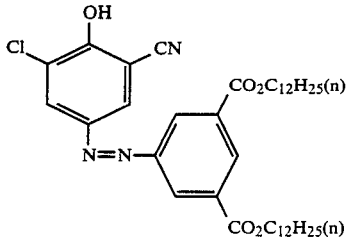
19.
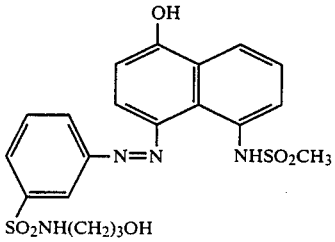
20.
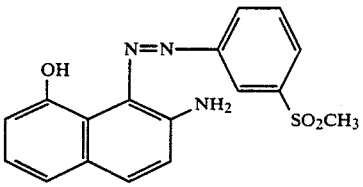
21.
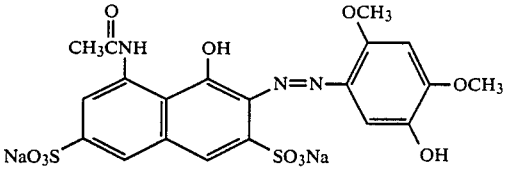
22.
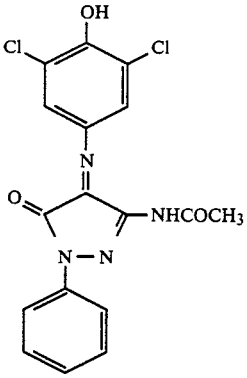
23.
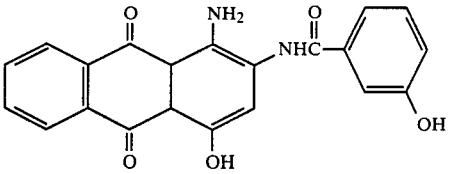
24.
25.
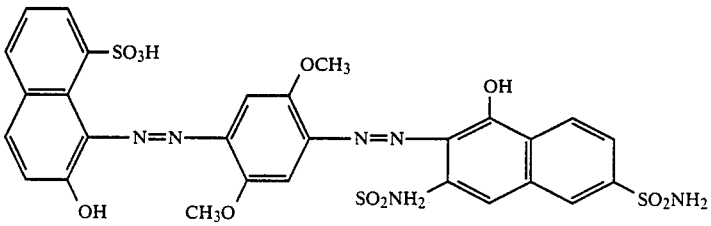
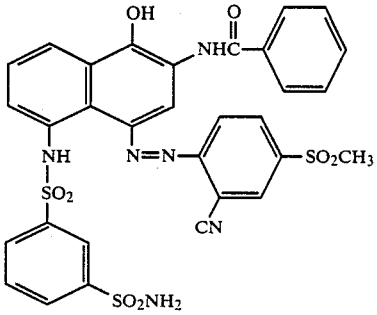
26.
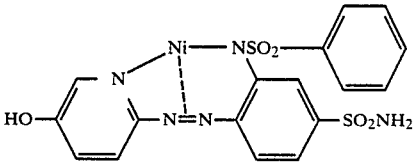
26'.

-continued
27.
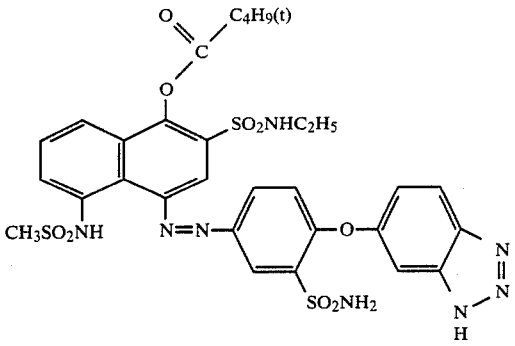
28.
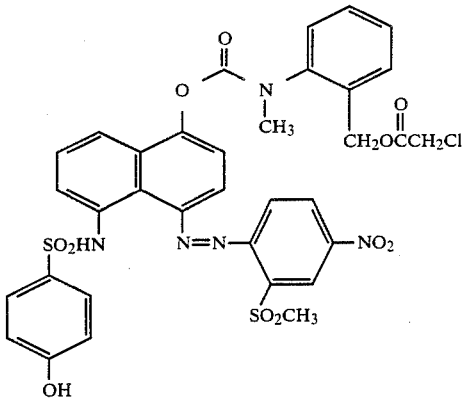
29.
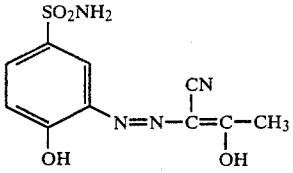
30.
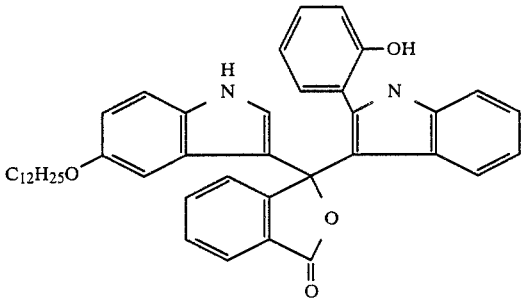
31.
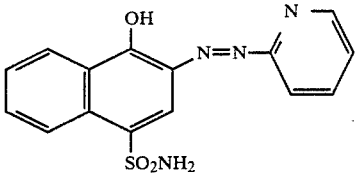
33.
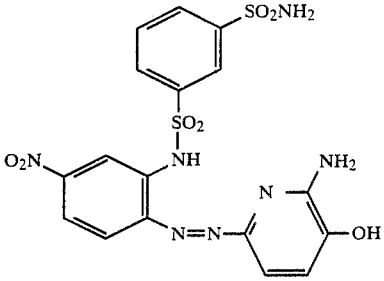
34.
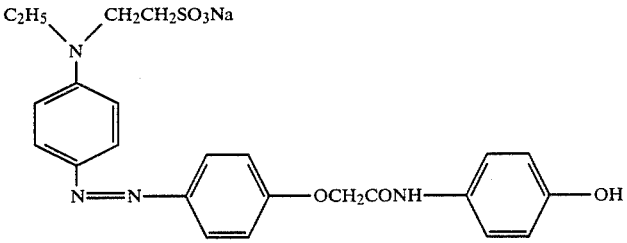
35.
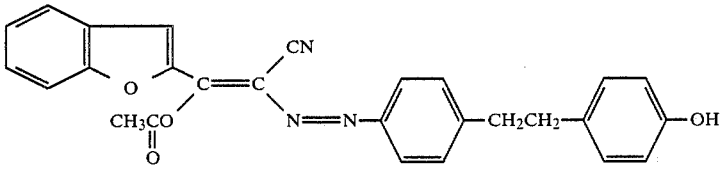

-continued
36.
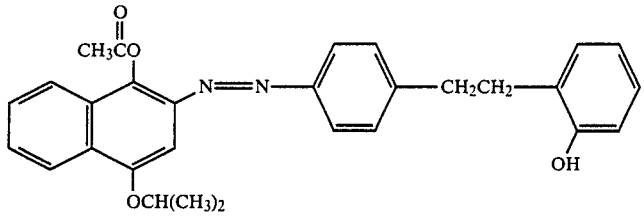
37.
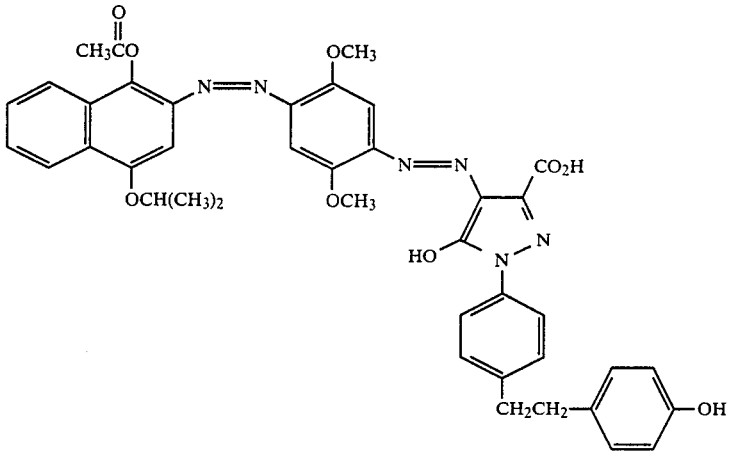
38.
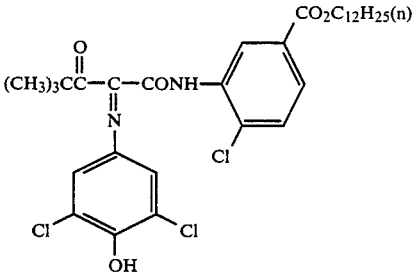
39.
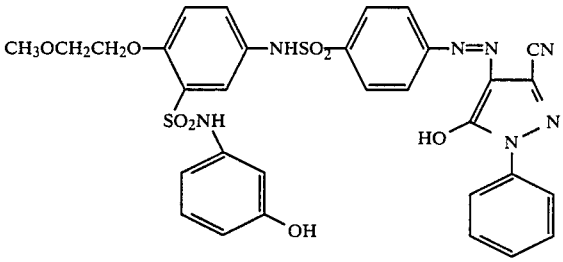
40.
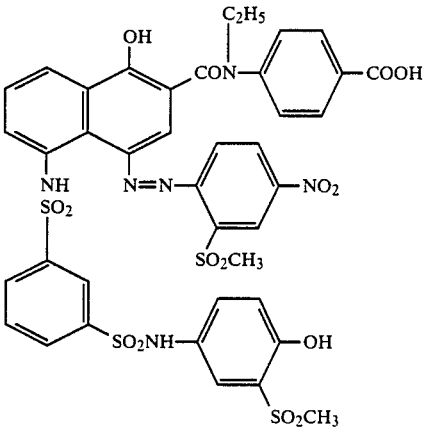
41.
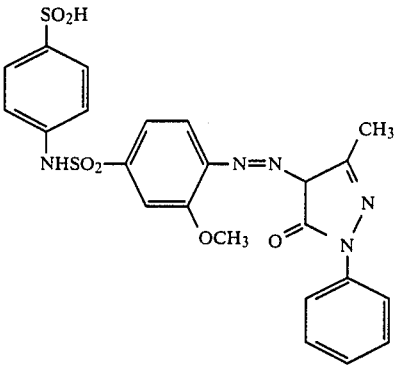

-continued
42.
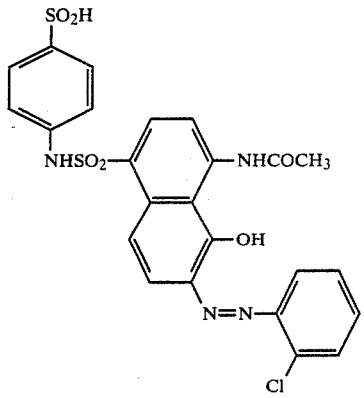
43.
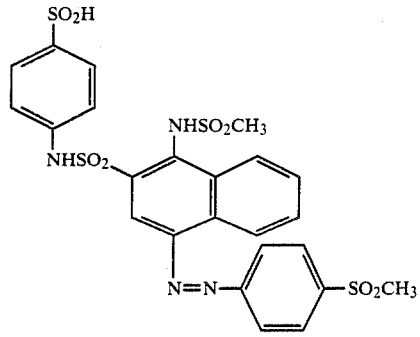
44.
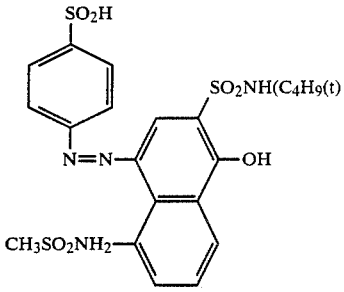
45.
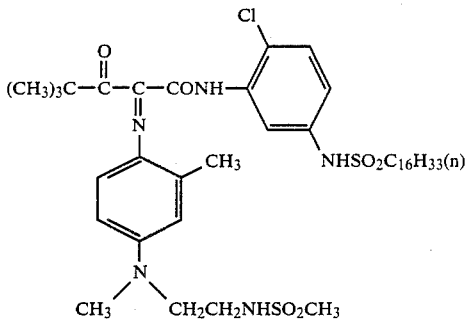
46.
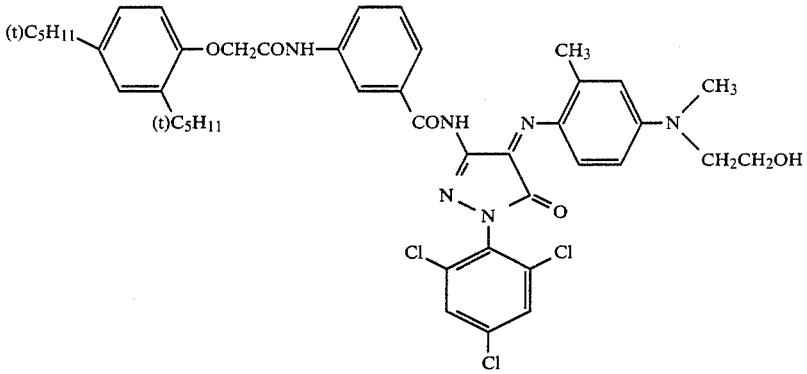
47.
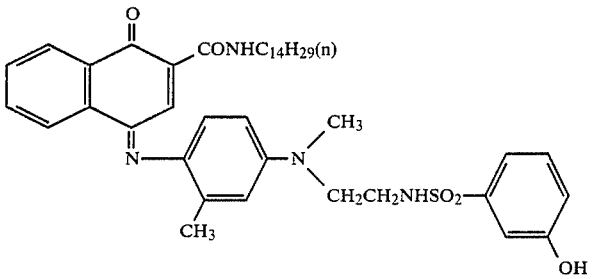
To describe the present invention in further detail, specific examples of the compounds represented by formula (I) are set forth below, but the compounds which can be used in the present invention are not to be construed as being limited to these compounds.

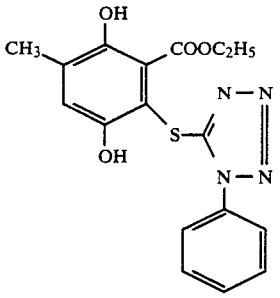
I-1
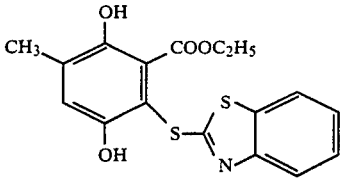
I-2
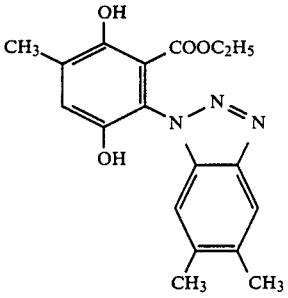
I-3
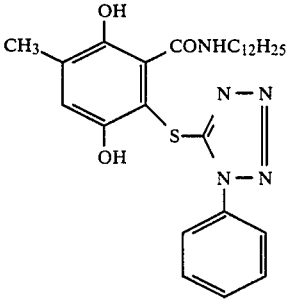
I-4
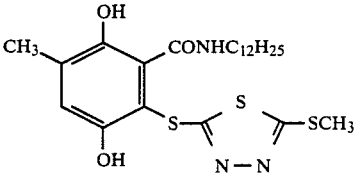
I-5
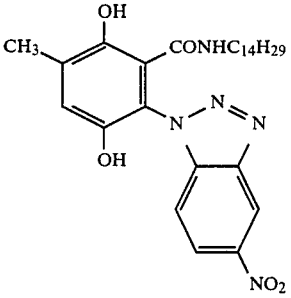
I-6
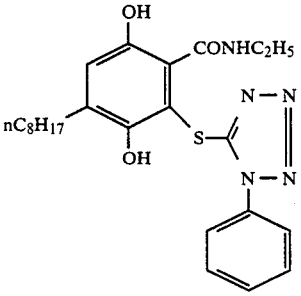
I-7
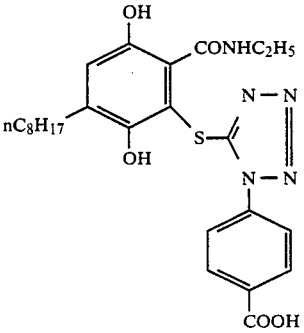
I-8
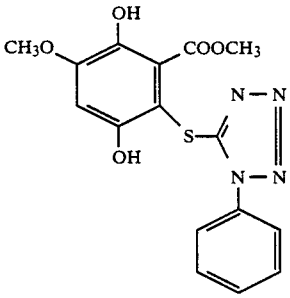
I-9
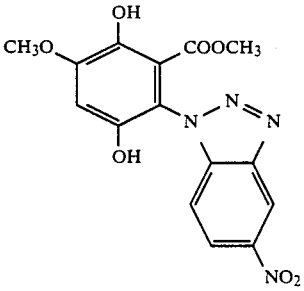
I-10

-continued
I-11
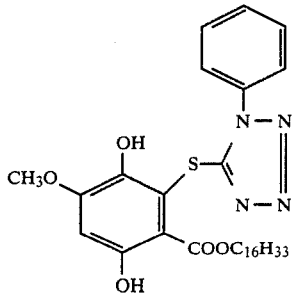
I-12
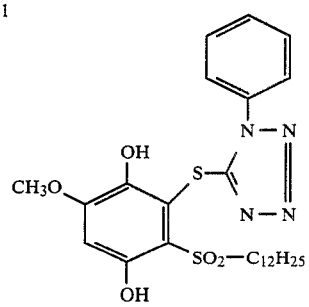
I-13
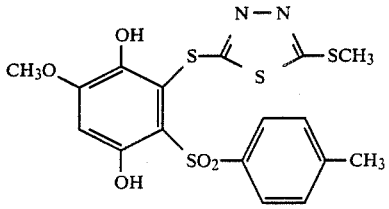
I-14
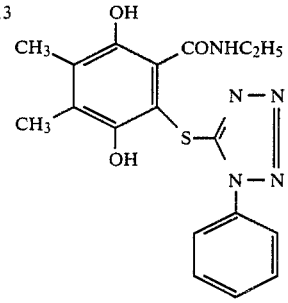
I-15
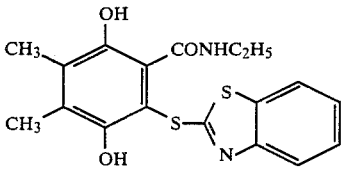
I-16
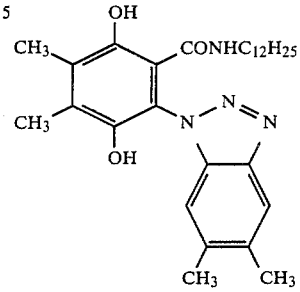
I-17
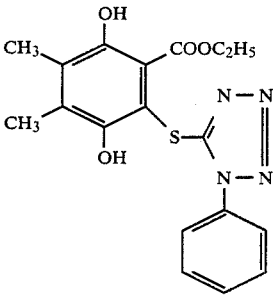
I-18
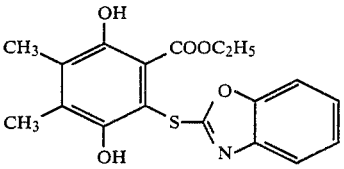
I-19
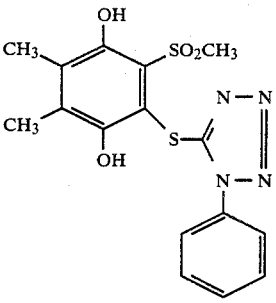
I-20
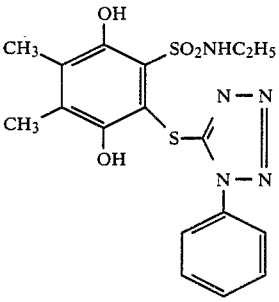

-continued
I-21
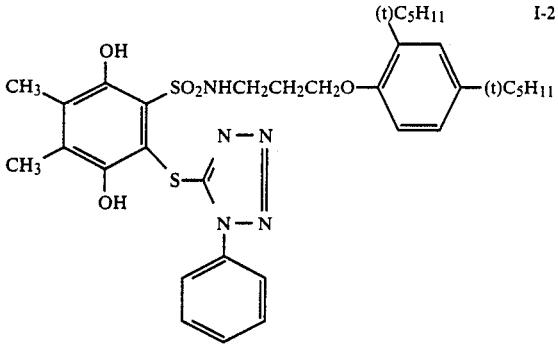
I-22
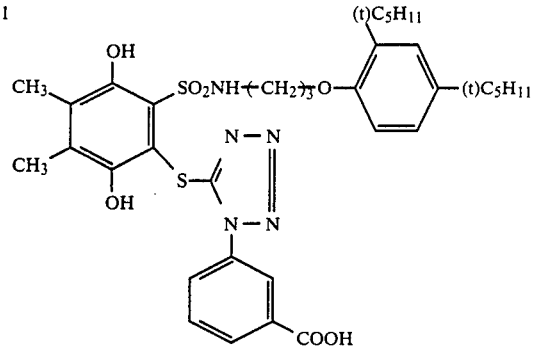
I-23
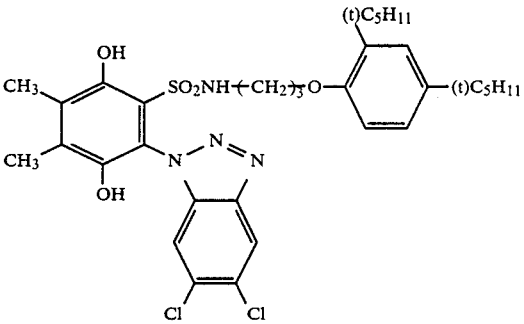
I-24
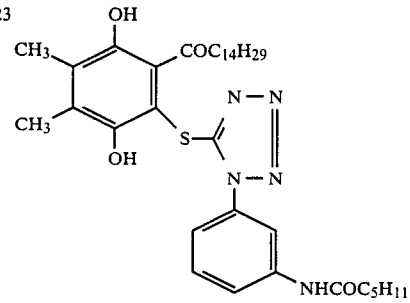
I-25
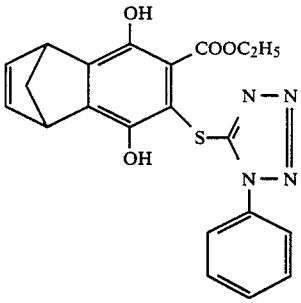
I-26
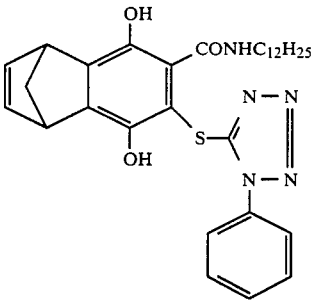
I-27
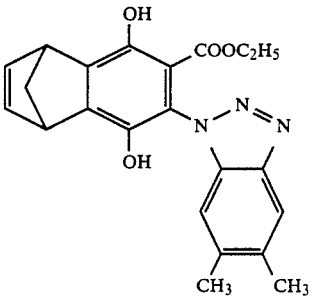
I-28
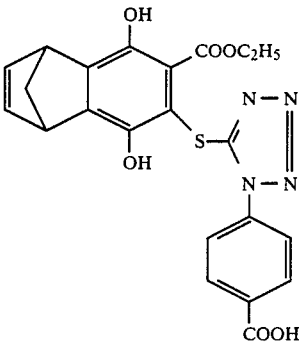
I-29
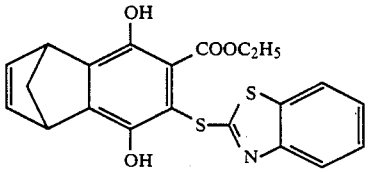
I-30
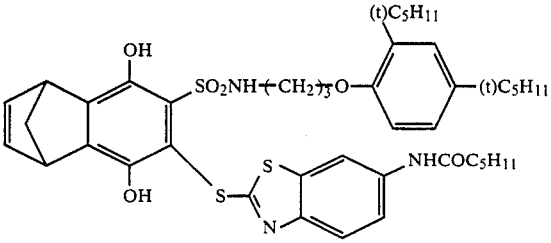

-continued
I-31
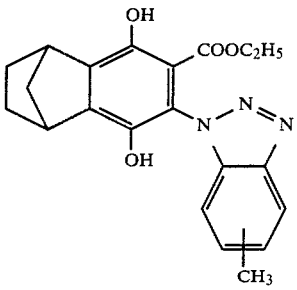
I-32
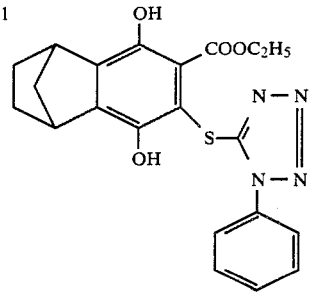
I-33
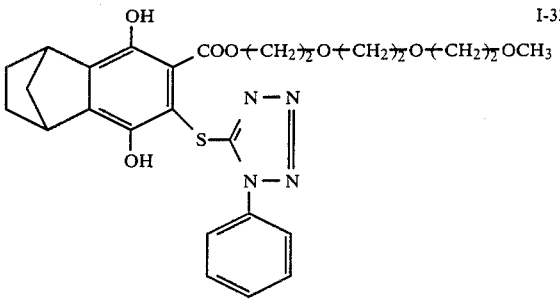
I-34
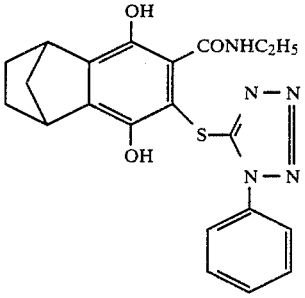
I-35
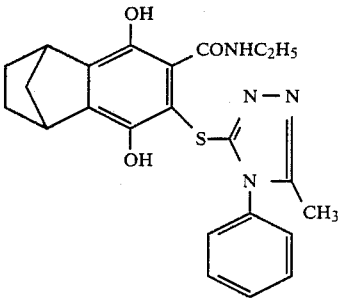
I-36
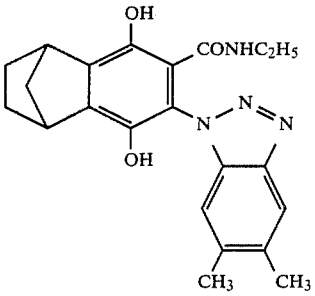
I-37
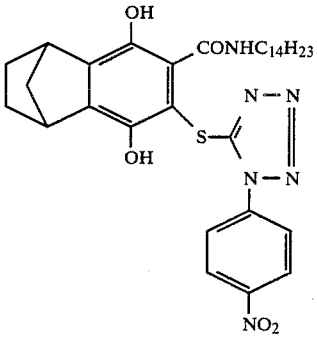
I-38
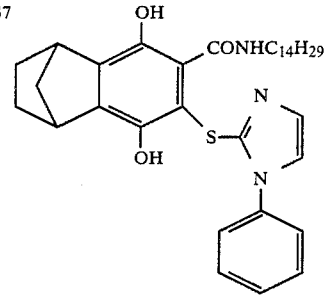
I-39
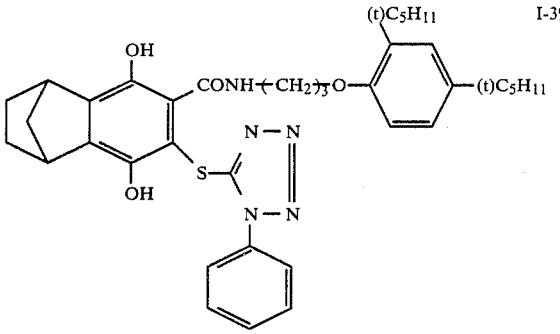
I-40
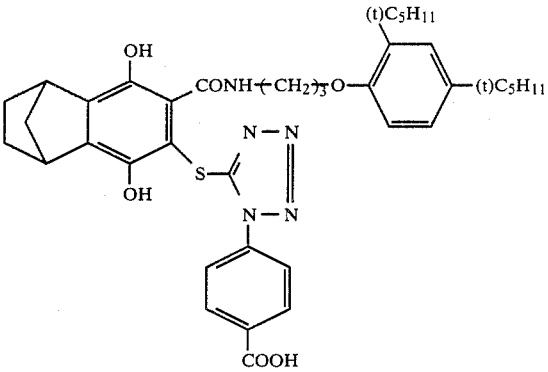

-continued
I-41
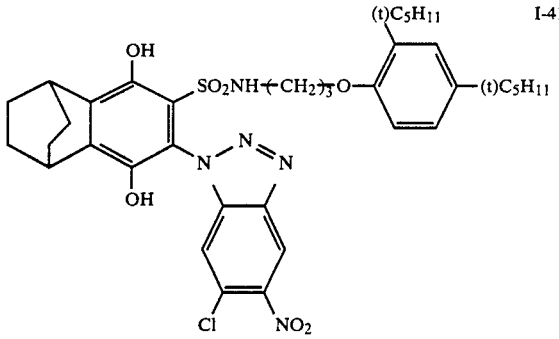
I-42
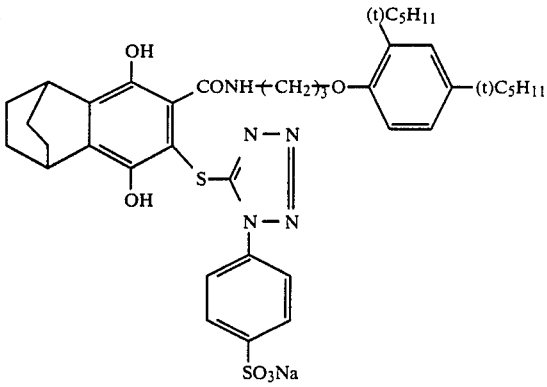
I-43
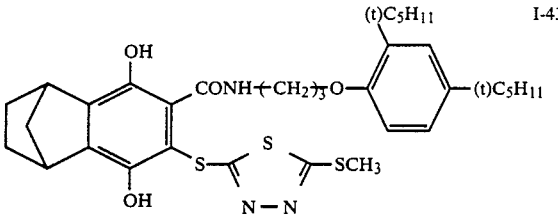
I-44
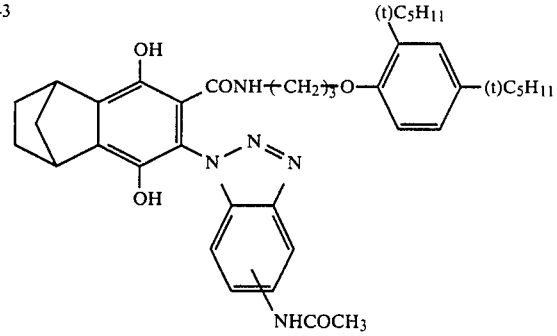
I-45
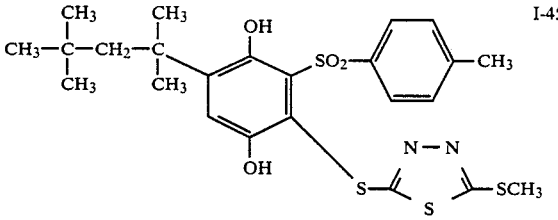
I-46
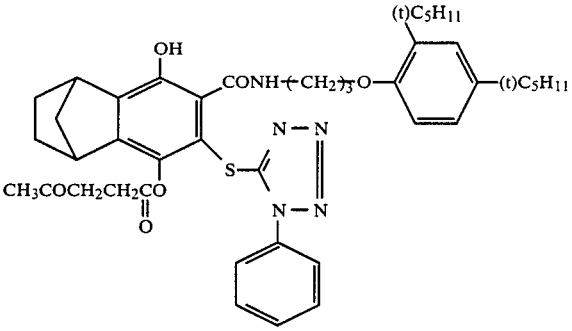
I-47
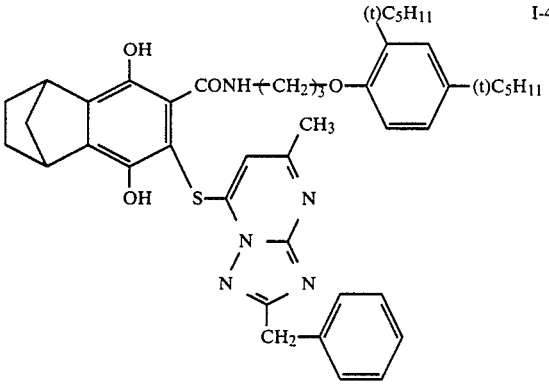
I-48
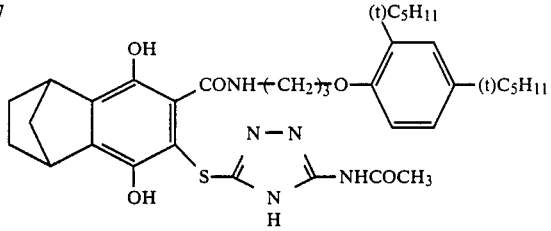

-continued
I-49
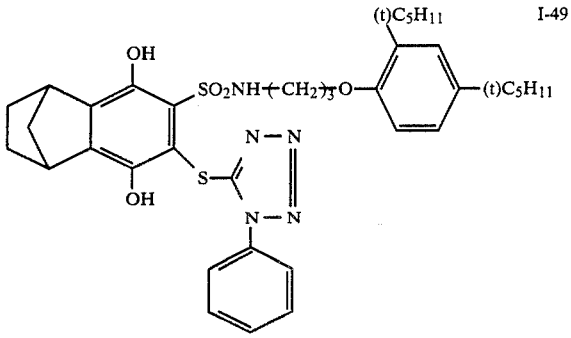
I-50
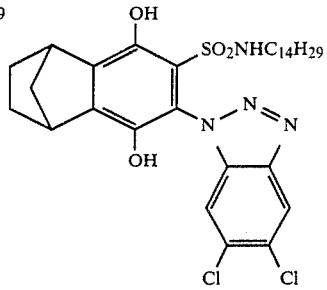
I-51
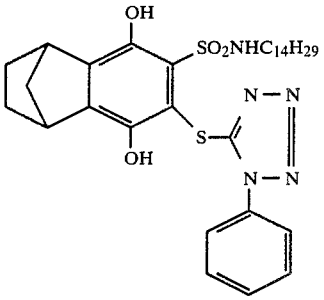
I-52
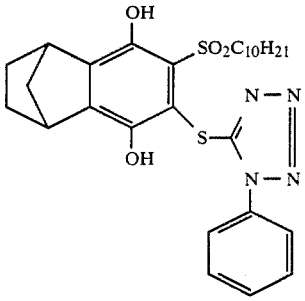
I-53
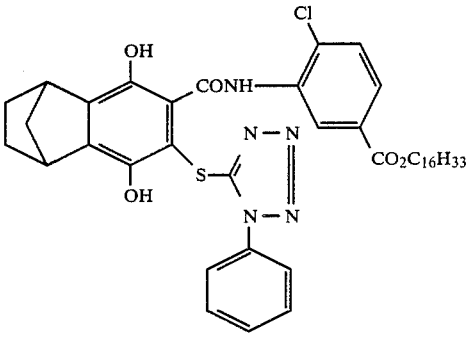
I-54
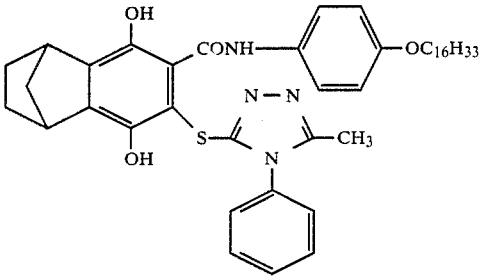
I-55
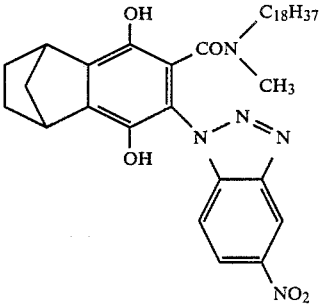
I-56
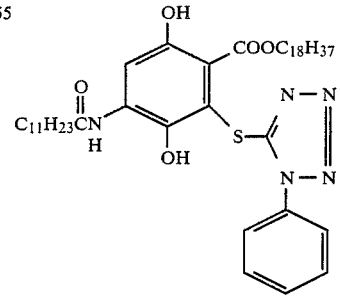
I-57
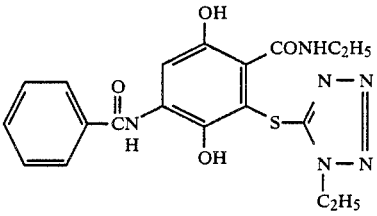
I-58
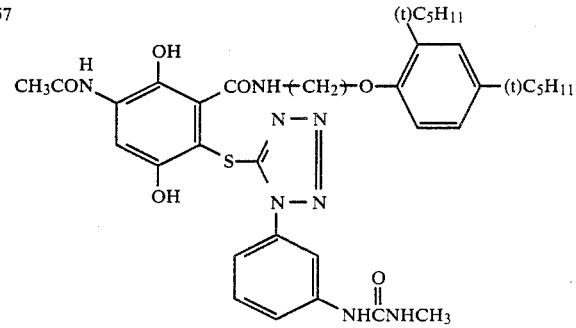

-continued
I-59
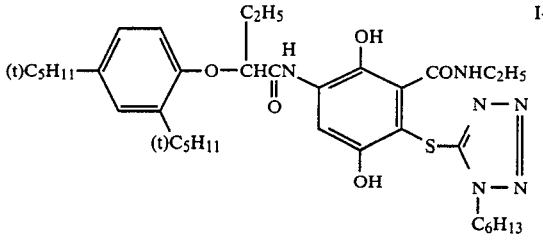
I-60
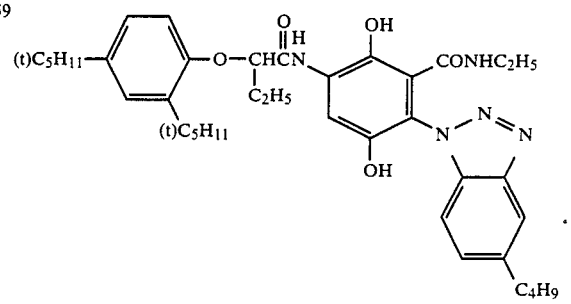
I-61
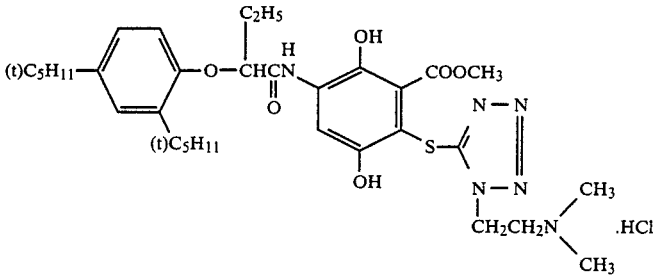
I-62
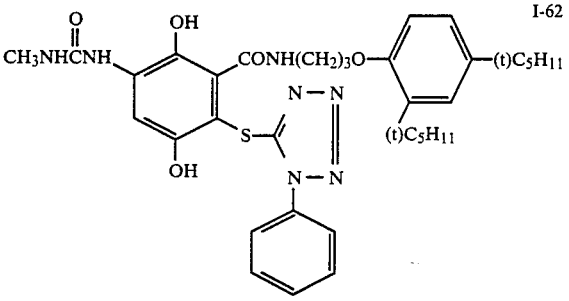
I-63
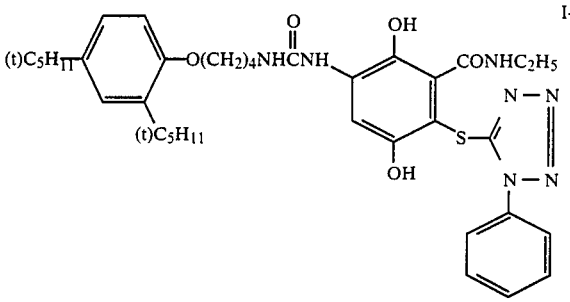
I-64
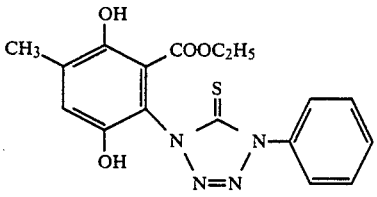
I-65
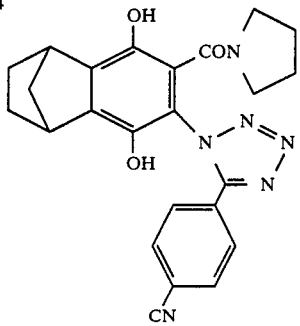
I-66
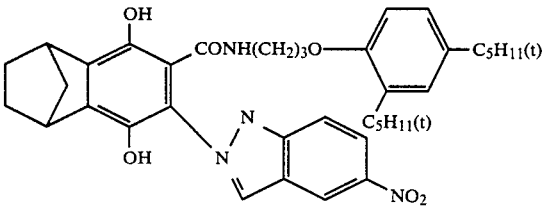

-continued
I-67
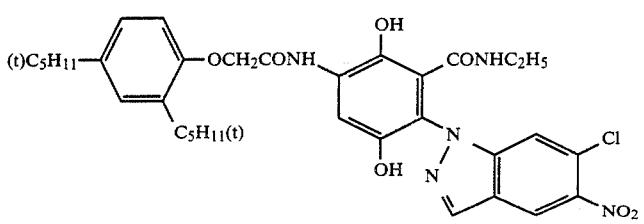
I-68
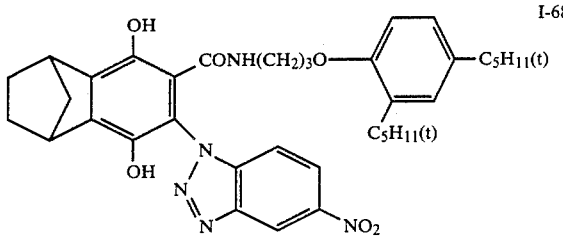
I-69
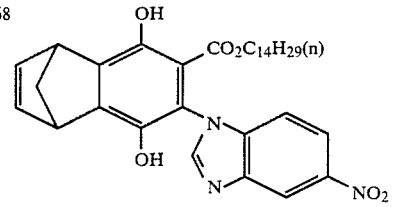
I-70
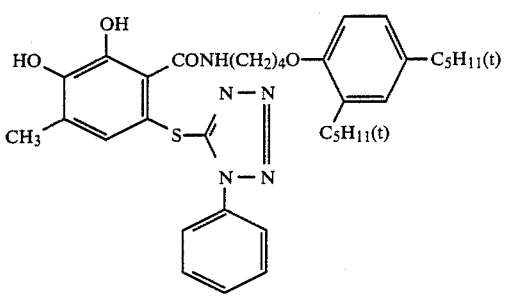
I-71
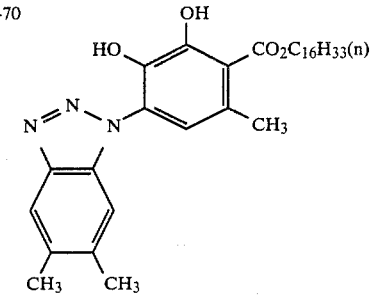
I-72
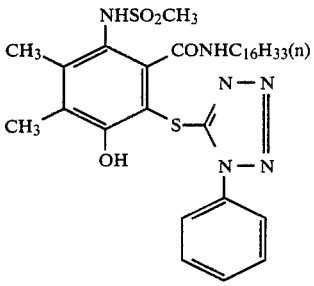
I-73
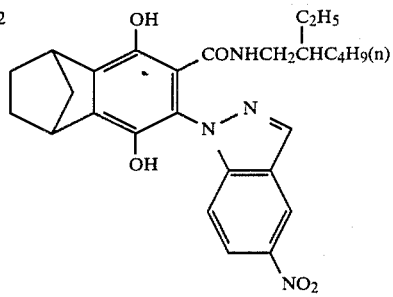
I-74
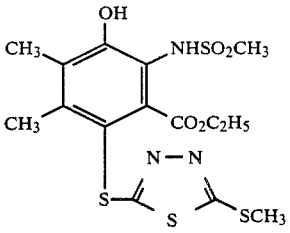
I-75
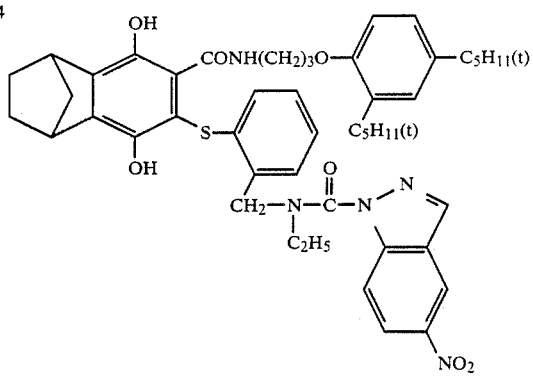

-continued
I-76
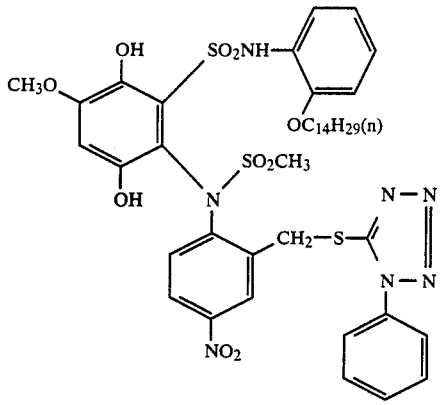
I-77
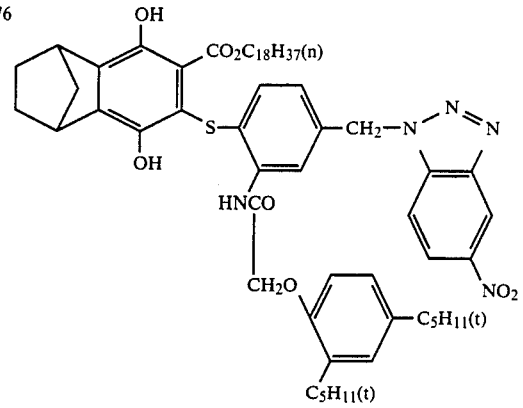
I-78
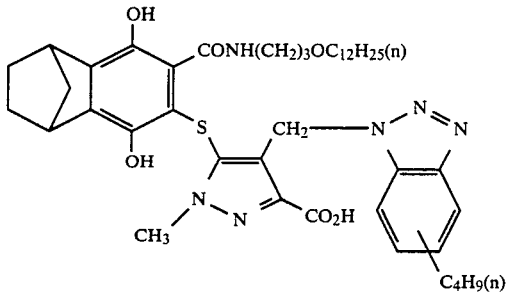
I-79
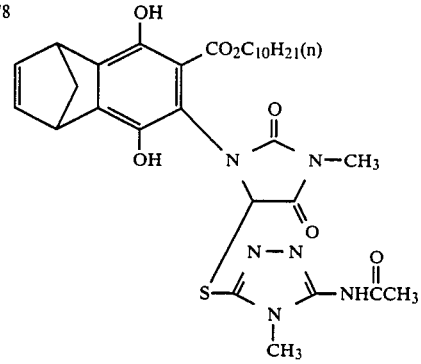
I-80
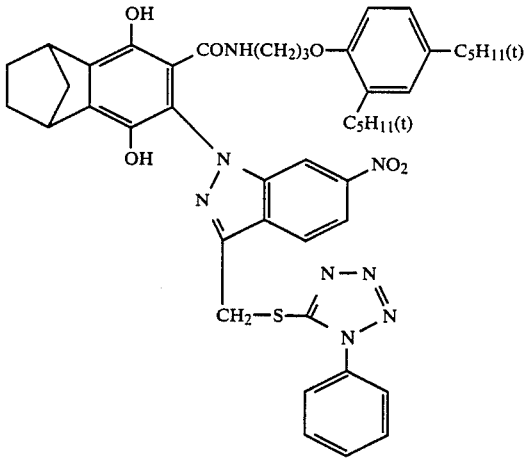
I-81
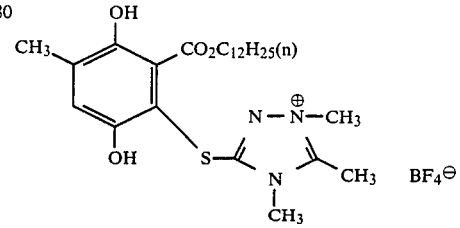
I-82
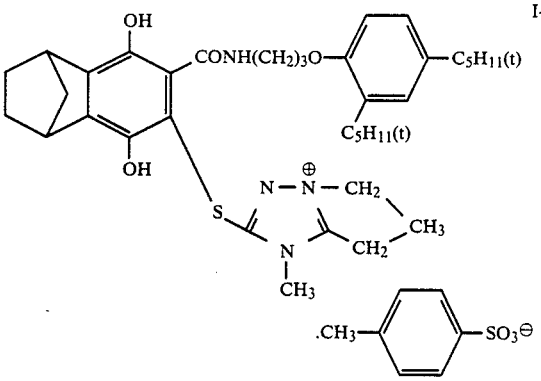
I-83
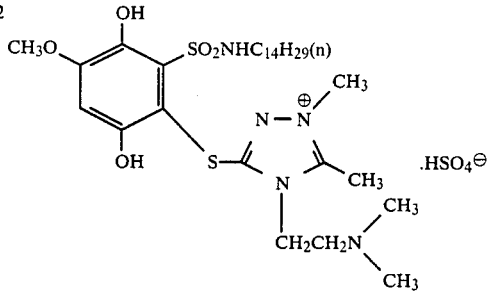

-continued
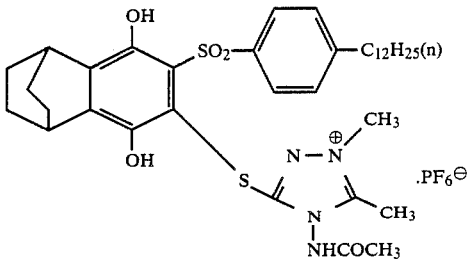
I-84
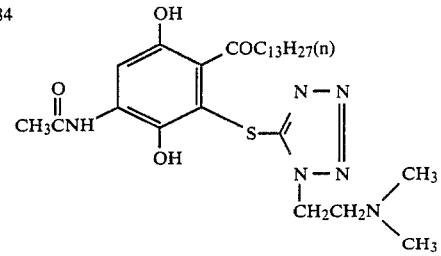
I-85
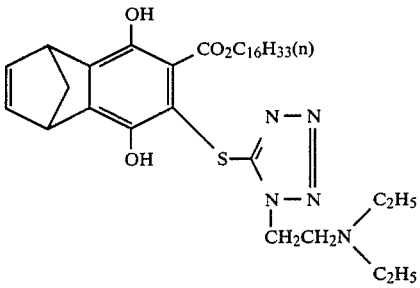
I-86
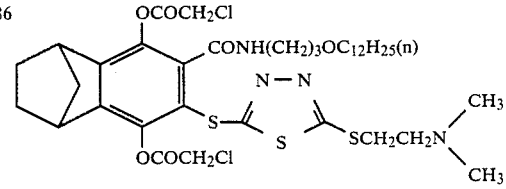
I-87
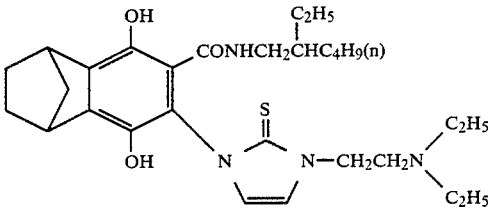
I-88
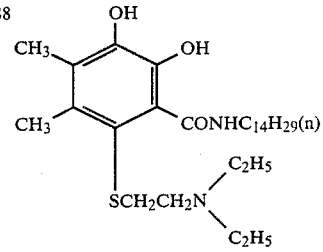
I-89
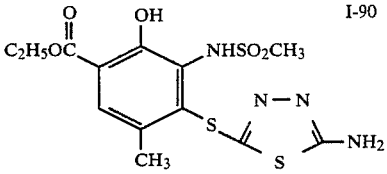
I-90
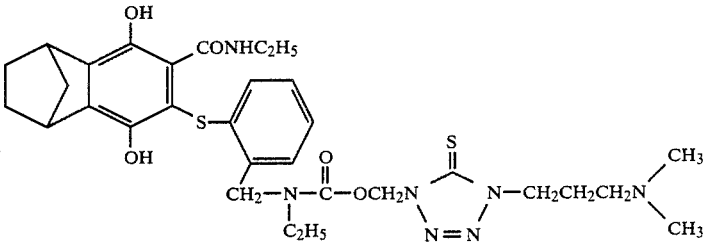
I-91
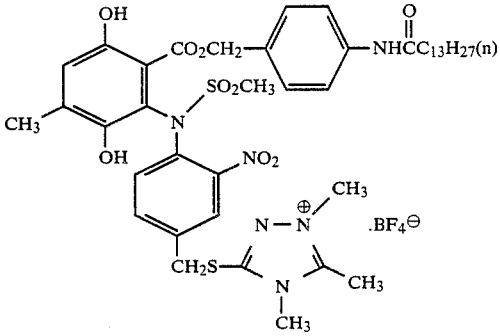
I-92

-continued
I-93
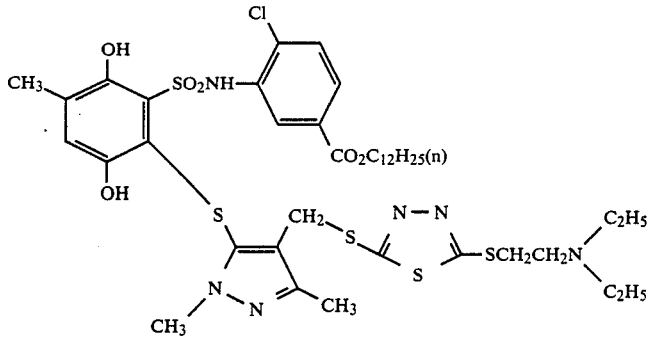
I-94
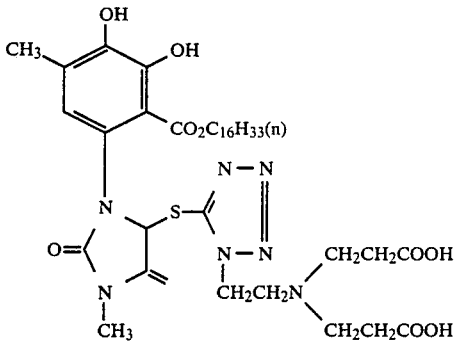
I-95
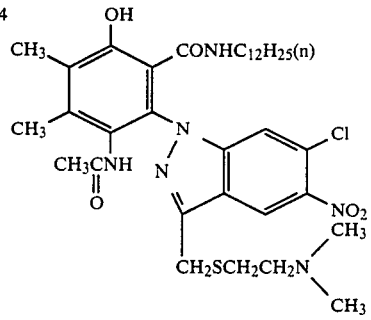
I-96
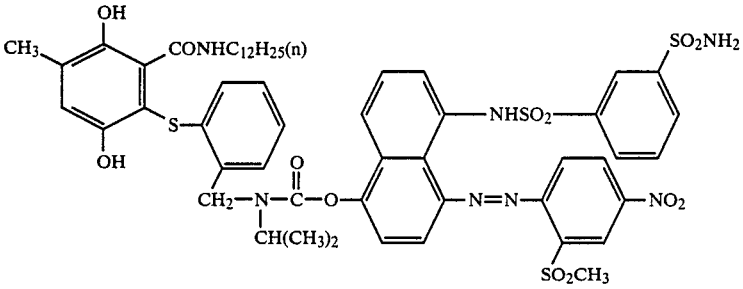
I-97
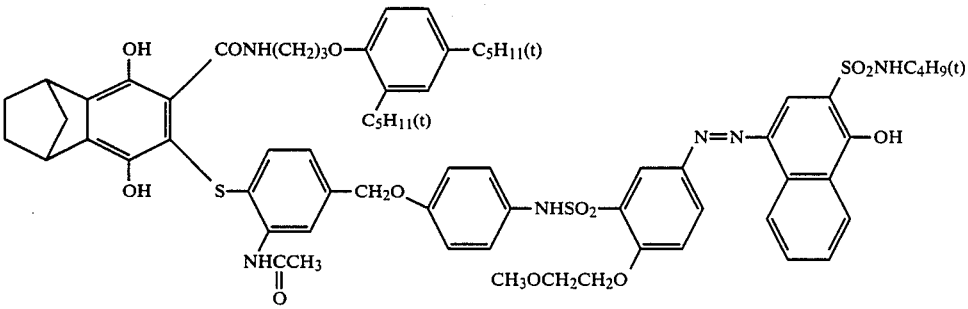
I-98
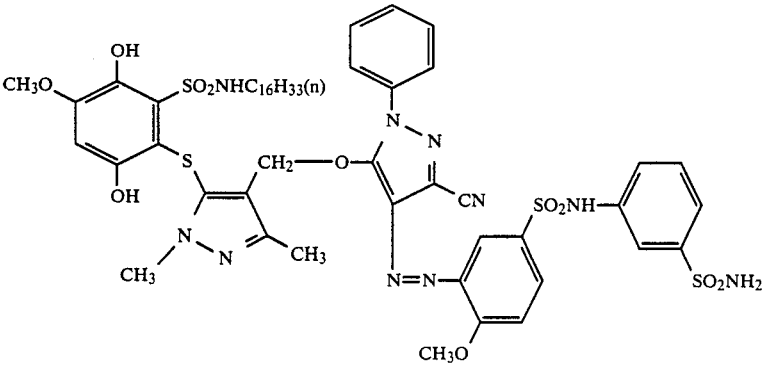

-continued
I-99
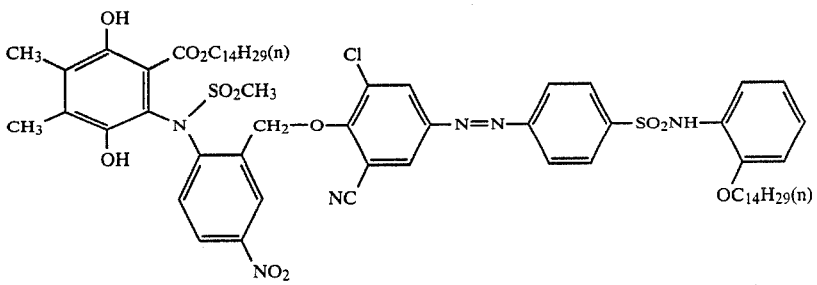
I-100
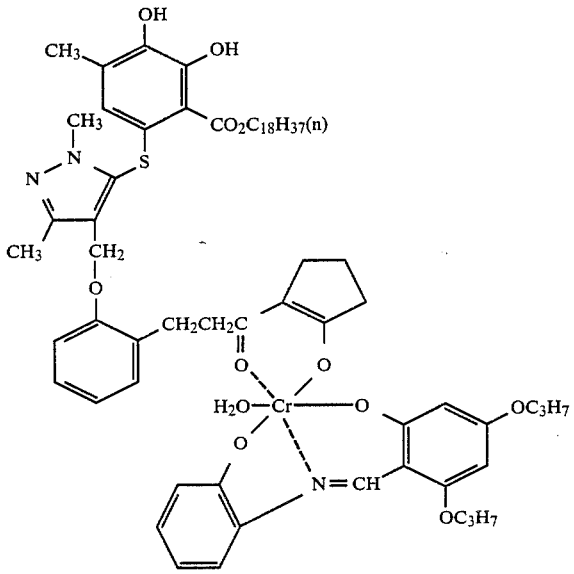
I-101
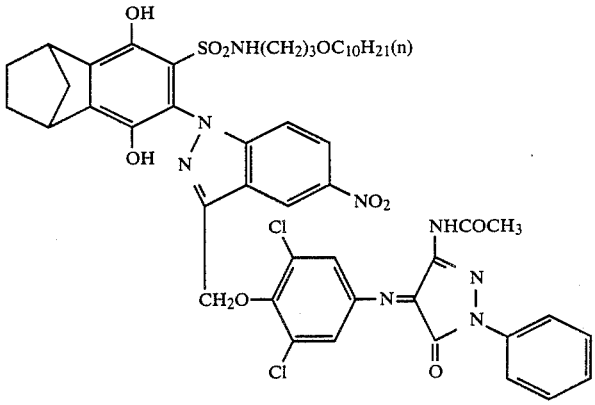

-continued
I-102
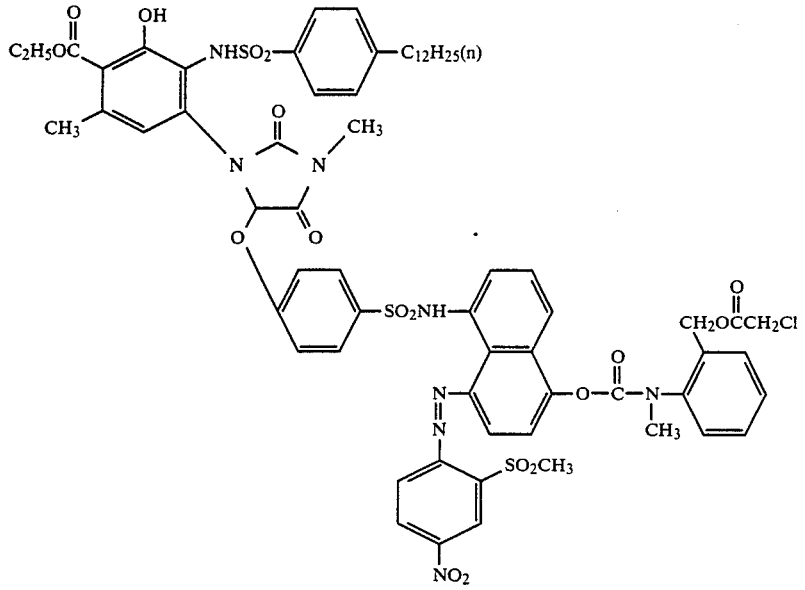
I-103
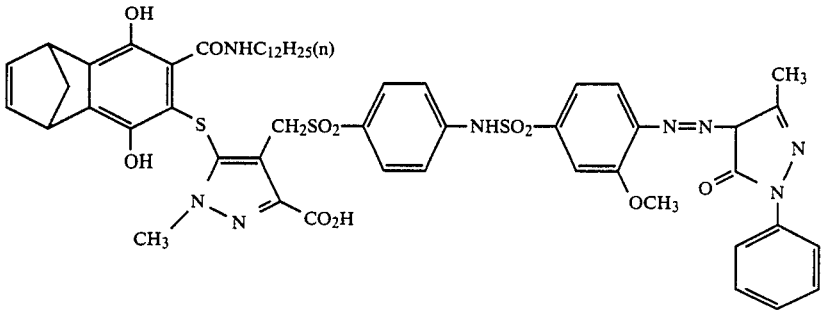
I-104
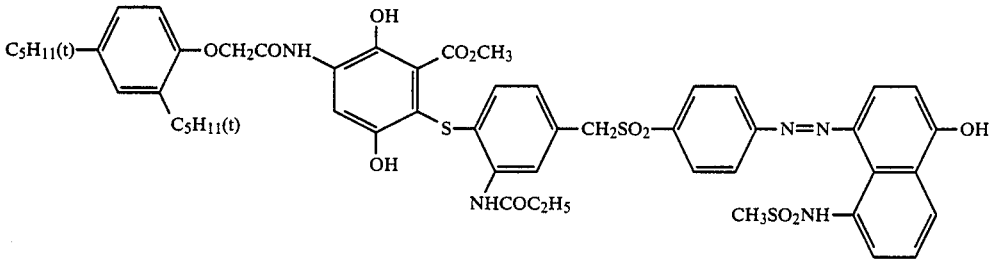
I-105
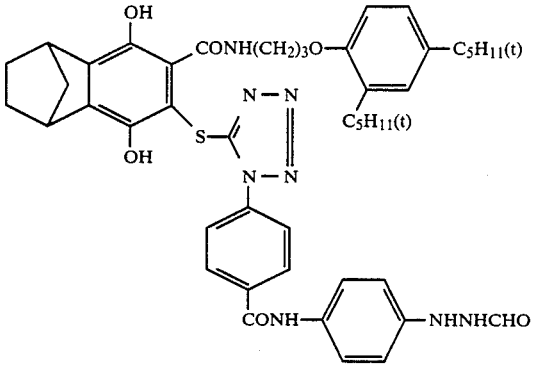

-continued
I-106
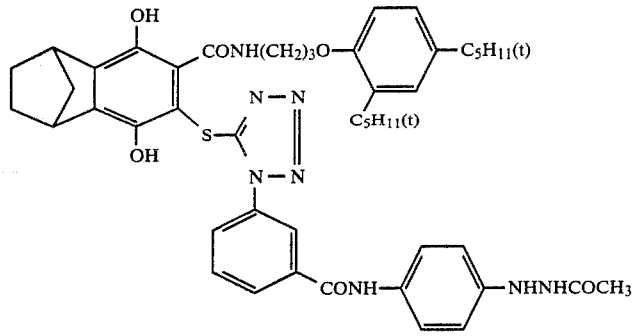
I-107
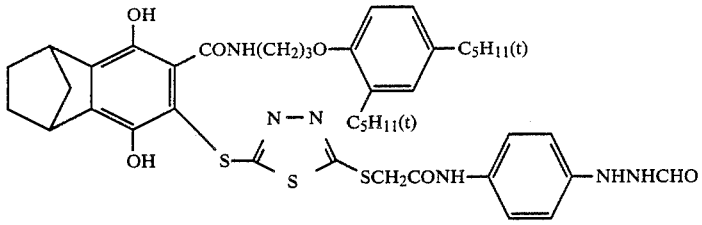
I-108
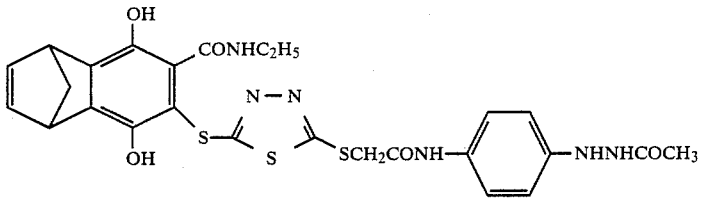
I-109
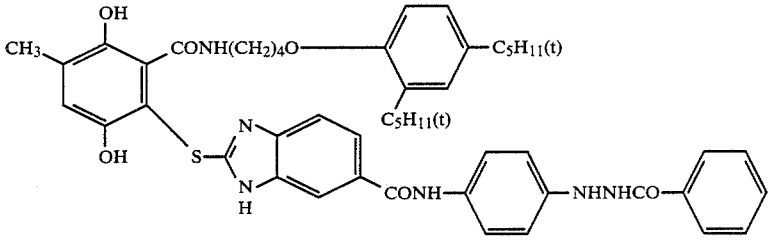
I-110
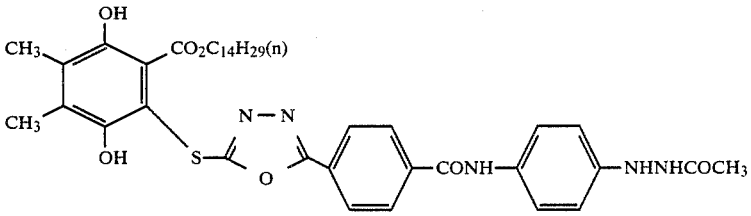

-continued
I-111
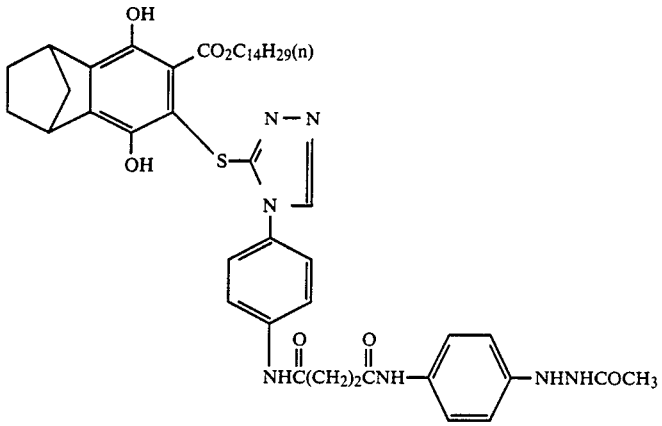
I-112
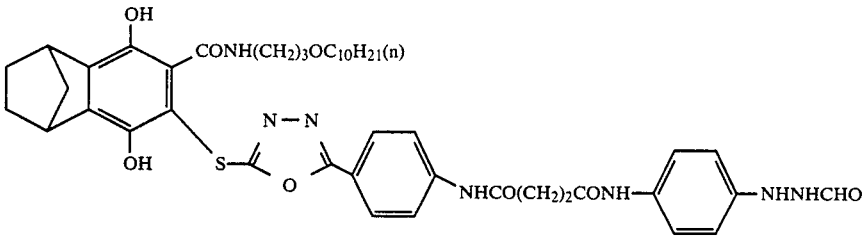
I-113
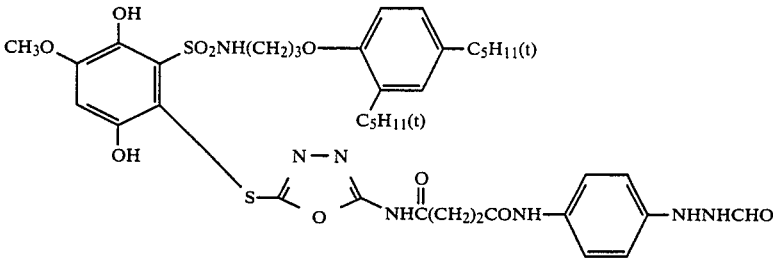
I-114
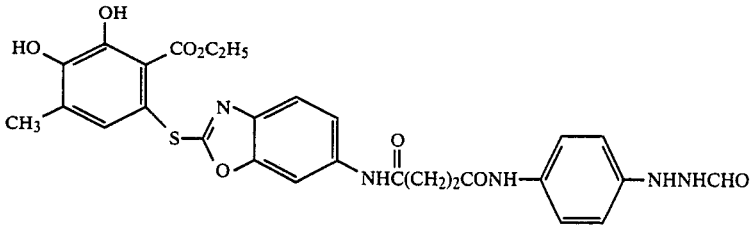
I-115
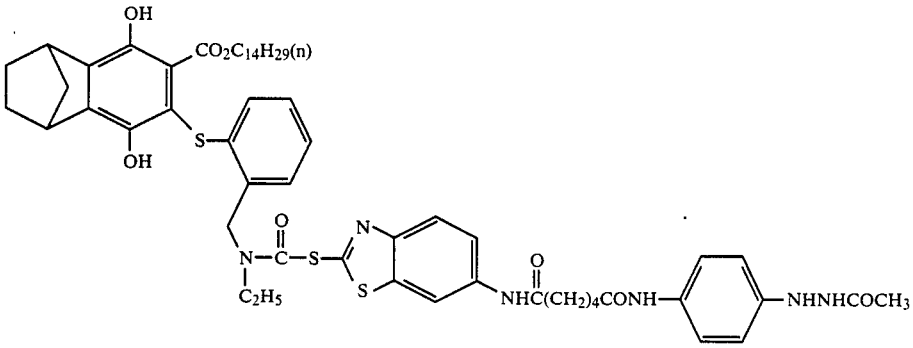

-continued
I-116
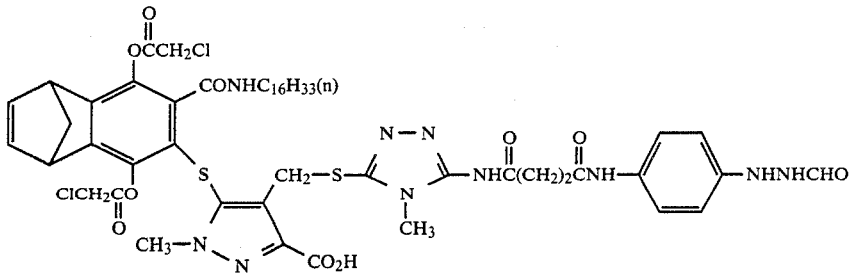
I-117
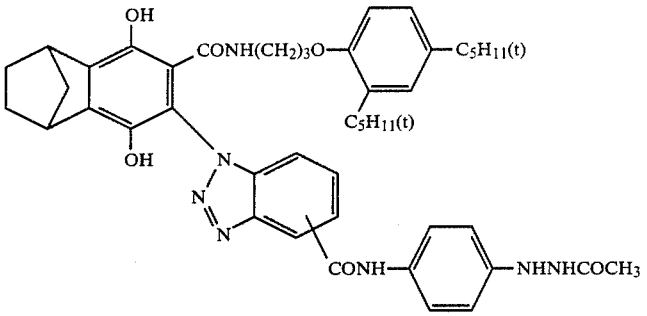
I-118
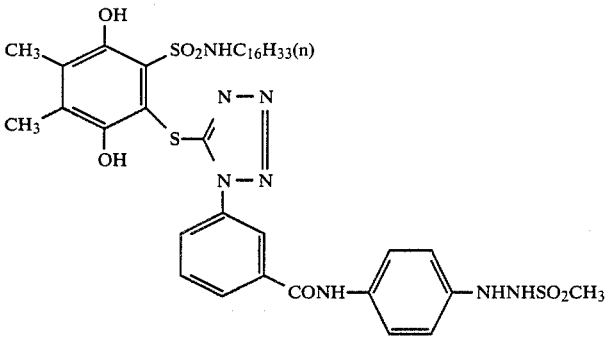
I-119
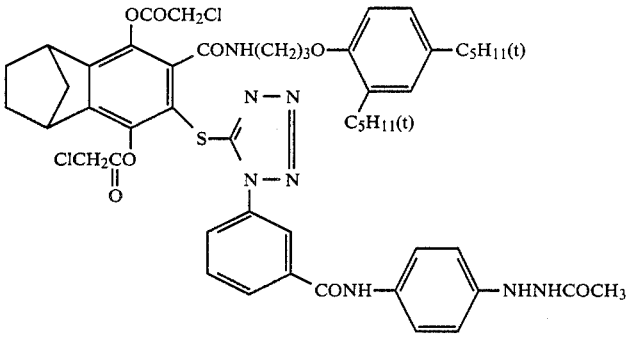

-continued
I-120
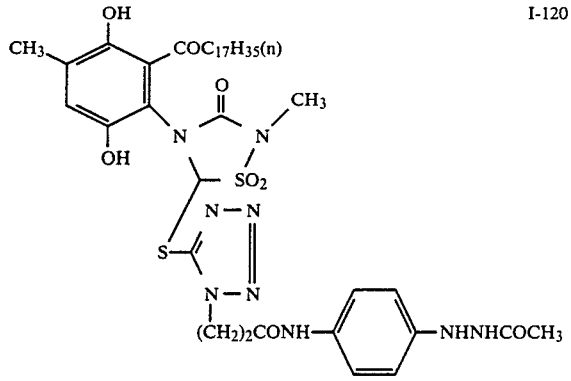
I-121
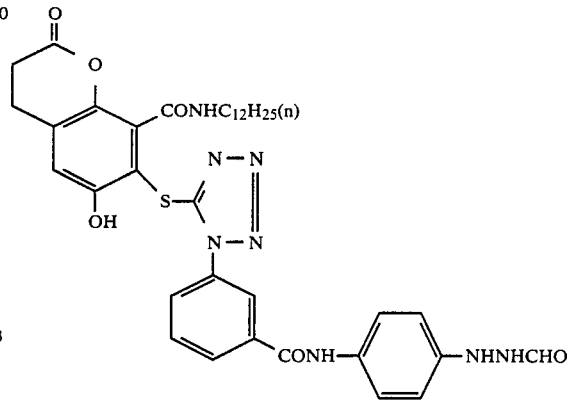
I-122
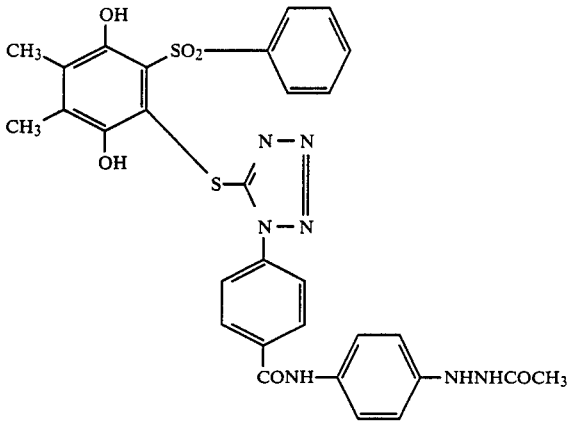
I-123
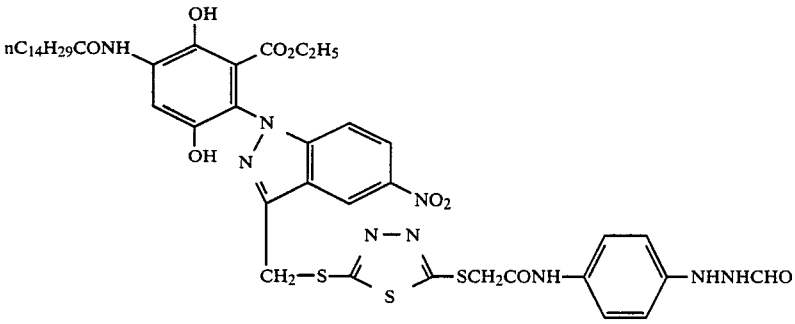
I-124
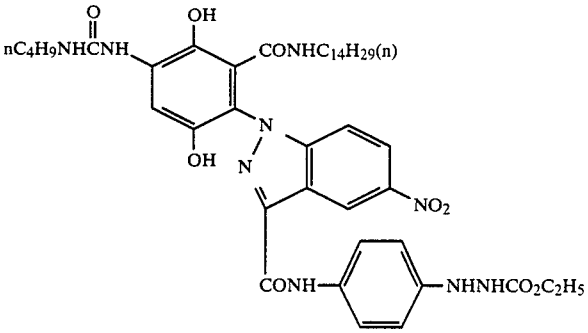

-continued
I-125
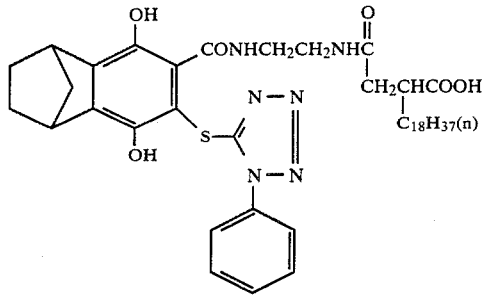
I-126
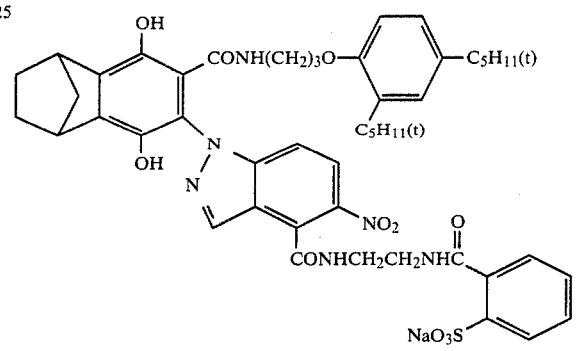
I-127
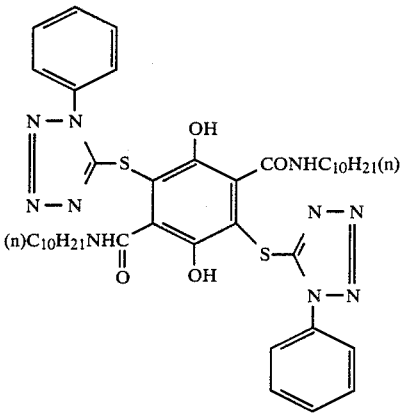
I-128
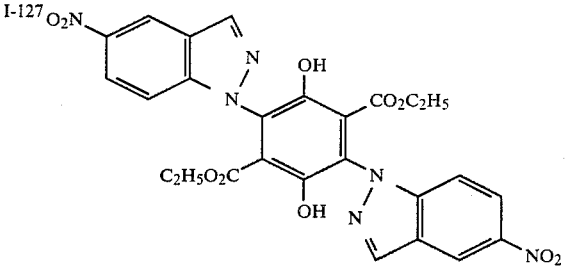
I-129
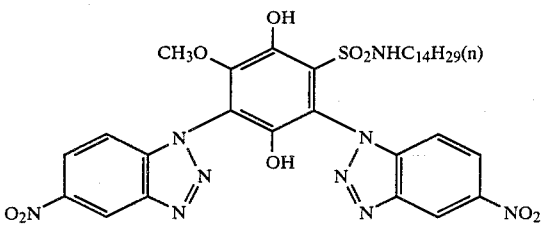
I-130
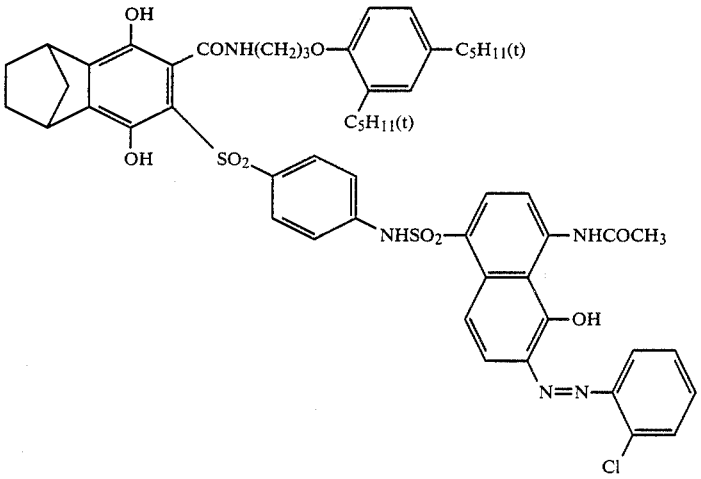

-continued

I-131

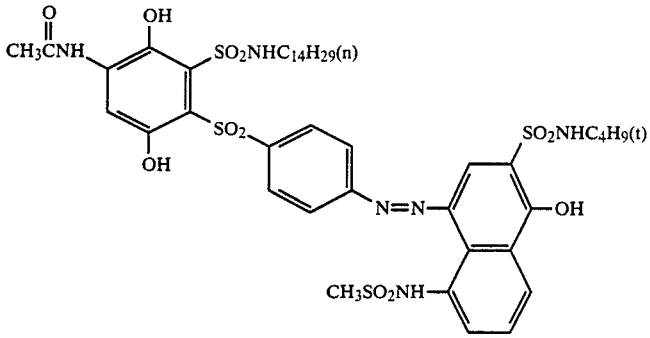

I-132

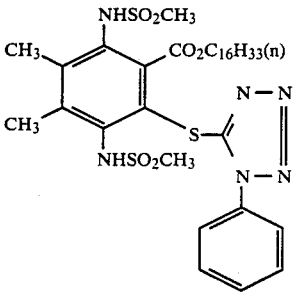

I-133

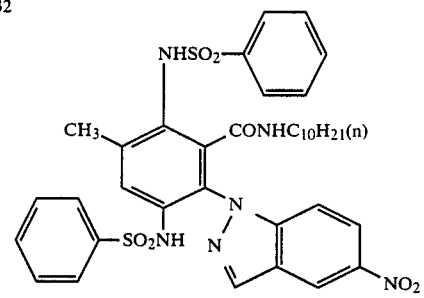

I-134

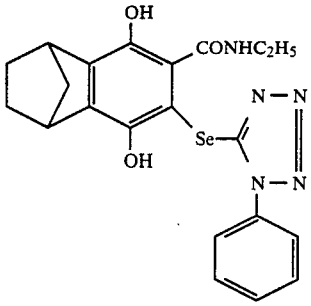

I-135

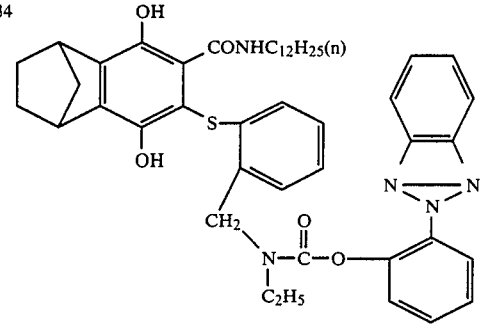

The compounds represented by formula (I) may generally be synthesized by the following two methods.

First, in the case that no Time is present (i.e., t=0), the compounds can be prepared:

(1) by reacting a derivative of benzoquinone, orthoquinone, quinonemonoimine, or quinonediimine with a PUG in chloroform, 1,2-dichloroethane, carbon tetrachloride, or tetrahydrofuran, in the absence or in the presence of an acid catalyst such as p-toluenesulfonic acid, benzenesulfonic acid, trifluoromethanesulfonic acid, or methanesulfonic acid, at a temperature ranging from room temperature to 100° C.;

(2) by reacting a chlorine-, bromine-, or iodine-substituted benzoquinone, orthoquinone, quinonemonoimine, or quinonediimine with a PUG in a nonprotonic polar solvent such as acetone, tetrahydrofuran and dimethylformamide, in the presence of a base such as potassium carbonate, sodium hydrogencarbonate, or sodium hydride, at a temperature ranging from −20° C. to 100° C., to obtain a quinone form, and reducing it by a reducing agent such as diethylhydroxylamine and sodium hydrosulfite, such as described in *Research Disclosure,* RD No. 18227 (June, 1979), and in *Liebig's Ann. Chem.,* No. 764131 (1972).

Secondly, in the case of the PUG being released through a Time group (i.e., t=1), the compounds represented by formula (I) can be synthesized in a manner nearly similar to the above. In other words, the method involves employing Time-PUG instead of said PUG, or preliminarily introducing into the redox center a Time group which has a substituent thereon that can be replaced by a PUG, such as a halogen atom, a hydroxyl group, or precursors thereof, and thereafter linking the PUG by a substitution reaction.

Specific examples of synthesizing the compounds are shown below. The compounds used in the present invention can be easily synthesized by these methods.

SYNTHESIS EXAMPLE 1

Synthesis of Compound (I-1)

2-Hydroxy-3-methyl-5-formylbenzoic acid was prepared from 2-hydroxy-3-methylbenzoic acid by the method described in Japanese Patent Application (OPI) No. 19539/73. 2,5-Dihydroxy-3-methylbenzoic acid was synthesized from the compound in accordance with the method described in *Organic Synthesis,* Coll. Vol. III, p. 759.

Then, 100 g of 2,5-dihydroxy-3-methylbenzoic acid was dissolved in 3 liters of ethanol and heated for 8 hours under reflux with hydrogen chloride gas blown into the solution. After completion of the reaction, distilling off the ethanol gave ethyl ester of 2,5-dihydroxy-3-methylbenzoic acid. In 30 ml of ethyl acetate was dissolved 8.0 g of said ester, and the solution was stirred. Then, 12 g of anhydrous sodium sulfate and 23 g of silver oxide were added to this solution, and inorganic matters were filtered off after 30 minutes. To the obtained filtrate were added 4 g of 1-phenyl-5-mercaptotetrazole and p-toluenesulfonic acid monohydrate dissolved in 20 ml of tetrahydrofuran. After the reaction was conducted for 1 hour at room temperature, distilling off the solvent and separating the resulting residue by column chromatography gave Compound (I-1). Yield: 6.0 g. M.P.: 147° C.

SYNTHESIS EXAMPLE 2

Synthesis of Compound (I-3)

4 g of 2,5-dihydroxy-3-methylbenzoic acid ethyl ester and 3.1 g of 5,6-dimethylbenzotriazole were dissolved in acetonitrile and the solution was stirred. To this was added 4.2 g of potassium carbonate and then 20.7 g of silver oxide was added little by little. After completion of the reaction, an excess of sodium hydrosulfite dissolved in water was added, and the solution was stirred vigorously. After distilling off the acetonitrile, the residue was extracted with ethyl acetate, and thereafter Compound (I-3) was obtained by a conventional method. It was recrystallized from methanol-water. Yield: 2.4 g. M.P.: 200°–202° C.

SYNTHESIS EXAMPLE 3

Synthesis of Compound (I-7)

n-Octylhydroquinone (22.2 g) and KOH (17.1 g) were dissolved in water, and dimethyl sulfate was dropwise added to the solution. When the pH thereof became acidic, additional KOH (11.4 g) was added, and dimethyl sulfate was dropwise added again to the solution. After completion of the reaction, the solution was extracted with ethyl acetate, and the solvent was distilled off to obtain 2,5-dimethoxyoctylbenzene.

Then, 2,5-dimethoxyoctylbenzene (25.0 g) was dissolved in dichloromethane, aluminum chloride (27 g) was added, and the solution was stirred. It was cooled to 5° C., and ethyl isocyanate (12.2 g) was slowly added dropwise to it. After the mixture was gradually warmed to room temperature and reacted for 8 hours at room temperature, the reaction solution was poured onto ice and extracted with dichloromethane. Removal of the solvent and the following separation of the residue from the raw materials by column chromatography gave 2,5-dimethoxy-4-n-octylbenzoic acid ethylamide.

This compound (25.8 g) was then dissolved in 1,2-dichloroethane, and aluminum chloride (26 g) was added to it. The mixture was heated to reflux for 4 hours, cooled and poured onto ice water. After the resulting dichloroethane layer was separated from water layer, the dichloroethane was distilled off. By separating the residue through column chromatography, 2,5-dihydroxy-4-n-octylbenzoic acid ethylamide was obtained.

This hydroquinone form (14.7 g) was dissolved in ethyl acetate and the solution was stirred. Anhydrous sodium sulfate (10 g) and silver oxide (34.5 g) were added to the solution and the mixture was reacted for 40 minutes. After filtering off inorganic matters, the filtrate obtained was added to a solution of 1-phenyl-5-mercaptotetrazole (9.8 g) and p-toluenesulfonic acid (10.5 g) in tetrahydrofuran. After the mixture was reacted for 1 hour, the solvent was distilled off and the main product was separated by columm chromatography to obtain Compound (I-7). Yield: 7.3 g. M.P.: 120° to 122° C.

SYNTHESIS EXAMPLE 4

Synthesis of Compound (I-27)

Ethyl gentisinate (24.6 g) and 5,6-dimethylbenzotriazole (15.5 g) were dissolved in acetone. Silver oxide (69.0 g) was added to the solution, and the resulting mixture was stirred. The reaction was checked with TLC, and after completion of the reaction, inorganic matters were filtered off. The obtained compound is 2-(5,6-dimethylbenzotriazole-1-yl)-3-ethoxycarbonyl-p-benzoquinone. This compound (19.7 g) was dissolved in acetonitrile, cyclopentadiene (3.3 g) was added to the solution and the mixture was reacted at room temperature. After completion of the reaction, a catalytic amount of triethylamine was added, and the resulting mixture was further stirred to precipitate Compound (I-27) as crystals. They were recrystallized from acetonitrile. Yield: 10.1 g. M.P.: 221° C. (decomposed).

SYNTHESIS EXAMPLE 5

Synthesis of Compound (I-34)

In ethyl acetate was dissolved 12.4 g of 3,6-dihydroxy-4-ethylcarbamoylbenzonorbornene, and 12 g of anhydrous sodium sulfate and 35 g of silver oxide were added. After 30 minutes, the mixture was filtered, and 0.9 g of p-toluenesulfonic acid and 9.8 g of 1-phenyl-5-mercaptotetrazole dissolved in ethyl acetate were added to the filtrate. After the reaction was conducted for 1 hour, almost all of the solvent was distilled off, and n-hexane and a small amount of ethyl acetate were added to precipitate Compound (I-34) as crystals. They were recrystallized from ethyl acetate-n-hexane. Yield: 36%. M.P.: 182°–183° C.

SYNTHESIS EXAMPLE 6

Synthesis of Compound (I-39)

6-(1) Synthesis of 3,6-Dihydroxybenzonorbornene-4-carboxylic Acid 3,6-Dihydroxybenzonorbornene (81.8 g), potassium carbonate (260 g), and dimethylformamide (400 ml) were mixed, and the mixture was reacted in an autoclave at 180° C. for 8 hours in contact with carbon dioxide at a pressure of 50 kg/cm$^2$.

After cooling, water was added to the reaction mixture, and the resulting solution was acidified with hydrochloric acid. Then, the solution was extracted with ethyl acetate. The organic layer was washed with water, and the ethyl acetate was distilled off under reduced pressure. Warm water was added to the residue, and the resulting solution was stirred to obtain 3,6-dihydroxybenzonorbornene-4-carboxylic acid as crystals. Yield (amount): 92.1 g. Yield (ratio): 90.2%.

6-(2) Synthesis of 3,6-Dihydroxybenzonorbornene-4-carboxylic Acid Phenyl Ester Phenyl ester form (oily) was obtained from 3,6-dihydroxybenzonorbornene-4-carboxylic acid by the method described in Japanese Patent Application (OPI) No. 28139/78.

6-(3) Synthesis of 3,6-Dioxo-4-[3-(2,4-di-t-pentylphenoxy)propylcarbamoyl]benzonorbornene Phenyl ester (14.8 g) synthesized in accordance with 1-(2) was mixed with 3-(2,4-di-t-pentylphenoxy)- propylamine (14.6 g), the mixture was heated to 140° C. and reacted for 4 hours under a reduced pressure of 20 mm Hg. After cooling, 3,6-dihydroxy-4-[3-(2,4-di-t-pentylphenoxy)propylcarbamoyl]benzonorbornene was obtained by crystallization from n-hexane. Yield (amount): 15.1 g. Yield (ratio): 61.2%. M.P.: 142° C.

6-(4) Synthesis of 3,6-Dioxo-4-[3-(2,4-di-t-pentylphenoxy)propylcarbamoyl]-5-chlorobenzonorbornene In 60 ml of tetrahydrofuran was dissolved 4.9 g of the amide obtained in accordance with 1-(3), 2.9 g of N-chlorosuccinimide was added and the mixture was reacted for 6 hours. Thereafter, the solvent was distilled off, and the residue was purified by silica gel chromatography to obtain 3,6-dioxo-4-[3-(2,4-di-t-pentylphenoxy)propylcarbamoyl]-5-chlorobenzonorbornene. Yield (amount): 5.0 g. Yield (ratio): 95.7%.

6-(5) Synthesis of Compound (I-39)

Potassium carbonate (2.0 g), 5-mercapto-1-phenyltetrazole (1.6 g) and acetone (30 ml) were mixed and stirred for 30 minutes.

Next, an acetone solution of 5.0 g of the compound obtained in 6-(4) was added to the mixture, and the resulting solution was stirred at room temperature for 30 minutes. After 2 hours, the solution was filtered from inorganic matters, and the acetone was distilled off under reduced pressure. The residue was dissolved in ethyl acetate, 55 ml of 27% aqueous solution of sodium hydrosulfite was added, and the resulting solution was stirred vigorously. After 10 minutes, the reaction solution was subjected to separation, the organic layer was washed twice with water and once with saturated aqueous solution of common salt, and thereafter dried over anhydrous sodium sulfate. After the solution was filtered to remove the sodium sulfate, the ethyl acetate was distilled off under reduced pressure, and the residue was crystallized from hexane. Yield (amount): 4.9 g. Yield (ratio): 80%. M.P.: 157°-158° C.

SYNTHESIS EXAMPLE 7

Synthesis of Compound (I-45)

In 50 ml of 1/1 acetic acid-ethyl acetate solution was dissolved 4 g of 2-(2-methylthio-1,3,4-thiadiazole-5-ylthio)-4-t-octyl-p-benzoquinone. Then, an excess of sodium p-toluenesulfinite was added to the solution, and the resulting mixture was reacted at room temperature for 1 hour. Thereafter the solvent was distilled off, and the residue was purified by silica gel chromatography. M.P.: 207°-209° C.

SYNTHESIS EXAMPLE 8

Synthesis of Compound (I-51)

A small amount of chloroform was added to 50 g of 3,6-dimethoxybenzonorbornene, and the mixture was stirred with cooling by ice water. Chlorosulfonic acid (65 ml) was slowly added to this. After the mixture was reacted at 0° C. for 1 hour, the reaction solution was poured over ice. It was extracted with diethyl ether. The extract solution was dried over anhydrous sodium sulfate and then the diethyl ether was distilled off, giving 4-chlorosulfonyl-3,6-dimethoxybenzonorbornene. Yield: 58%.

Then, 15 g of this compound was dissolved in acetonitrile, and 10 g of triethylamine and 11 g of n-tetradecylamine were added one by one with cooling by ice water. After reacting for 1 hour, water was added to the reaction mixture, and the resulting solution was extracted with ethyl acetate, and the extract solution was dried over anhydrous sodium sulfate. The oily residue obtained by distilling off the solvent was dissolved in 80 ml of dichloromethane. This solution was slowly added dropwise to a solution of 28 g of boron tribromide in 140 ml of dichloromethane. After reacting for 2 hours, the reaction solution was poured onto ice water and extracted with ethyl acetate. Crystallization was effected by adding n-hexane to the oil left after distilling off the solvent. Yield: 14.3 g. 8 g of the 4-tetradecylsulfamoyl-3,6-dioxobenzonorbornene obtained was dissolved in 150 ml of ethyl acetate, and 10 g of anhydrous sodium sulfate and 10.1 g of silver oxide were added. After reacting for 40 minutes, inorganic matter was removed by filtration under reduced pressure. To the filtrate was added 20 ml of concentrated hydrochloric acid, and the resulting solution was stirred vigorously. After 20 minutes, 100 ml of water was added, and the mixture was subjected to separation. After the ethyl acetate layer was washed with an aqueous solution of sodium hydrogencarbonate, the layer was dried over anhydrous sodium sulfate. After filtering off inorganic matter, 10 g of anhydrous sodium sulfate was added, and then 10 g of silver oxide was added. After 20 minutes, inorganic matter was filtered out. The solvent was distilled off and n-hexane was added to precipitate yellow crystals. Yield: 6.5 g.

In ethyl acetate was dissolved 1.5 g of the chloroquinone obtained, 0.6 g of 1-phenyl-5-mercaptotetrazole was added, and the resulting mixture was reacted for 1 hour. Then, an excess of aqueous solution of sodium hydrosulfite was added to the solution and the mixture was stirred vigorously. After completion of the reaction, the mixture was subjected to separation and the ethyl acetate layer was washed with water. Then, the solvent was removed and the oil obtained was purified by column chromatography to yield Compound (I-51). M.P.: 111°-114° C.

SYNTHESIS EXAMPLE 9

Synthesis of Compound (I-66)

After 6.3 g of potassium carbonate, 4.9 g of 5-nitroindazole, and 15.7 g of the compound obtained in Synthesis Example 6-(4) were reacted in 150 ml of acetone at room temperature for 2 hours, inorganic matter was filtered out and the acetone was distilled off under reduced pressure. The residue was dissolved in 100 ml of ethyl acetate, 25 g of sodium hydrosulfite dissolved in 100 ml of water was added, and the resulting mixture was stirred vigorously. After 10 minutes, the organic layer was separated, washed twice with water and dried over anhydrous sodium sulfate. This solution was filtered and the filtrate was concentrated with a rotary evaporator and thereafter the residue was recrystallized from acetonitrile. Yield (amount): 15.3 g. Yield (ratio): 79%. M.P.: 158°-159° C.

SYNTHESIS EXAMPLE 10

Synthesis of Compound (I-68)

From 12 g of the compound obtained in Synthesis Example 6-(4) and 3.7 g of 5-nitrobenzotriazole, 12.2 g of the object was obtained in the same manner as that of Synthesis Example 9 (crystallized from a mixed solution of hexane/ethyl acetate=50 ml/10 ml). Yield: 82%. M.P.: 207° C. (decomposed).

SYNTHESIS EXAMPLE 13

Synthesis of Compound (I-105)

1-(4-Carboxyphenyl)-5-mercaptotetrazole (9.2 g) and acetone (500 ml) were mixed and stirred. Then, 3,6-dioxo-4-[3-(2,4-di-t-amylphenoxy)propylcarbamoyl]-5-chlorobenzonorbornene (20.0 g) was added, and the mixture was reacted overnight. Then, the acetone was distilled off under reduced pressure, and the residue was dissolved in ethyl acetate (200 ml). To this solution was added 27% aqueous solution of sodium hydrosulfite (150 ml), and the resulting mixture was stirred vigorously. After 10 minutes, the reaction solution was subjected to separation. After the organic layer was washed twice with water and then once with saturated aqueous solution of common salt, it was dried over anhydrous sodium sulfate. After the solution was filtered to remove sodium sulfate, the solvent was distilled off. The residue was crystallized from ethyl acetate-n-hexane. Yield (amount): 17.0 g. Yield (ratio): 62.7%

The thus obtained 3,6-dioxo-4-[3-(2,4-di-t-amylphenoxy)propylcarbamoyl]-5-[1-(4-carboxyphenyl)-tetrazole-5-ylthio]benzonorbornene (9 g) was dissolved in DMF (20 ml), 2-(4-aminophenyl)-1-formylhydrazine (2.3 g) and dichlorohexylcarbodiimide (2.7 g) were added, and the mixture was reacted at room temperature overnight. Next, it was filtered, the filtrate was evaporated to dryness under reduced pressure, and the residue was purified by column chromatography and recrystallized from chloroform-diethyl ether. Yield (amount): 6.5 g. Yield (ratio): 60.9%. M.P.: 156° C. (decomposed).

The compound of formula (I) of the present invention is believed to be either cross-oxidized by redox reaction with the oxidant of the developing agent or of the auxiliary developing agent formed in an image pattern during development, or oxidized itself by directly reducing silver salts to release a photographically useful substance to the image pattern and converted into a colorless oxidant.

Because the compounds of the present invention release a photographically useful group to an image pattern quickly, effectively and in good timing, various applications may be considered. For example, a development inhibiting substance released will inhibit development in the image pattern and exhibit DIR effects such as finer grains, softening of tone and improved sharpness of the image and better color reproduction or the like. Further, if a diffusible or nondiffusible dye is released, it may be possible to form color images. As will be described later, the compounds of formula (I) of the present invention are extremely active and exhibit remarkable photographic effects through efficient action in comparison with the hitherto known compounds having similar action.

The compounds of the present invention can achieve expected objects by being added to a silver halide emulsion layer and/or a hydrophilic colloid layer provided either on or beneath said emulsion layer. When applying the compounds of formula (I) of the present invention to the above object, it is necessary to select suitable release group PUG in correspondence to respective objects. Further, the amount to be added depends on the kind of photosensitive materials as well as on the property of the PUG to be selected. In general, a preferable amount to be added is in the range of from $1\times10^{-7}$ to $1\times10^{-3}$ mol per mol of silver halide.

For example, in the case of the PUG being a development inhibitor, it is preferable to use the compounds of the present invention in an amount of from $1\times10^{-7}$ to $1\times10^{-1}$ mol per mol of silver halide, and an amount ranging from $1\times10^{-6}$ to $5\times10^{-2}$ mol is most desired. In the case of the PUG being a development accelerator or fogging agent, the amount to be added is preferably similar to that for the above development inhibitor.

Further, for example, when the PUG is a dye to be used for forming an image, it is preferable to use the compounds of the present invention in an amount of from $1\times10^{-3}$ to $1\times10$ mols per mol of silver halide, and an amount ranging from $1\times10^{-2}$ to 4 mols is most desired.

In adding the compounds of the present invention to a silver halide emulsion layer and/or other hydrophilic colloid layers, conventional methods are applied. That is, water-soluble compounds may be added to an aqueous solution of gelatin in the form of an aqueous solution or in the original form. For compounds which are insoluble or sparingly soluble in water, the method is used which comprises mixing the compounds with an aqueous solution of gelatin after dissolving them in a solvent miscible with water, or which, for example, is described in U.S. Pat. No. 2,322,027. For example, they are dissolved in the following solvents, and thereafter dispersed in a hydrophilic colloid: alkyl phthalates (e.g., dibutyl phthalate and dioctyl phthalate), phosphoric esters (e.g., diphenyl phosphate, triphenyl phosphate, tricresyl phosphate, and dioctyl butyl phosphate), citric esters (e.g., tributyl acetyl citrate), benzoic esters (e.g., octyl benzoate), alkylamides (e.g., diethyllaurylamide), fatty acid esters (e.g., dibutoxyethylsuccinate and diethyl azeolate), trimesic esters (e.g., tributyl trimesate); or organic solvents having a boiling point of from 30° C. to 150° C., such as lower alkyl acetates (e.g., ethyl acetate and butyl acetate), ethyl propionate, secondary butyl alcohol, methyl isobutyl ketone, β-ethoxyethyl acetate, and methyl cellosolve acetate. The above high boiling point organic solvents and low boiling point organic solvents may be used in combination.

The compounds of formula (I) of the present invention can be used in emulsified dispersion in combination with reducing substances such as hydroquinones and their derivatives, catechols and their derivatives, aminophenols and their derivatives or ascorbic acid and its derivatives.

As the photosensitive silver halides used for the photographic emulsion layer of the photosensitive material employed in the present invention, any one of silver bromide, silver iodobromide, silver iodochlorobromide, silver chlorobromide, and silver chloride may be used.

The average grain size (expressed in terms of the average based on the projected area with the diameter of the grain taken for a spherical or approximately spherical grain, or the length of one edge taken for a cubic grain) of the silver halide contained in the photographic emulsion is not particularly limited, but preferably does not exceed 3 μm.

The grain size distribution may be either narrow (the so-called monodispersion) or broad.

The silver halide grains in the photographic emulsion may be of regular crystals such as cubes, octahedrons, tetradecahedrons, and rhombic dodecahedrons or of irregular crystals such as spheres and tables or even of composite form of them. The grains may consist of a mixture of these various crystals.

An emulsion may be used where tabular silver halide grains having a diameter at least five times the thickness account for not less than 50% of the total projected areas. The details are described in Japanese Patent Application (OPI) Nos. 127921/83 and 113927/83.

The silver halide grains may have a surface layer whose phase is different from that of the interior. Latent images may be formed primarily on the surface of the grains or inside of them.

The photographic emulsion used in accordance with the present invention may be prepared by the methods described in *Chimie et Phisique Photographique* by P. Glafkides (published by Paul Montel, 1967); *Photographic Emulsion Chemistry* by G. F. Duffin (published by the Focal Press, 1966); *Making and Coating Photographic Emulsion* by V. L. Zelikman et al. (published by the Focal Press, 1964) and other literature. In other words, the acid method, neutral method and ammonia method may all be used alike, and for reacting a soluble silver salt with a soluble halogen salt, the single jet method and the double jet method can be used, singly or in combination.

A method comprising forming grains in the presence of an excess of silver ion (the so-called reverse single jet method) may also be employed. As one type of double jet method, a method involving maintaining at a constant level the pAg in the liquid phase wherein a silver halide is produced, i.e., the so-called controlled double jet method may be used.

According to this method, the silver halide emulsion obtained has a regular crystal form and its crystal grain size is approximately uniform.

It is also possible to use a mixture of two or more different silver halide emulsions prepared separately.

Cadmium salts, zinc salts, lead salts, thallium salts, iridium salts, or complex salts thereof, rhodium salts or complex salts thereof, iron salts or complex salts thereof, and gold salts or complex salts thereof may be present during silver halide grain forming process or the physical ripening of the produced grains.

The silver halide emulsion may or may not be chemically sensitized. For chemical sensitization, for example, the method described in pp. 675–734 of *Die Grundlagen der Photographischen Prozesse mit Silberhalogeniden* edited by H. Frieser (Akademische Verlagsgesellschaft, 1968) may be employed.

Specifically, the sulfur sensitization method employing compounds containing sulfur which may react with active gelatin and silver (e.g., thiosulfates, thiourea, mercapto compounds, and rhodanines); the reduction sensitization method employing reducing substances (e.g., stannous salts, amines, hydrazine derivatives, formamidine sulfinate, and silane compounds); and the noble metal sensitization method employing noble metal compounds (e.g., complex salts of gold and of the metals belonging to the VIII group of the Periodic Table, such as Pt, Ir, and Pd) may be used either singly or in combination.

Various compounds may be incorporated in the photographic emulsion used in accordance with the present invention for the purpose of preventing fog in the preparation and storage of the photosensitive material or in the photographic processing or of stabilizing the photographic performance. Specifically, the following various compounds known as antifogging agents or stabilizers can be incorporated: azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole); mercaptopyrimidines; mercaptotriazines; thioketo compounds such as oxazolinethione; azaindenes such as triazaindene, tetraazaindenes (particularly 4-hydroxy-substituted (1,3,3a,7-tetraazaindene) and pentaazaindenes; benzenethiosulfonic acid, benzenesulfinic acid, benzenesulfonic acid amides and the like.

The photographic emulsion layer of the photosensitive material prepared in accordance with the present invention or other hydrophilic colloid layers may contain various surfactants in order to provide coating aid, antistatic, better slip, emulsified dispersion, adhesion prevention and improved photographic properties (e.g., development acceleration, higher contrasting and sensitization).

Exemplary surfactants include the following: nonionic surfactants such as saponins (steroid saponin), alkylene oxide derivatives (e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamides, and polyethylene oxide adducts of silicone), glycidol derivatives (e.g., alkenylsuccinic acid polyglycerides and alkylphenol polyglycerides), fatty acid esters of polyhydric alcohols and alkyl esters of sugars; anionic surfactants containing acid groups such as carboxy, sulfo, phospho, sulfate and phosphate groups, such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers and polyoxyethylene alkylphosphoric acid esters; amphoteric surfactants such as amino acids, aminoalkylsulfonic acids, aminoalkylsulfuric acid esters or aminoalkylphosphoric acid esters, alkyl betaines and amino oxides; and cationic surfactants such as alkylamine salts, aliphatic or aromatic quaternary ammonium salts, heterocyclic quaternary ammonium salts such as pyridinium and imidazolium and phosphonium or sulfonium salts containing an aliphatic or heterocyclic group.

In order to improve sensitivity and contrast or to accelerate development, it is also possible to incorporate in the photographic emulsion layer(s) of the photosensitive material of the present invention, for example, polyalkylene oxides or their derivatives such as ethers, esters and amines, thioether compounds, thiomorpholines, quaternary ammonium salt compounds, urethane derivatives, urea derivatives, imidazole derivatives, 3-pyrazolidones and the like.

In order to improve dimensional stability and other properties, a dispersion of a synthetic polymer which is insoluble or sparingly soluble in water may be incorporated in the photographic emulsion layer or other hydrophilic colloid layers of the photographic material of the present invention. For example, polymers which contain as the monomeric ingredients the following substances either singly or in combination may be used: alkyl(meth)acrylate, alkoxyalkyl(meth)acrylate, glycidyl(meth)acrylate, (meth)acrylamide, vinyl esters (e.g., vinyl acetate), acrylonitrile, olefins and styrene. Further, these may be used in combination with acrylic acid, methacrylic acid, $\alpha,\beta$-unsaturated dicarboxylic acids, hydroxyalkyl(meth)acrylate, sulfoalkyl(meth)acrylates, styrene sulfonic acid, and the like.

The photosensitive emulsion used in accordance with the present invention may be spectrally sensitized with methine dyes and the like. Exemplary dyes used in the present invention include cyanine, merocyanine, complex cyanine, complex merocyanine, holopolar cyanine, hemicyanine, styryl, and hemioxonol dyes. Particularly useful dyes are cyanine and merocyanine dyes and those dyes which belong to the group of complex merocyanine dyes. Any of the nuclei generally used for cyanine dyes as basic heterocyclic nuclei is applicable to the above-described dyes. Specifically, pyrroline, oxazoline, thiazoline, pyrrole, oxazole, thiazole, selenazole, imidazole, tetrazole, and pyridine nuclei; nuclei formed by coalescence of alicyclic hydrocarbon rings to these nuclei; and nuclei formed by coalescence of aromatic hydrocarbon ring to the above illustrated nuclei, such as indolenine, benzindolenine, indole, benzoxazole, naphthoxazole, benzothiazole, naphthothiazole, benzoselenazole, benzimidazole, and quinoline nuclei. These nuclei may be substituted at carbon atoms.

The following nuclei may be applicable as nuclei having the ketomethylene structure to merocyanine dyes or complex merocyanine dyes: pyrazoline-5-one nucleus, thiohydantoin nucleus, 2-thiooxazolidine-2,4-dione nucleus, thiazolidine-2,4-dione nucleus and rhodanine nucleus.

In the photographic emulsion layer of the photosensitive material made in accordance with the present invention, together with the above illustrated compounds of the present invention, other dye forming couplers, i.e., compounds which may develop colors by oxidative coupling with aromatic primary amine developing agents (e.g., phenylenediamine derivatives and aminophenol derivatives) in the color developing process may be used. Exemplary magenta couplers incluce 5-pyrazolone coupler, pyrazolobenzimidazole coupler, cyanoacetylcoumarone coupler and open chain acylacetonitrile coupler. Exemplary yellow couplers include acylacetamide couplers (e.g., benzoylacetanilides and pivaloylacetanilides). Exemplary cyan couplers include naphthol coupler and phenol coupler. These couplers are desirably of a nondiffusible type and contain a hydrophobic group called a ballast group in the molecule. The couplers may also be in the form of polymers. The couplers may be either 4- or 2-equivalent with respect to silver ion. The couplers may also be colored couplers having color compensating effects or couplers which release development inhibitors or development accelerators in the course of development (i.e., the so-called DIR couplers or DAR couplers).

In addition to the DIR couplers, non-coloring DIR coupling compounds which produce colorless substances by a coupling reaction and which release development inhibitors may also be incorporated in the above identified layers. Aside from the DIR couplers, compounds which release development inhibitors in the course of development may be incorporated in the sensitive material.

In order to meet the requirement for a photosensitive material, two or more different kinds of the above illustrated couplers may be used in the same layer. Needless to say, the same compound may be added to two or more different layers.

The photosensitive material prepared according to the present invention may contain an inorganic or organic hardener in the photographic emulsion layer or other hydrophilic colloid layers. For example, the following substances may be used either singly or in combination: chromium salts (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloylhexahydro-s-triazine and 1,3-vinylsulfonyl-2-propanol), active halides (e.g., 2,4-dichloro-6-hydroxy-s-triazine), and mucohalogenic acidsv(e.g., mucochloric acid and mucophenoxychloric acid).

Gelatin is advantageously used for a binder or protective colloid which may be used for the emulsion layer or hydrophilic colloid layers (e.g., protective layer and intermediate layer) of the photosensitive material in accordance with the present invention, but other hydrophilic colloids may also be employed. They include: proteins such as gelatin derivatives, graft polymers of gelatin with other high polymers, albumin and casein; cellulose derivatives such as hydroxyethyl cellulose, carboxymethyl cellulose and cellulose sulfate, sugar derivatives such as sodium alginate and starch derivatives; and various synthetic hydrophilic polymer matters including homo- and copolymers such as polyvinyl alcohol, polyvinyl alcohol partially substituted acetal, poly-N-vinyl pyrrolidone, polyacrylic acid, polymethacrylic acid, polyacrylamide, polyvinylimidazole, and polyvinylpyrazole. Besides, lime-treated, acid-treated, and enzyme-treated gelatin may also be employed.

In the silver halide photosensitive material of the present invention, various other additives may be added: such as whitening agents, dyes, desensitizers, coating aids, antistatic agents, plasticizers, slipping agents, matting agents, development accelerators, mordants, UV absorbers, anti-fading agents, and anticolor fogging agents.

As for these additives, specifically, such may be used as described in *Research Disclosure,* RD No. 17643, pp. 22–31 (December, 1978).

In the photographic processing of the silver halide photosensitive material according to the present invention, any well known method can be employed, such as wet processing and thermal development methods.

For the processing solution in a wet processing method, any well known method can be used. The processing temperature is usually chosen within the range of from 18° to 50° C., but temperatures lower than 18° C. or higher than 50° C. may also be employed. Either of the monochromatic development process wherein a silver iamge is formed in accordance with specific purpose or the color photographic process comprising development process wherein dye images are formed may be applied to the silver halide photographic material of the present invention.

The developer used in monochromatic development may contain a hitherto known developing agent. Exemplary developing agents which may be employed either singly or in combination include: dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds produced by condensation of 1,2,3,4-tetrahydroquinoline rings and indolenine rings, such as those described in U.S. Pat. No. 4,067,872. In addition to these compounds, the developer may generally contain well known preservatives, alkaline agents, pH buffers, antifogging agents, and the like, and may contain, as required, solubilizers, color toning agents, development accelerators, surfactants, anti-foaming agents, water softeners, hardeners, tackifiers, and the like.

As the fixing solution, commonly used compositions may be employed. Exemplary fixing agents include thiosulfates, thiocyanates, and organic sulfur compounds which are known to have fixing effects. The fixing solution may contain a water-soluble aluminum salt as the hardener.

Conventional methods may be employed for forming dye images. Exemplary methods include (1) the negative-positive process (see *Journal of the Society of Motion Picture and Television Engineers,* Vol. 61, pp. 667–701 (1953), (2) the color reverse process comprising forming negative silver image by developing a film in a developer containing a monochromatic developing agent and conducting at least one cycle of uniform exposure or other suitable fogging treatment, followed by color development to form positive dye images, and (3) the silver dye bleach process comprising subjecting the photographic emulsion layer containing dyes to exposure followed by development to form silver images and then bleaching the dye using the silver images as the bleaching catalyst.

The color developer generally comprises an aqueous alkaline solution containing a color developing agent. Exemplary color developing agents to be used in the present invention include known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, and the like.

In addition to these, those compounds described in pp. 226–229 of *Photographic Processing Chemistry* by L. F. A. Mason (published by Focal Press, 1966), U.S. Patents 2,193,015 and 2,592,364 and Japanese Patent Application (OPI) No. 64933/73 may also be employed.

The color developer may, in addition to the above-described compounds, contain a pH buffer such as sulfites, carbonates, borates and phosphates of alkali metals, a development inhibitor or antifogging agent such as bromides, iodides and organic antifogging agents. The developer may also, as required, contain a water softener, a preservative such as hydroxylamine, an organic solvent such as benzyl alcohol and diethylene glycol, a development accelerator such as polyethylene glycol, quaternary ammonium salts and amines, a dye forming coupler, a competitive coupler, a fogging agent such as sodium borohydride, an auxiliary developing agent such as 1-phenyl-3-pyrazolidone, a tackifier, a chelating agent of polycarboxylic compounds described in U.S. Pat. No. 4,083,723, and an antioxidant described in West German Patent Application (OLS) No. 2,622,950.

The photographic emulsion layer is usually subjected to bleaching after completion of the color development process. The bleaching process may or may not be conducted simultaneously with the fixation process. Exemplary bleaching agents include compounds of polyvalent metals such as iron (III), cobalt (III), chromium (VI), and copper (II), peracids, quinones, and nitroso compounds. Specifically, ferric cyanides, dichromates, organic complex salts of iron (III) or cobalt (III), complex salts of amino polycarboxylic acids such as ethylenediaminetetraacetic acid, nitrilotriacetic acid and 1,3-diamino-2-propanoltetraacetic acid or of organic acids such as citric acid, tartaric acid and malic acid; persulfates and permanganates; and nitrosophenol. Among them, particularly useful are potassium ferricyanide, EDTA iron (III) sodium, and EDTA iron (III) ammonium. Iron (III) complex salts of EDTA are useful both in an independent bleaching solution and a combined bleaching and fixing solution.

Various additives may be added to the bleaching or bleaching and fixing solution, in addition to the bleaching accelerators described in U.S. Pat. Nos. 3,042,520 and 3,241,966 and Japanese Patent Publication Nos. 8506/70 and 8836/70, and the thiol compounds described in Japanese Patent Application (OPI) No. 65732/78.

The compounds of formula (I) of the present invention can be applied to various silver halide photosensitive materials. The examples will be given below.

(1) The compounds of the present invention are, for example, effective to improve the quality of a silver halide photosensitive material for photo plate making which has an emulsion layer of silver chlorobromide or silver chloroiodobromide containing at least 60% of silver chloride and from 0 to 5% of silver iodide (the emulsion is preferably monodispersion) and which contains polyalkylene oxides. For instance, when the PUG of compound (I) is a development inhibitor, the compound can improve (elongate) halftone without deteriorating the quality of dots. When the PUG is a development accelerator, the compound is effective for promoting sensitization and improving the quality of dots. In these cases, the compounds of the present invention are used preferably in an amount of from $1\times10^{-7}$ to $1\times10^{-1}$ mol, and particularly from $1\times10^{-6}$ to $1\times10^{-2}$ mol, per mol of silver halide.

The polyalkylene oxide compounds used in this case may be added to a silver halide photosensitive material and/or a developer.

The polyalkylene oxide compounds include condensates of polyalkylene oxides consisting of at least 10 units of an alkylene oxide having from 2 to 4 carbon atoms, such as ethylene oxide, propylene-1,2-oxide and butylene-1,2-oxide, preferably ethylene oxide and compounds having at least one active hydrogen atom, such as water, aliphatic alcohols, aromatic alcohols, fatty acids, organic amines, and hexitol derivatives, and block copolymers of two or more kinds of polyalkylene oxides. In other words, specifically, the following compounds can be used as polyalkylene oxide compounds: polyalkylene glycols, polyalkylene glycol alkyl ethers, polyalkylene glycol aryl ethers, polyalkylene glycol (alkylaryl) esters, polyalkylene glycol esters, polyalkylene glycol fatty acid amides, polyalkylene glycol amines, polyalkylene glycol block copolymers, and polyalkylene glycol graft polymers.

Compounds having a molecular weight of from 500 to 10,000 are preferably used.

Specific examples of the polyalkylene oxide compounds preferably used in the present invention are as follows:

Examples of polyalkylene oxide compounds:

1. $HO(CH_2CH_2O)_9H$
2. $C_{12}H_{25}O(CH_2CH_2O)_{15}H$
3. $C_8H_{17}CH{=}CHC_8H_{16}O(CH_2CH_2O)_{15}H$

-continued

4. 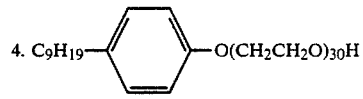

5. $C_{11}H_{23}COO(CH_2CH_2O)_{80}H$

6. $C_{11}H_{23}CONH(CH_2CH_2O)_{15}H$

7. $C_{12}H_{25}N(CH_2CH_2O)_{15}H)_2$

8. $C_{14}H_{29}N(CH_2)(CH_2CH_2O)_{24}H$

9. $H(CH_2CH_2O)_a(CH(CH_3)CH_2O)_b(CH_2CH_2O)_cH$ a + b + c = 50
b:a + c = 10:9

These polyalkylene oxide compounds may be used singly or in combinations of two or more kinds.

In the addition of the above polyalkylene oxide compounds to a silver halide photosensitive material, they can be added in an amount ranging from $5\times10^{-4}$ to 5 g, preferably from $1\times10^{-3}$ to 1 g, per mol of silver halide. In the addition of the above polyalkylene oxide compounds to a developer, they can be added in an amount ranging from 0.1 to 10 g per liter of the developer.

(2) The compounds of formula (I) of the present invention are effective to improve (elongate) the halftone of a photosensitive material having a monodispersion silver halide emulsion layer capable of forming a superhard negative image with a stable developer by the action of the hydrazine derivatives described in U.S. Pat. Nos. 4,224,401, 4,168,977, 4,241,164, 4,311,781, 4,272,606, 4,221,857, 4,243,739, 4,272,614, 4,269,929, etc., without deteriorating the quality of dots. By the above stable developer is meant a developer which contains sulfite ions, a preservative, in an amount of at least 0.15 mol/l and the pH of which is 10.0 to 12.3. This developer is more stable than ordinary lith developers which can contain only very small amount of sulfite ions because the developer can contain a large amount of preservatives and less subject to the oxidation by the air and consequently more stable than, for example, the developer (pH=12.8) of the hard tone image forming system described in U.S. Pat. No. 2,419,975 because the developer has a relatively low pH value. In this case, the compounds of formula (I) of the present invention which contain a development inhibitor as the PUG are employed in an amount of preferably from $1\times10^{-5}$ to $8\times10^{-2}$ mol, particularly from $1\times10^{-4}$ to $5\times10^{-2}$ mol, per mol of silver halide. The hydrazine derivatives as used in the above-described case are expressed by formula (VIII)

$$R_1—NHNH—G—R_2 \qquad \text{(VIII)}$$

wherein $R_1$ represents an aliphatic or aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl, sulfonyl, sulfoxy, phosphoryl, or N-substituted or unsubstituted iminomethylene group.

In formula (VIII), the aliphatic groups represented by $R_1$ are preferably of from 1 to 30 carbon atoms and straight chain, branched, or cyclic alkyl groups having from 1 to 20 carbon atoms are most desired. The branched alkyl groups may be cyclized so as to form a saturated heterocycle containing one or more hetero atoms. Further, these alkyl groups may have substituents such as an aryl, alkoxy, sulfoxy, sulfonamide, or carboxylic amide group.

In formula (VIII), the aromatic groups represented by $R_1$ are monocyclic or bicyclic aryl groups or unsaturated heterocyclic groups. These unsaturated heterocyclic groups may be condensed with monocyclic or bicyclic group to form a heteroaryl group.

The aromatic groups include benzene, naphthalene, pyridine, pyrimidine, imidazole, pyrorazole, quinoline, isoquinoline, benzimidazole, thiazole, and benzothiazole rings. Among them, the aromatic groups containing a benzene ring are preferred. The most desirable $R_1$ is an aryl group.

The aryl or unsaturated heterocyclic group of $R_1$ may be substituted, typical substituents including straight chain, branched or cyclic alkyl (having preferably from 1 to 20 carbon atoms), aralkyl (preferably monocyclic or bicyclic aralkyl the portion of which is of from 1 to 3 carbon atoms), alkoxy (preferably having from 1 to 20 carbon atoms), substituted amino (preferably an amino group substituted by an alkyl group of from 1 to 20 carbon atoms), acylamino (preferably having from 2 to 30 carbon atoms), sulfonamide (preferably having from 1 to 30 carbon atoms) and ureido groups (preferably having from 1 to 30 carbon atoms).

In formula (VIII), the alkyl groups represented by $R_2$ are those having preferably 1 to 4 carbon atoms and may have such substituents as halogen atoms, cyano, carboxy, sulfo, alkoxy, and phenyl groups.

Of the groups represented by $R_2$ in formula (VIII), aryl groups which may be substituted are a monocyclic or bicyclic aryl group, which, for example, contains benzene rings. This aryl group may be substituted by, e.g., a halogen atom, an alkyl, cyano, carboxyl or sulfo group.

Of the groups represented by $R_2$ in formula (VIII), alkoxy groups which may be substituted are those having from 1 to 8 carbon atoms, which may be substituted by a halogen atom, an aryl group, etc.

Of the groups represented by $R_2$ in formula (VIII), aryloxy groups which may be substituted are preferably monocyclic ones and exemplary substituents include halogen atoms and the like.

When G is a carbonyl group, of the groups represented by $R_2$, preferred ones are a hydrogen atom, methyl, methoxy, ethoxy and substituted or unsubstituted phenyl groups, a hydrogen atom being the most desirable.

When G is a sulfonyl group, preferable $R_2$ is a methyl, ethyl, phenyl or 4-methylphenyl group, the most desirable $R_2$ being a methyl group.

When G is a phosphoryl group, preferable $R_2$ is a methoxy, ethoxy, butoxy, phenoxy or phenyl group, the most desirable $R_2$ being a phenoxy group.

When G is a sulfoxy group, preferable $R_2$ is a cyanobenzyl, methylthiobenzyl group, etc., and when G is an N-substituted or unsubstituted iminomethylene group, preferable $R_2$ is methyl, ethyl and substituted or unsubstituted phenyl groups.

$R_1$ or $R_2$ of formula (VIII) may have a ballast group incorporated therein, which is ordinarily used in passive photographic additives such as couplers. The ballast group is a relatively inactive group photographically, having 8 or more carbon atoms and may be selected from, for example, alkyl, alkoxy, phenyl, alkylphenyl, phenoxy, and alkylphenoxy groups.

$R_1$ and $R_2$ of formula (VIII) may have a group incorporated therein which strengthens the adsorption on the surface of silver halide grains. Such adsorption groups include thiourea, heterocyclic thioamide, mercaptoheterocyclic, triazole groups described in U.S. Pat. No. 4,385,108.

For G of formula (VIII), a carbonyl group is the most desirable.

Specific examples of the compounds represented by formula (VIII) are set forth below, which should not be interpreted as limiting the present invention.

VIII-1

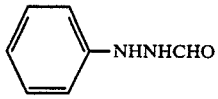

VIII-2

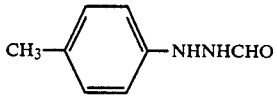

VIII-3

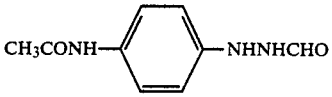

VIII-4

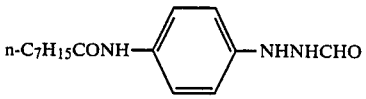

VIII-5

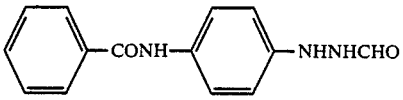

VIII-6

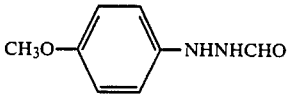

VIII-7

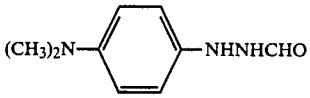

VIII-8

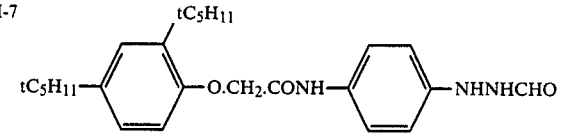

VIII-9

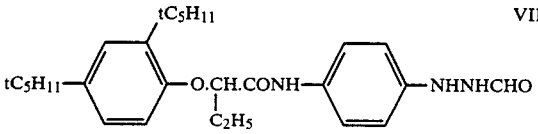

VIII-10

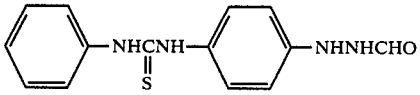

VIII-11

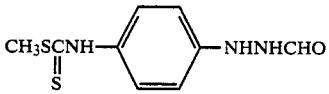

VIII-12

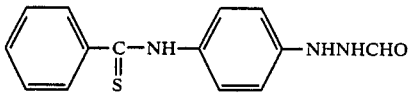

VIII-13

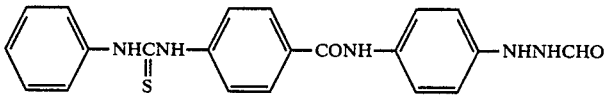

VIII-14

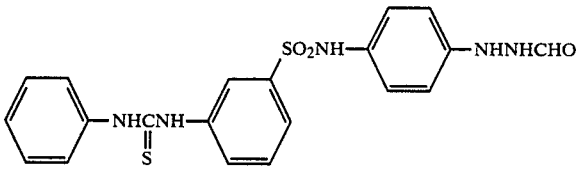

VIII-15

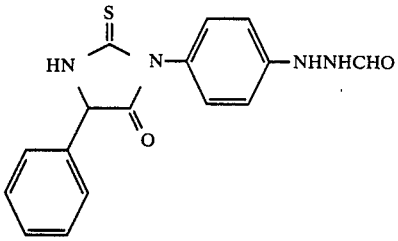

VIII-16

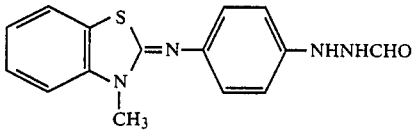

VIII-17

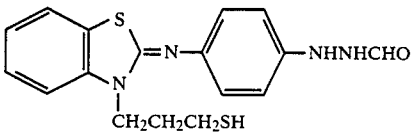

-continued
VIII-18
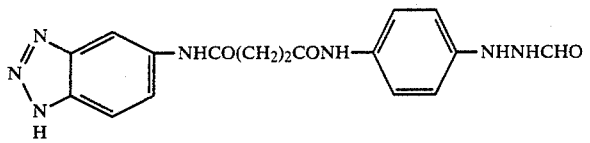
VIII-19
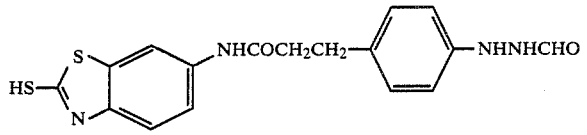
VIII-20
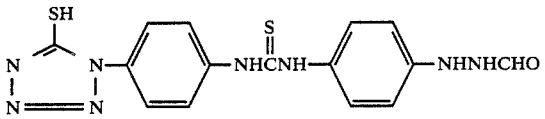
VIII-21
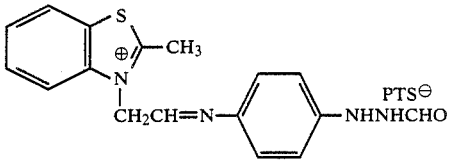
VIII-22
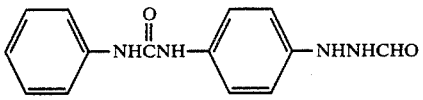
VIII-23
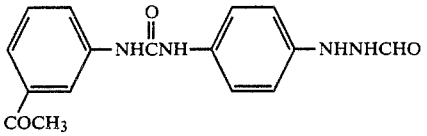
VIII-24
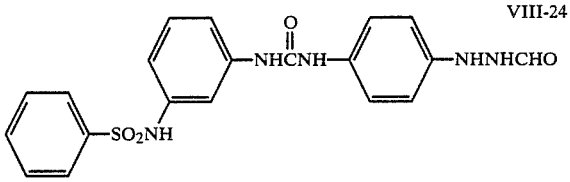
VIII-25
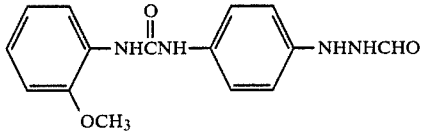
VIII-26
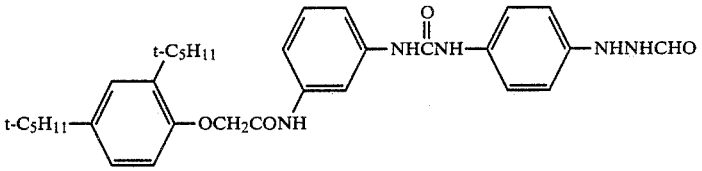
VIII-27
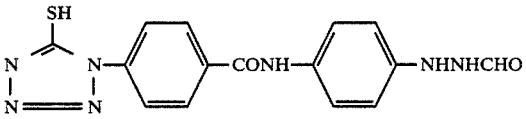
VIII-28
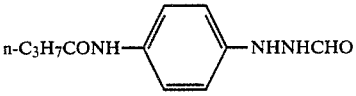
VIII-29
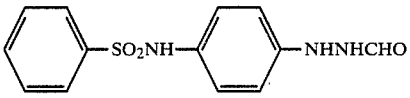
VIII-30
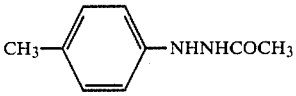
VIII-31
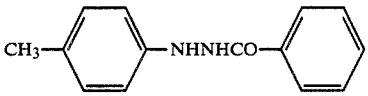
VIII-32
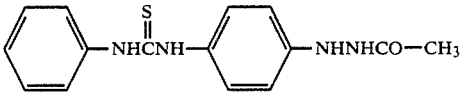
VIII-33
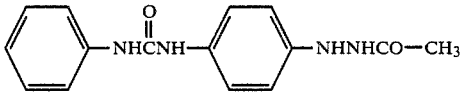
VIII-34
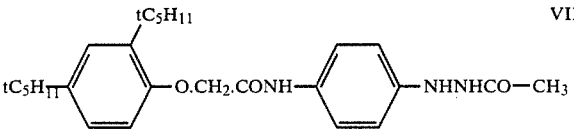

-continued
VIII-35
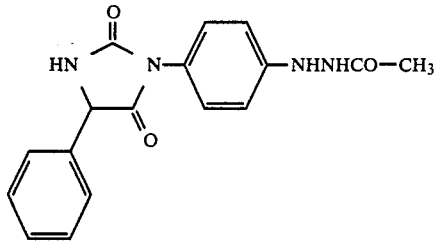
VIII-36
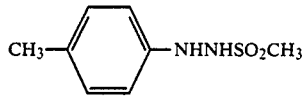
VIII-37
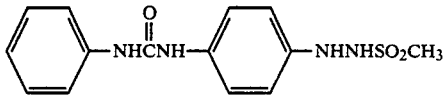
VIII-38
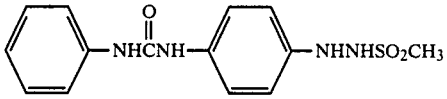
VIII-39
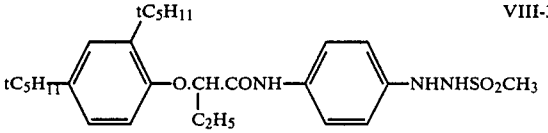
VIII-40
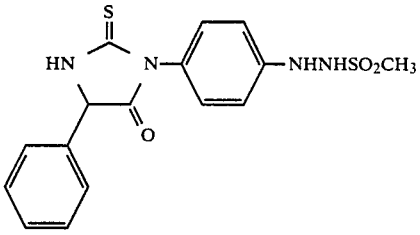
VIII-41
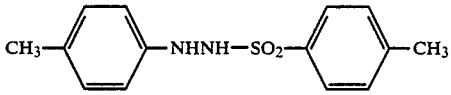
VIII-42
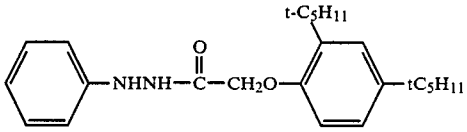
VIII-43
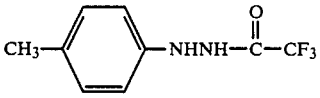
VIII-44
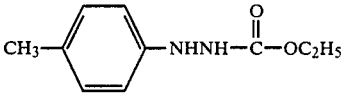
VIII-45
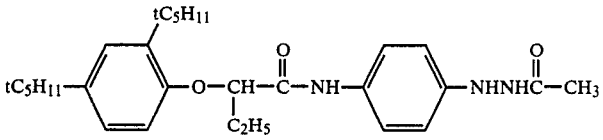
VIII-46
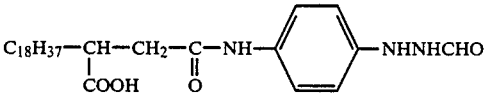
VIII-47
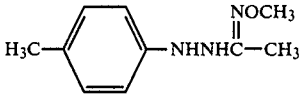
VIII-48
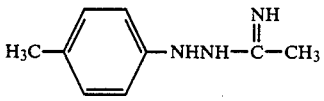
VIII-49
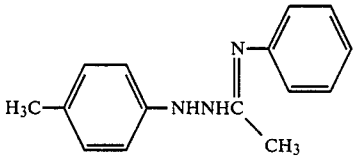
VIII-50
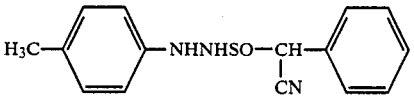
VIII-51
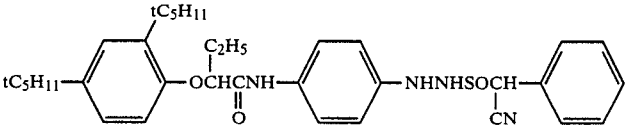

-continued
VIII-52
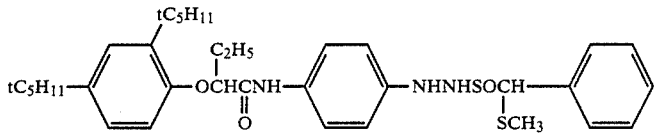
VIII-53
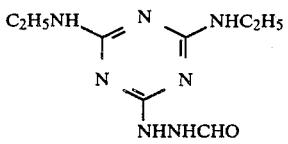
VIII-54
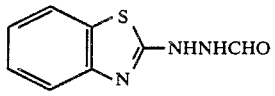
VIII-55
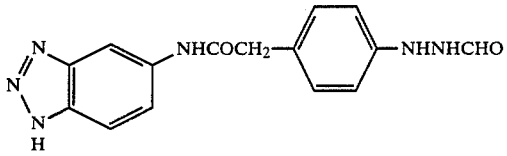
VIII-56
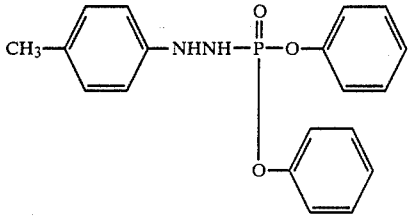
VIII-57
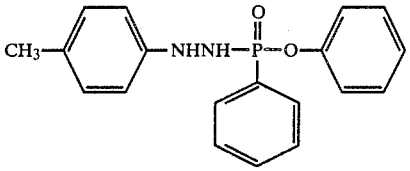
VIII-58
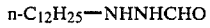
VIII-59
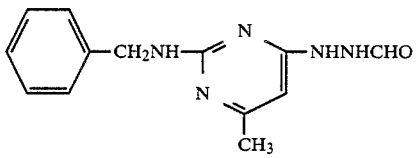
VIII-60
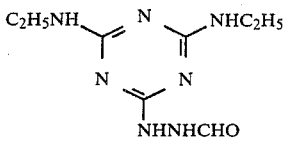
VIII-61
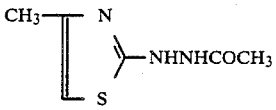
VIII-62
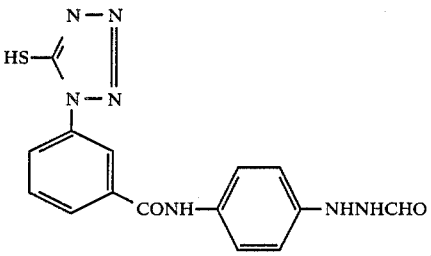
VIII-63
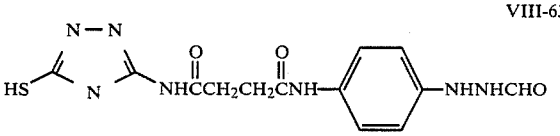
VIII-64
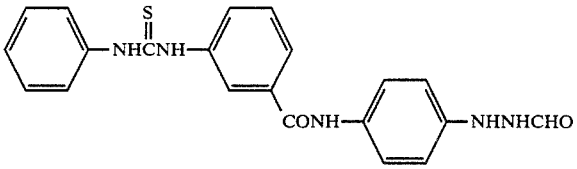
VIII-65
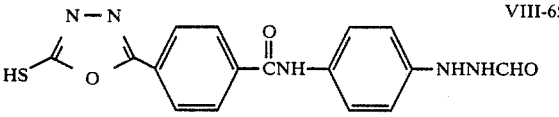
VIII-66
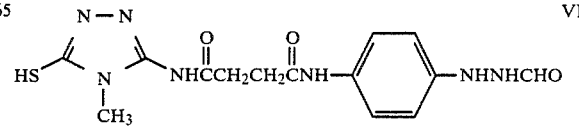

Methods of synthesizing these compounds are described in Japanese Patent Application (OPI) Nos. 20921/78, 20922/78, 66732/78, 20318/78, and the like.

When incorporating the compounds represented by formula (VIII) in a photosensitive material, it is preferable to incorporate them in a silver halide emulsion layer, but they may be incorporated in another non-photosensitive hydrophilic colloid layer (e.g., a protective layer, an intermediate layer, a filter layer and an antihalation layer). Specifically, when the compound to be used is water-soluble, it may be added as an aqueous solution, and when it is sparingly soluble in water, it may be added to a hydrophilic colloid solution as a solution of an organic solvent such as alcohols, esters and ketones miscible with water. When being added to the silver halide emulsion layer, the compound may be added at any time from the initiation of chemical ripening to the coating of the emulsion, but it is preferable to add the compound in the course of from the completion of the chemical ripening to the coating of the emulsion. It is most desirable to add the compound to a coating solution prepared separately.

It is desirable to select the optimum content of the compound represented by formula (VIII) depending on the grain size of the silver halide emulsion, the composition of the halogen, the method and degree of the chemical sensitization, the relationship between the layer to which said compound is added and the silver halide emulsion layer, and the kind of the antifogging compound. The method of testing for the selection is well known to those skilled in the art. Usually, an amount ranging preferably from $10^{-6}$ to $1\times10^{-1}$ mol, and particularly from $10^{-5}$ to $4\times10^{-2}$ mol, per mol of silver halide is used.

(3) The compounds represented by formula (I) according to the present invention can be applied to a multilayer and multicolor photographic material having at least two different spectral sensitivities on the base for the purpose of chiefly improving granular property, sharpness and color reproducibility and heightening sensitivity. The multilayer color photographic material usually has on the base at least each one of red-sensitive emulsion layer, green-sensitive emulsion layer and blue-sensitive emulsion layer. The order of these layers may be selected optionally as required. A preferable order of the layers is red-sensitive, green-sensitive and blue-sensitive or blue-sensitive, red-sensitive and green-sensitive as counted from the base side. Each of said emulsion layers may consist of two or more emulsion layers having different sensitivities or a non-photosensitive layer may exist between two or more emulsion layers having the same sensitivity. Usually, cyan forming, magenta forming and yellow forming couplers are incorporated into the red-sensitive, green-sensitive and blue-sensitive emulsion layers, respectively, but different combinations are possible as the case may be.

The compounds of the present invention can be used together with a coupler and added to the same emulsion layer or it can be added as a separate emulsified dispersion to a photographic auxiliary layer such as the intermediate layer.

The compounds of the present invention may be added to the coupler in each photosensitive layer, that is, the yellow coupler in the blue-sensitive layer, the magenta coupler in the green-sensitive layer or the cyan coupler in the red-sensitive layer in color photo-sensitive materials in an amount of 0.1 to 50 mol%, preferably 0.3 to 15 mol%. It is preferable to use the compound in an amount of $1\times10^{-5}$ to $8\times10^{-2}$, particularly $1\times10^{-4}$ to $5\times10^{-2}$ mol, per mol of the silver halide in the layer to be added to.

(4) The compounds of formula (I) of the present invention are effective to improve photographic properties such as sharpness of a monochromatic photosensitive material, especially X-ray photosensitive material which has on one side or both sides of the base a silver iodobromide or silver chloroiodobromide emulsion layer containing 0 to 50 mol% of silver chloride and up to 15 mol% of silver iodide. In this case, preferable amount used is in the range of $1\times10^{-6}$ to $1\times10^{-1}$, particularly $1\times10^{-5}$ to $5\times10^{-2}$ mol, per mol of silver halide.

In addition to the above, the compounds of formula (I) of the present invention can be applied to various photosensitive materials used for electron beam, high resolution monochromatic photograph, diffusion transfer monochromatic photograph, color X-ray, diffusion transfer color photograph and the like.

The compounds of formula (I) of the present invention are also advantageously used for the thermal development photosensitive materials described in Japanese Patent Application (OPI) Nos. 58543/83 U.S. Pat. No. 4,500,626), 164551/84 and 166954/84 and U.S. Pat. Nos. 4,503,137, 4,583,914, 4,478,927, 4,455,363, 4,500,626, 4,463,079, 4,474,867 and the like.

The present invention will be further described in detail by reference to the following examples, which should not be construed to limit the scope of the invention.

The preparation of the emulsions and the compositions of the processing solutions used in Examples 1 to 3 will be given together as follows.

Preparation of Emulsion (A)

A silver iodobromide emulsion of high monodispersion was prepared by adding simultaneously an aqueous solution of silver nitrate and a mixed aqueous solution of potassium iodide and potassium bromide to an aqueous solution of gelatin maintained at 50° C. by the double jet method while pAg is maintained at 7.5. The obtained silver iodobromide grains were cubic, the average grain size was 0.26 μm, and the content of silver iodide was 2 mol%.

This emulsion was washed with water according to the conventional method to remove soluble salts, and thereafter subjected to chemical sensitization by adding sodium thiosulfate to it.

Preparation of Emulsion (B)

A monodispersion of silver chlorobromide emulsion was obtained in the same manner as in Emulsion (A) except that the addition and the mixing of an aqueous solution of silver nitrate and those of an aqueous solution of halide were conducted at 60° C. and in the presence of potassium hexachloroiridiumate (III) in an amount of $4\times10^{-7}$ mol per mol of silver. It was washed with water and subjected to chemical sensitization as Emulsion (A). The prepared silver chlorobromide grains were cubic, the average grain size was 0.28 μm, and the content of silver chloride was 30 mol%.

Preparation of Emulsion (C)

A monodispersion of silver chlorobromide emulsion was prepared by adding simultaneously an aqueous solution of silver nitrate and an aqueous solution of a halide to an aqueous solution of gelatin maintained at 50° C. by the double jet method and mixing them while pAg was maintained at 7.8. This emulsion was precipitated, washed with water according to the conventional method to remove soluble salts and thereafter subjected to chemical sensitization by adding sodium thiosulfate as Emulsion (A). The silver chlorobromide grains of the emulsion thus obtained were cubic, the average grain size was 0.30 μm, and the content of silver bromide was 30 mol%.

Preparation of Emulsion (D)

A monodispersion of silver chlorobromide (the average grain size: 0.30 μm, the content of silver bromide: 30 mol%) was prepared in the same manner as in Emulsion (C) except that the addition and the mixing were conducted in the presence of rhodium ammonium chloride in an amount of $5\times10^{-6}$ mol per mol of silver for forming grains of silver chlorobromide. The emulsion was washed with water and subjected to chemical sensitization by adding sodium thiosulfate and potassium chlorooleate as in Emulsion (C).

| Composition of Developer (E) | |
|---|---|
| Hydroquinone | 40.0 g |
| 4,4-Dimethyl-1-phenyl-3-pyrazolidone | 0.4 g |
| Anhydrous Sodium Sulfite | 75 g |
| Sodium Hydrogencarbonate | 7.0 g |
| EDTA Disodium Salt | 1.0 g |
| Potassium Bromide | 6.0 g |
| 5-Methylbenzotriazole | 0.6 g |
| Water to make | 1 liter |
| The pH was adjusted to 12.0 by the addition of potassium hydroxide. | |
| **Composition of Developer (F)** | |
| Hydroquinone | 40.0 g |
| 4,4-Dimethyl-1-phenyl-3-pyrazolidone | 0.4 g |
| Sodium Hydroxide | 13.0 g |
| Anhydrous Potassium Sulfite | 90.0 g |
| Potassium Phosphate | 74.0 g |
| EDTA Disodium Salt | 1.0 g |
| Potassium Bromide | 6.0 g |
| 5-Methylbenzotriazole | 0.6 g |
| 1-Diethylamino-2,3-dihydroxypropane | 17.0 g |
| Water to make | 1 liter |
| The pH was adjusted to 11.4 by the addition of potassium hydroxide. | |

EXAMPLE 1

To Emulsion (D) were added 4-hydroxy-6-methyl-1,3,3a,7-tetraazaindene, a dispersion of polyethylene acrylate, polyethylene glycol (the average molecular weight: 1,000), 1,3-bisvinylsulfonyl-2-propanol, Sensitizing Dye (A) and Compound (VIII-9) of formula (VIII), and the compound of formula (I) of the present invention was added to the mixture. Sample Nos. 101 to 116 were prepared by coating simultaneously the resulting mixture on a polyethylene terephthalate film such that the amount of the silver coated was 3.5 g/m² and that of the gelatin coated was 2.0 g/m² and on this layer an aqueous solution containing gelatin as the chief ingredient and coating aids such as a surfactant and a tackifier such that the amount of the gelatin added was 1.1 g/m². Sample Nos. 117 to 120 were prepared in quite the same manner as in the above samples except that the compound of formula (I) was replaced by Comparative Compounds (B) to (E).

After the films thus obtained were exposed to light with Gray Scanner Negative Contact Screen No. 2, 150L manufactured by Dainippon Screen Co., Ltd. through an optical wedge for sensitometry, they were developed in the developer of Composition (E) at 38° C. for 30 sec., followed by fixation, rinsing and drying. The obtained results are shown in Table 1.

Sensitizing Dye (A)

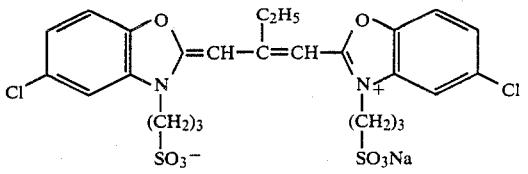

Comparative Compound (B)

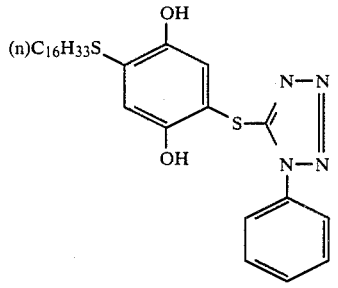

Comparative Compound (C)

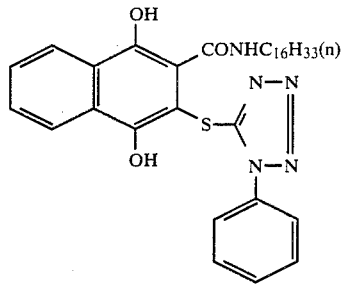

Comparative Compound (D)

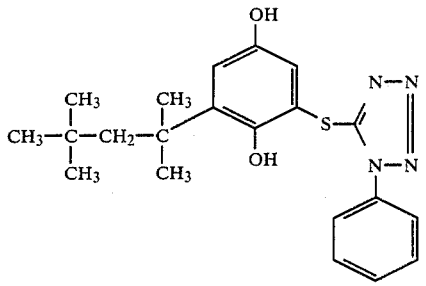

Comparative Compound (E)

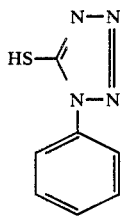

TABLE 1

| Sample No. | Emulsion | Compound of General Formula (VIII) | Processing Solution | Compound of General Formula (I) Structural Formula | Amount of Addition (mol/mol Ag) | Result Quality of Dot | Halftone | Remarks |
|---|---|---|---|---|---|---|---|---|
| 101 | D | (VIII-9) | E | — | — | 4 | 1.18 | Control |
| 102 | " | " | " | (I-34) | $4.0 \times 10^{-3}$ | 5 | 1.30 | Invention |
| 103 | " | " | " | (I-39) | $4.0 \times 10^{-3}$ | 4.5 | 1.41 | " |
| 104 | " | " | " | (I-43) | $3.0 \times 10^{-3}$ | 5 | 1.32 | " |
| 105 | " | " | " | (I-36) | $4.0 \times 10^{-3}$ | 5 | 1.25 | " |
| 106 | " | " | " | (I-7) | $4.0 \times 10^{-3}$ | 4.5 | 1.29 | " |
| 107 | " | " | " | (I-1) | $4.0 \times 10^{-3}$ | 4.5 | 1.30 | " |
| 108 | " | " | " | (I-25) | $4.0 \times 10^{-3}$ | 4.5 | 1.25 | " |
| 109 | " | " | " | (I-29) | $3.0 \times 10^{-3}$ | 4.0 | 1.37 | " |
| 110 | " | " | " | (I-49) | $4.0 \times 10^{-3}$ | 4.5 | 1.30 | " |
| 111 | " | " | " | (I-48) | $3.0 \times 10^{-3}$ | 4.5 | 1.39 | " |
| 112 | " | " | " | (I-51) | $4.0 \times 10^{-3}$ | 4.5 | 1.27 | " |
| 113 | " | " | " | (I-6) | $1.5 \times 10^{-3}$ | 4.5 | 1.47 | " |
| 114 | " | " | " | (I-66) | $1.5 \times 10^{-3}$ | 5.0 | 1.46 | " |
| 115 | " | " | " | (I-68) | $1.5 \times 10^{-3}$ | 5.0 | 1.45 | " |
| 116 | " | " | " | (I-73) | $1.5 \times 10^{-3}$ | 5.0 | 1.44 | " |
| 117 | " | " | " | (B) | $4.0 \times 10^{-3}$ | 4.0 | 1.20 | Comparison |
| 118 | " | " | " | (C) | $4.0 \times 10^{-3}$ | 3.0 | 1.25 | " |
| 119 | " | " | " | (D) | $4.0 \times 10^{-3}$ | 4.0 | 1.21 | " |
| 120 | " | " | " | (E) | $4.0 \times 10^{-3}$ | 3.0 | 1.18 | " |

In Table 1, the quality of dot was evaluated by visual inspection in 5 grades, grade 5 representing the best and grade 1 representing the worst quality. Only grades 5 and 4 can be used practically for dot negative for preparing plate.

The halftone represents the difference between log values of the amount of exposure giving blacking areas of 5% and 95% of each dot, and a larger difference shows a softer halftone.

As evident from Table 1, better quality of dots and softer halftone can be obtained by using the compounds represented by formula (I) of the present invention than by using other compounds from those according to the present invention.

EXAMPLE 2

To Emulsion (A) were added 4-hydroxy-6-methyl-1,3,3a,7-tetraazaindene, a dispersion of polyethyl acrylate, polyethylene glycol (the average molecular weight: 1,000), 1,3-bisvinylsulfonyl-2-propanol, a compound of Sensitizing Dye (A) (Sample Nos. 201 to 219) or of Sensitizing Dye (A') (Sample Nos. 201' to 219'), a compound of formula (VIII) and potassium iodide. After a compound of formula (I) was added to the mixture, Sample Nos. 201 to 219 were prepared by coating simultaneously the resulting mixture on a polyethylene terephthalate film such that the amount of coated silver was 3.5 g/m$^2$ and that of coated gelatin was 2.0 g/m$^2$ and an aqueous solution containing gelatin as the chief ingredient and coating aids such as a surfactant and a tackifier on farther side of the base such that the amount of coated gelatin was 1.1 g/m$^2$. After the films thus obtained were exposed to light with Gray Scanner Negative Contact Screen No. 2, 150L manufactured by Dainippon Screen Co., Ltd. through an optical wedge for sensitometry, they were developed in the developer of Composition (E) or (F) at 38° C. for 30 sec., followed by fixation, rinsing and drying.

The obtained results are shown in Tables 2-1 and 2-2.

Sensitizing Dye (A)

The same compound as that described in Example 1.

Sensitizing Dye (A')

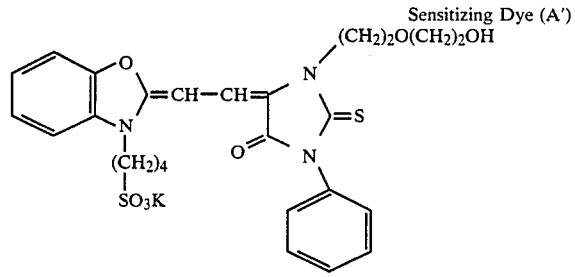

TABLE 2

| Sample No. | Emulsion | Compound of General Formula (VIII) | Processing Solution | Compound of General Formula (I) Structural Formula | Amount of Addition (mol/mol Ag) | Result Quality of Dot | Halftone | Remarks |
|---|---|---|---|---|---|---|---|---|
| 201 | A | (VIII-9) | E | — | — | 4 | 1.15 | Comparison |
| 202 | " | " | " | (I-34) | $4.0 \times 10^{-3}$ | 5.0 | 1.31 | Invention |
| 203 | " | " | " | " | $8.0 \times 10^{-3}$ | 4.5 | 1.38 | " |
| 204 | " | " | " | (I-39) | $4.0 \times 10^{-3}$ | 4.5 | 1.37 | " |
| 205 | " | " | " | " | $8.0 \times 10^{-3}$ | 4.0 | 1.42 | " |
| 206 | " | " | " | (I-43) | $4.0 \times 10^{-3}$ | 4.5 | 1.35 | " |
| 207 | " | " | " | " | $8.0 \times 10^{-3}$ | 4.0 | 1.42 | " |
| 208 | " | " | " | (I-6) | $2.0 \times 10^{-3}$ | 5.0 | 1.43 | " |
| 209 | " | " | " | " | $4.0 \times 10^{-3}$ | 4.5 | 1.45 | " |
| 210 | " | " | " | (I-66) | $2.0 \times 10^{-3}$ | 5.0 | 1.41 | " |
| 211 | " | " | " | " | $4.0 \times 10^{-3}$ | 4.5 | 1.44 | " |
| 212 | " | " | " | (I-68) | $2.0 \times 10^{-3}$ | 4.5 | 1.44 | " |
| 213 | " | " | " | " | $4.0 \times 10^{-3}$ | 4.0 | 1.47 | " |
| 214 | " | " | " | (I-73) | $2.0 \times 10^{-3}$ | 5.0 | 1.43 | " |
| 215 | " | " | " | " | $4.0 \times 10^{-3}$ | 4.5 | 1.46 | " |
| 216 | " | (VIII-27) | " | — | — | 4 | 1.13 | Comparison |

TABLE 2-continued

| Sample No. | Emulsion | Compound of General Formula (VIII) | Processing Solution | Compound of General Formula (I) Structural Formula | Amount of Addition (mol/mol Ag) | Result Quality of Dot | Halftone | Remarks |
|---|---|---|---|---|---|---|---|---|
| 217 | " | " | " | (I-34) | $4.0 \times 10^{-3}$ | 4.5 | 1.27 | Invention |
| 218 | " | (VIII-25) | " | — | — | 4.5 | 1.05 | Comparison |
| 219 | " | " | " | (I-34) | $4.0 \times 10^{-3}$ | 5 | 1.21 | Invention |
| (201)' | " | (VIII-9) | F | — | — | 4.0 | 1.10 | Comparison |
| (202)' | " | " | " | (I-34) | $4.0 \times 10^{-3}$ | 5.0 | 1.26 | Invention |
| (204)' | " | " | " | (I-39) | $4.0 \times 10^{-3}$ | 4.0 | 1.31 | " |
| (206)' | " | " | " | (I-43) | $4.0 \times 10^{-3}$ | 4.5 | 1.29 | " |
| (208)' | " | " | " | (I-6) | $2.0 \times 10^{-3}$ | 4.5 | 1.39 | " |
| (210)' | " | " | " | (I-66) | $2.0 \times 10^{-3}$ | 5.0 | 1.35 | " |
| (212)' | " | " | " | (I-68) | $2.0 \times 10^{-3}$ | 4.5 | 1.41 | " |
| (214)' | " | " | " | (I-73) | $2.0 \times 10^{-3}$ | 5.0 | 1.37 | " |
| (216)' | " | (VIII-27) | " | — | — | 4 | 1.09 | Comparison |
| (217)' | " | " | " | (I-34) | $4.0 \times 10^{-3}$ | 4.5 | 1.27 | Invention |
| (218)' | " | (VIII-25) | " | — | — | 4.5 | 1.03 | Comparison |
| (219)' | " | " | " | (I-34) | $4.0 \times 10^{-3}$ | 5.0 | 1.20 | Invention |

As described in Example 1, the value of halftone given in Tables 2-1 and 2-2 is the difference between log values of the amount of exposure giving blackened areas of 5% and 95% of each dot, a larger difference showing a softer halftone.

As is evident from Tables 2-1 and 2-2, softer halftones can be obtained by using the compounds represented by formula (I) of the present invention than by not using the same. By comparing Example 1 with Example 2, it was found that the halftone softening effect by the compounds of the present invention was significant, although the degree of the effect depends on the composition of the emulsion and the kind of the center forming agent and processing solution.

EXAMPLE 3

Sample Nos. 301 to 316 were prepared with Emulsion (B) or (C) by use of Sensitizing Dye (A) and Compound (VIII-9) of formula (VIII) in the same manner as in Example 1. After being exposed to light as in Example 1, the samples were developed in Developer (E) at 38° C. for 30 sec., followed by fixation, rinsing and drying. Table 3 shows the obtained results.

As described in Example 1, the value of the halftone given in Table 3 is the difference between log values of the amount of exposure giving blackened areas of 5% and 95% of dots.

As is evident from Table 3, it was found that the use of the compound represented by formula (I) exhibits a significant effect of softening halftone although the halogen composition of the silver chlorobromide emulsion may be different.

TABLE 3

| Sample No. | Emulsion | Compound of General Formula (VIII) | Processing Solution | Compound of General Formula (I) Structural Formula | Amount of Addition (mol/mol Ag) | Result Quality of Dot | Halftone | Remarks |
|---|---|---|---|---|---|---|---|---|
| 301 | B | (VIII-9) | E | — | — | 4.0 | 1.20 | Comparison |
| 302 | " | " | " | (I-34) | $4.0 \times 10^{-3}$ | 4.5 | 1.36 | Invention |
| 303 | " | " | " | (I-39) | $4.0 \times 10^{-3}$ | 5.0 | 1.34 | " |
| 304 | " | " | " | (I-43) | $4.0 \times 10^{-3}$ | 4.0 | 1.43 | " |
| 305 | " | " | " | (I-36) | $4.0 \times 10^{-3}$ | 4.5 | 1.37 | " |
| 306 | " | " | " | (I-66) | $2.0 \times 10^{-3}$ | 5.0 | 1.45 | " |
| 307 | " | " | " | (I-68) | $2.0 \times 10^{-3}$ | 4.5 | 1.49 | " |
| 308 | " | " | " | (I-73) | $2.0 \times 10^{-3}$ | 5.0 | 1.47 | " |
| 309 | C | " | " | — | — | 4.0 | 1.19 | Comparison |
| 310 | " | " | " | (I-34) | $4.0 \times 10^{-3}$ | 5.0 | 1.32 | Invention |
| 311 | " | " | " | (I-39) | $4.0 \times 10^{-3}$ | 4.5 | 1.37 | " |
| 312 | " | " | " | (I-43) | $4.0 \times 10^{-3}$ | 4.0 | 1.40 | " |
| 313 | " | " | " | (I-36) | $4.0 \times 10^{-3}$ | 4.5 | 1.35 | " |
| 314 | " | " | " | (I-66) | $2.0 \times 10^{-3}$ | 5.0 | 1.43 | " |
| 315 | " | " | " | (I-68) | $2.0 \times 10^{-3}$ | 4.5 | 1.51 | " |
| 316 | " | " | " | (I-73) | $2.0 \times 10^{-3}$ | 4.5 | 1.50 | " |

EXAMPLE 4

In order to evaluate the effectiveness of the compounds of the present invention, Multilayer Color Photosensitive Material 401 consisting of layers having the following compositions was prepared on transparent triacetyl cellulose provided with an undercoating layer.

The amount of the coated emulsion was expressed in the amount of silver coated.

| Sample 401 | |
|---|---|
| (1) Emulsion Layer | |
| A gelatin Layer Containing the Following: | |
| Negative Type Silver Iodobromide Emulsion (silver iodide: 5 mol %, average grain size: 0.6 μm) | 1.6 g/m$^2$ |
| Coupler (C-0) | 0.9 g/m$^2$ |
| Compound of the Present Invention (I-39) | 0.009 g/m$^2$ |
| Tricresyl Phosphate | 0.6 g/m$^2$ |
| (2) Protective Layer | |
| Gelatin | 2.5 g/m$^2$ |
| 2,4-Dichloro-6-hydroxy-s-triazine Sodium | 0.13 g/m$^2$ |

Sample Nos. 402 to 405

Sample Nos. 402 and 403 were prepared in the same manner as in Sample No. 401 except that Compound (I-39) of the present invention in Sample No. 401 was replaced by equimolar Compounds (I-43) and (I-49) of the present invention.

In addition to these, Sample Nos. 404 and 405 were prepared in the same manner as in Sample No. 401 except that Compound (I-39) of the present invention in Sample No. 401 was replaced by equimolar CompoundS (B) and (C) used for comparison.

For these samples, each one of which was subjected to (Condition B) forced deteriorating conditions (45° C., 80% RH, for 3 days) and each one of which was not undergone such conditions (Condition A) were exposed to image light for sensitometry and subjected to color development processing. The densities of the developed samples were measured with a red filter. The photographic properties obtained are summarized in Table 4.

The development processing employed here was conducted at 38° C. as follows.

| | |
|---|---|
| 1. Color Development | 3 min 15 sec |
| 2. Bleach | 6 min 30 sec |
| 3. Rinsing | 3 min 15 sec |
| 4. Fixation | 6 min 30 sec |
| 5. Rinsing | 3 min 15 sec |
| 6. Stabilization | 3 min 15 sec |

The compositions of the processing solution used for each process are as follows.

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleaching Solution: | |
| Ammonium Bromide | 160.0 g |
| Aqueous Ammonia (28%) | 25.0 cc |
| EDTA Sodium Iron Salt | 130.0 g |
| Glacial Acetic Acid | 14.0 cc |
| Water to make | 1 liter |
| Fixing Solution: | |
| Sodium Tetrapolyphosphate | 2.0 g |
| Sodium Sulfite | 4.0 g |
| Ammonium Thiosulfate (70%) | 175.0 cc |
| Sodium Bisulfite | 4.6 g |
| Water to make | 1 liter |
| Stabilizing Solution: | |
| Formalin | 8.0 cc |
| Water to make | 1 liter |

TABLE 4

| Sample | Compound | Condition A Fog | Condition A Relative Sensitivity* | Condition A γ** | Condition B (forced deterioration) Fog | Condition B Relative Sensitivity* | Condition B γ** |
|---|---|---|---|---|---|---|---|
| 401 | (I-39) | 0.07 | 100 | 0.82 | 0.07 | 98 | 0.80 |
| 402 | (I-43) | 0.06 | 93 | 0.80 | 0.06 | 93 | 0.79 |
| 403 | (I-49) | 0.07 | 120 | 0.89 | 0.07 | 117 | 0.88 |
| 404 | (B) | 0.07 | 110 | 0.84 | 0.06 | 93 | 0.78 |

TABLE 4-continued

| Sample | Compound | Condition A Fog | Condition A Relative Sensitivity* | Condition A γ** | Condition B (forced deterioration) Fog | Condition B Relative Sensitivity* | Condition B γ** |
|---|---|---|---|---|---|---|---|
| 405 | (C) | 0.06 | 95 | 0.82 | 0.06 | 80 | 0.76 |

*Relative Sensitivity: The reciprocal of exposure giving a density of (fog + 0.2), the relative sensitivity obtained for Sample No. 401 under condition A being taken as 100.

**γ: Inclination of the line connecting the density point of (fog + 0.2) with that of (fog + 1.2).

Coupler (C-0):

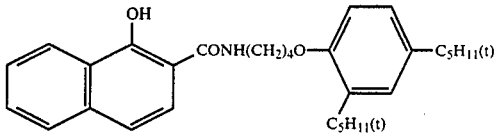

It is obvious from Table 4 that the photographic properties of Sample Nos. 401 to 403 which use the compounds of the present invention are almost unchanged under the forced deteriorating conditions as compared with the samples which use conventional compounds.

EXAMPLE 5

A Multilayer Color Photosensitive Material 501 consisting of layers having the following compositions was prepared on a transparent triacetyl cellulose film base.

| | |
|---|---|
| First Layer: Antihalation Layer | |
| A gelatin layer containing the following: | |
| Black Colloidal Silver | 0.15 g/m² |
| UV Absorber U-1 | 0.08 g/m² |
| UV Absorber U-2 | 0.12 g/m² |
| Second Layer: Intermediate Layer | |
| A gelatin layer containing the following: | |
| 2,5-Di-t-pentadecyl Hydroquinone | 0.18 g/m² |
| Coupler (C-1) | 0.11 g/m² |
| Third Layer: First Red-Sensitive Emulsion Layer | |
| A gelatin layer containing the following: | |
| Silver Iodobromide (silver iodide: 4 mol %, average grain size: 0.4 μm) | 1.2 g/m² |
| Sensitizing Dye I | $1.4 \times 10^{-4}$ mol per mol of silver |
| Sensitizing Dye II | $0.4 \times 10^{-4}$ mol per mol of silver |
| Sensitizing Dye III | $5.6 \times 10^{-4}$ mol per mol of silver |
| Sensitizing Dye IV | $4.0 \times 10^{-4}$ mol per mol of silver |
| Coupler (C-2) | 0.45 g/m² |
| Coupler (C-3) | 0.035 g/m² |
| Coupler (C-4) | 0.025 g/m² |
| Fourth Layer: Second Red-Sensitive Emulsion Layer | |
| A gelatin layer containing the following: | |
| Silver Iodobromide Emulsion (silver iodide: 8 mol %, average grain size: 0.8 μm) | 1.0 g/m² |
| Sensitizing Dye I | $5.2 \times 10^{-5}$ mol per mol of silver |
| Sensitizing Dye II | $1.5 \times 10^{-5}$ mol per mol of silver |
| Sensitizing Dye III | $2.1 \times 10^{-4}$ mol per mol of silver |
| Sensitizing Dye IV | $1.5 \times 10^{-5}$ mol per mol of silver |
| Coupler (C-2) | 0.050 g/m² |
| Coupler (C-5) | 0.070 g/m² |
| Coupler (C-3) | 0.035 g/m² |
| Fifth Layer: Intermediate Layer | |
| A gelatin layer containing: | |
| 2,5-Di-t-pentadecyl Hydroquinone | 0.08 g/m² |
| Sixth Layer: First Green-Sensitive Emulsion Layer | |
| A gelatin layer containing the following: | |
| Silver Iodobromide (silver iodide: 4 mol %, average grain size: 0.4 μm) | 0.80 g/m² |
| Sensitizing Dye V | $4.0 \times 10^{-4}$ mol per mol of silver |
| Sensitizing Dye VI | $3.0 \times 10^{-5}$ mol per mol of silver |
| Sensitizing Dye VII | $1.0 \times 10^{-4}$ mol per mol of silver |
| Coupler (C-6) | 0.45 g/m² |
| Coupler (C-7) | 0.13 g/m² |
| Coupler (C-8) | 0.02 g/m² |

-continued

| | |
|---|---|
| Coupler (C-4) | 0.04 g/m$^2$ |
| Seventh Layer: Second Green-Sensitive Emulsion Layer | |
| A gelatin layer containing the following: | |
| Silver Iodobromide (silver iodide: 8 mol %, average grain size: 0.8 μm) | 0.85 g/m$^2$ |
| Sensitizing Dye V | $2.7 \times 10^{-4}$ mol per mol of silver |
| Sensitizing Dye VI | $1.8 \times 10^{-5}$ mol per mol of silver |
| Sensitizing Dye VII | $7.5 \times 10^{-5}$ mol per mol of silver |
| Coupler (C-6) | 0.095 g/m$^2$ |
| Coupler (C-7) | 0.015 g/m$^2$ |
| Eighth Layer: Yellow Filter Layer | |
| A gelatin layer containing the following: | |
| Yellow Colloidal Silver | 0.08 g/m$^2$ |
| 2,5-Di-t-pentadecyl Hydroquinone | 0.090 g/m$^2$ |
| Ninth Layer: First Blue-Sensitive Emulsion Layer | |
| Silver Iodobromide Emulsion (silver iodide: 5 mol %, average grain size: 0.3 μm) | 0.37 g/m$^2$ |
| Sensitizing Dye VIII | $4.4 \times 10^{-4}$ mol per mol of silver |
| Coupler (C-9) | 0.71 g/m$^2$ |
| Coupler (C-4) | 0.07 g/m$^2$ |
| Tenth Layer: Second Blue-Sensitive Emulsion Layer | |
| A gelatin layer containing the following: | |

-continued

| | |
|---|---|
| Silver Iodobromide Emulsion (silver iodide: 7 mol %, average grain size: 0.9 μm) | 0.55 g/m$^2$ |
| Sensitizing Dye VIII | $3.0 \times 10^{-4}$ mol per mol of silver |
| Coupler (C-9) | 0.23 g/m$^2$ |
| Eleventh Layer: First Protective Layer | |
| A gelatin layer containing the following: | |
| UV Absorber U-1 | 0.14 g/m$^2$ |
| UV Absorber U-2 | 0.22 g/m$^2$ |
| Twelfth Layer: Second Protective Layer | |
| A gelatin layer containing the following: | |
| Silver Iodobromide Emulsion (silver iodide: 2 mol %, average grain size: 0.07 μm) | 0.25 g/m$^2$ |
| Polymethacrylate Particles (diameter: 1.5 μm) | 0.10 g/m$^2$ |

Besides the above described ingredients, Gelatin Hardener H-1 and a surfactant were added to each layer.

Structural Formulae of the Compounds Used in the Examples

UV Absorber U-1

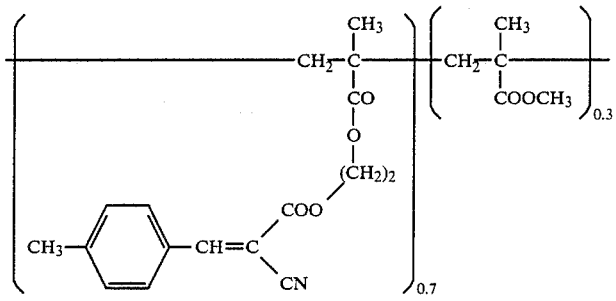

UV Absorber U-2

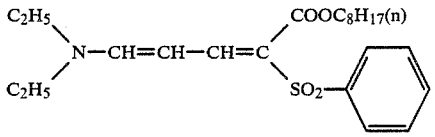

Coupler (C-1)

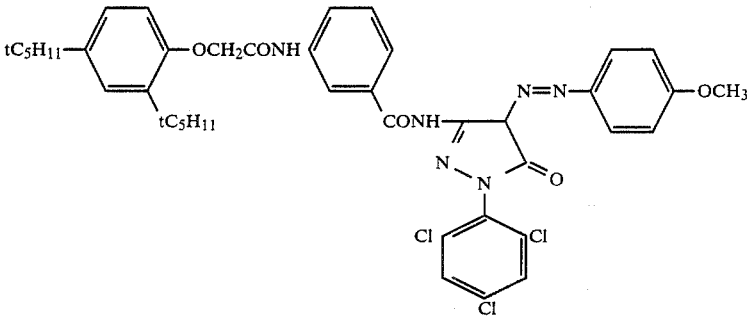

Coupler (C-2)

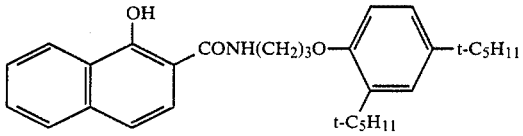

-continued
Coupler (C-3)
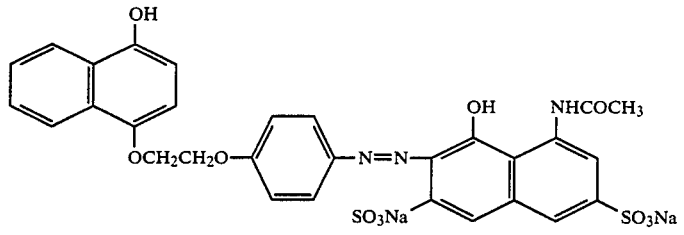
Coupler (C-4)
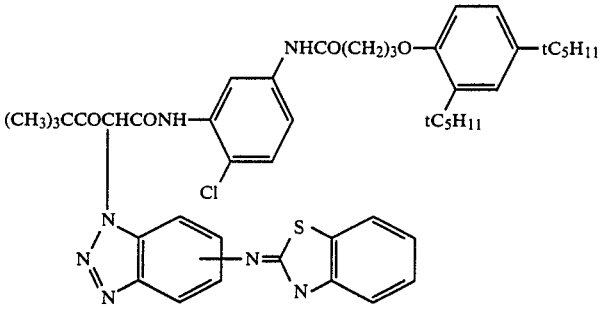
Coupler (C-5)
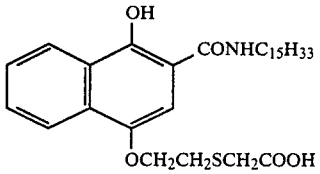
Coupler (C-6)
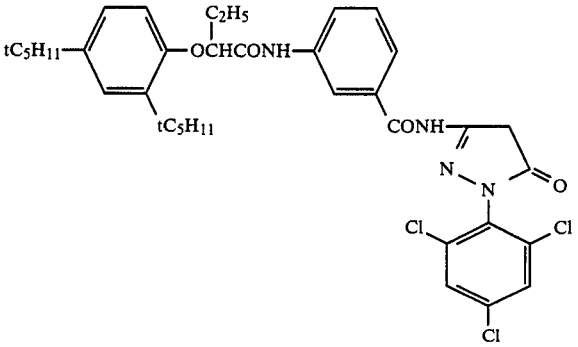
Coupler (C-7)
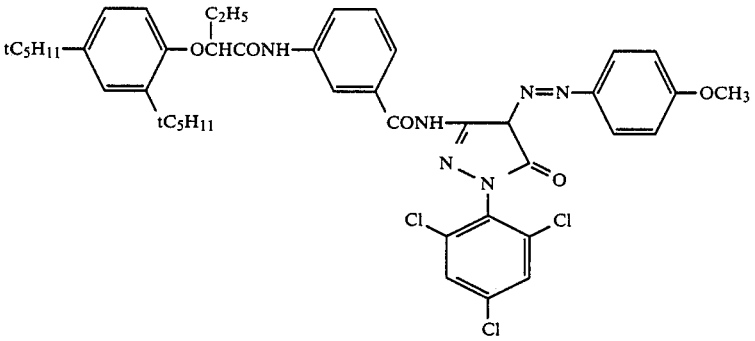

-continued
Coupler (C-8)
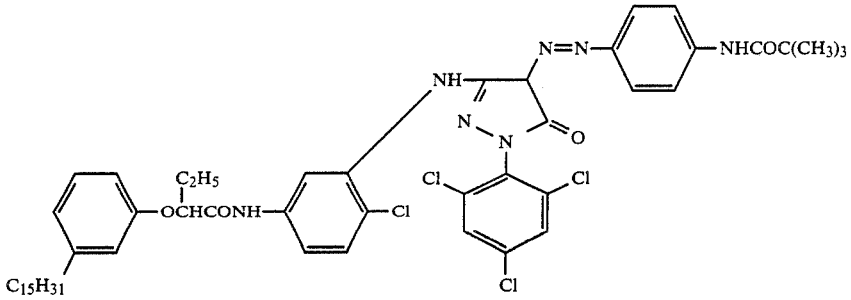
Coupler (C-9)
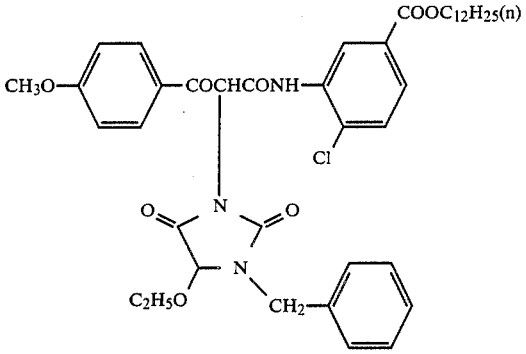
Gelatin Hardener H-1
$CH_2{=}CH{-}SO_2{-}CH_2{-}CONH(CH_2)_2NHCO{-}CH_2{-}SO_2{-}CH{=}CH$
Sensitizing Dye I
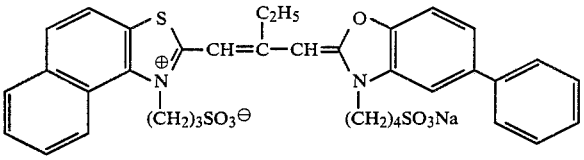
Sensitizing Dye II
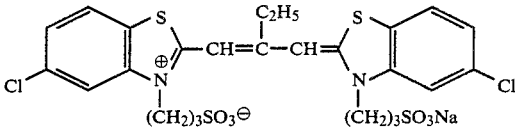
Sensitizing Dye III
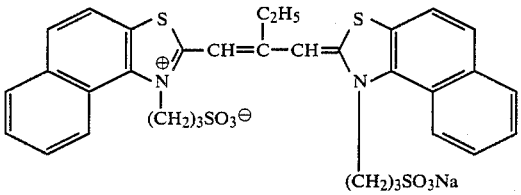
Sensitizing Dye IV
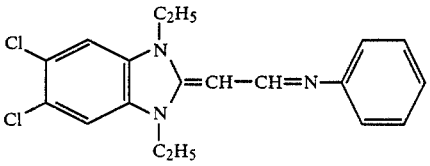

-continued

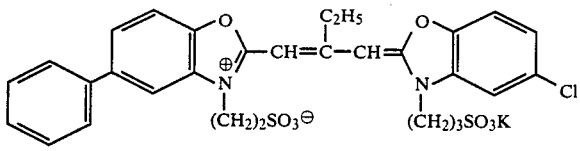

Sensitizing Dye V

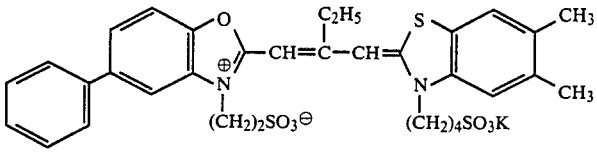

Sensitizing Dye VI

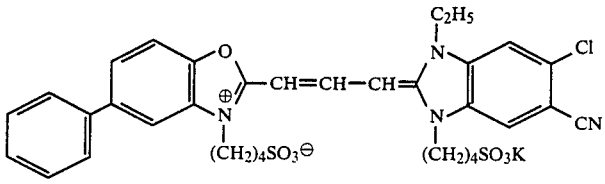

Sensitizing Dye VII

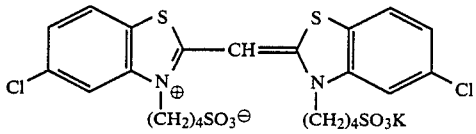

Sensitizing Dye VIII

Further, Sample Nos. 502 and 503 were prepared in the same manner as in Sample No. 501 except that Coupler (C-4) in the sixth layer was replaced by equimolar compound (I) of the present invention.

These samples were exposed to light for sensitometry and subjected to the same color development processing as in Example 4. Data on the photographic properties of them were obtained by measuring the densities of the developed samples with a green filter.

Besides, they were exposed to light through a filter the density of which is changing stepwise, subjected to the above-described color development processing and thereafter measured for granular property with a green filter. The granular property was measured by the conventional RMS method with an aperture of 48 μm. These results are shown in Table 5.

TABLE 5

| Sample No. | Compound | Relative Sensitivity | γ | RMS Value* | Remarks |
|---|---|---|---|---|---|
| 501 | (C-4) | 100 | 0.71 | 0.013 | Comparison |
| 502 | (I-39) | 100 | 0.72 | 0.011 | Invention |
| 503 | (I-43) | 97 | 0.70 | 0.010 | " |

*RMS Value at a density of 1.0

From Table 5, it is evident that both of the samples using the compounds of the present invention have a better granular property expressed by RMS value than that of Sample No. 501 using a conventional DIR coupler for comparison, even though they have almost the same relative sensitivity and γ.

EXAMPLE 6

Preparation of Photosensitive Silver Halides

A silver iodobromide emulsion (iodine content: 2 mol%) having an average grain size of 1.3 μm was prepared from silver nitrate, potassium bromide and potassium iodide by a conventional ammonia method, the emulsion was subjected to chemical sensitization by the gold and sulfur sensitization method using chloroauric acid and sodium thiosulfate, washed by a conventional precipitation method, and 4-hydroxy-6-methyl-1,3,3a,7-tetraazaindene was added as a stabilizer to the emulsion to obtain a photosensitive silver iodobromide emulsion.

Preparation of Sample Nos. 601 to 615

Sample Nos. 601 to 615 were prepared in which an emulsion layer consisting of the photosensitive silver halide emulsion prepared in accordance with the above method and the compounds of formula (I) of the present invention or compound (II) for comparison, and a protective layer or an aqueous gelatin solution were each uniformly and successively coated on both sides of an undercoated and processed polyester base.

In this case, the coated amount was the same at both sides, the total amount of the coated silver on both sides being 8.0 g/m$^2$, the amount of the coated gelatin of the protective layer being 2.6 g/m$^2$ and that of the coated gelatin of the emulsion layer being 5.2 g/m$^2$.

These samples were held between two sheets of fluorescence sensitizing paper containing calcium tungstate, a square wave chart made of aluminum was closely contacted as an object with the sheets, and they were exposed to X-ray such that a density of 1.0 was obtained. Thereafter they were developed by the following developer at 35° C. for 25 sec., followed by fixation, rinsing and drying. The processed samples were measured for CTF with a microphotometer. Table 6 shows the obtained results.

| Developer: | |
|---|---|
| Potassium Hydroxide | 29.14 g |
| Glacial Acetic Acid | 10.96 g |

-continued

| Developer: | |
|---|---|
| Potassium Sulfite | 44.20 g |
| Sodium Bicarbonate | 7.50 g |
| Boric Acid | 1.00 g |
| Diethylene Glycol | 28.96 g |
| Ethylenediaminetetraacetic Acid | 1.67 g |
| 5-Methylbenzotriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium Metabisulfite | 12.60 g |
| Water to make | 1 liter |

As is evident from Table 6, it was found that the CTF values of the photosensitive materials to which the compounds of the present invention are added are larger and their sharpness are better than those of the comparative samples having no compounds of the present invention. The effect of the compounds of the present invention is larger than that of Comparative Compound (B), which makes clear the usefulness of them.

TABLE 6

| | Compound (I) | | CTF | | |
|---|---|---|---|---|---|
| Sample No. | Structural Formula | Amount of Addition (mol/mol Ag) | 0.5 line/mm | 1 line/mm | Remarks |
| 601 | — | — | 0.81 | 0.62 | Control |
| 602 | (I-34) | $5 \times 10^{-3}$ | 0.89 | 0.72 | Invention |
| 603 | " | $10 \times 10^{-3}$ | 0.91 | 0.78 | " |
| 604 | (I-39) | $5 \times 10^{-3}$ | 0.89 | 0.73 | " |
| 605 | " | $10 \times 10^{-3}$ | 0.91 | 0.79 | " |
| 606 | (I-9) | $5 \times 10^{-3}$ | 0.88 | 0.71 | " |
| 607 | " | $10 \times 10^{-3}$ | 0.91 | 0.78 | " |
| 608 | (I-27) | $5 \times 10^{-3}$ | 0.84 | 0.68 | " |
| 609 | " | $10 \times 10^{-3}$ | 0.85 | 0.69 | " |
| 610 | (I-29) | $5 \times 10^{-3}$ | 0.90 | 0.72 | " |
| 611 | " | $10 \times 10^{-3}$ | 0.91 | 0.79 | " |
| 612 | (I-48) | $5 \times 10^{-3}$ | 0.87 | 0.71 | " |
| 613 | " | $10 \times 10^{-3}$ | 0.90 | 0.78 | " |
| 614 | (I-7) | $5 \times 10^{-3}$ | 0.86 | 0.69 | " |
| 615 | " | $10 \times 10^{-3}$ | 0.90 | 0.75 | " |
| 624 | (B) | $5 \times 10^{-3}$ | 0.82 | 0.64 | Comparison |
| 625 | " | $10 \times 10^{-3}$ | 0.83 | 0.66 | " |

EXAMPLE 7

A silver halide emulsion comprising 80 mol% of silver chloride, 19.5 mol% of silver bromide and 0.5 mol% of silver iodide was prepared by gold sensitization and sulfur sensitization according to a conventional method. The gelatin contained in this emulsion was 45% by weight based on the silver halides. To this emulsion were added 3-carboxymethyl-5-[2-(3-ethylthiazolinilidene)ethylidene]rhodanine (spectral sensitizer), 4-hydroxy-1,3,3a,7-tetraazaindene (stabilizer), polyoxyethylene nonylphenyl ether containing 50 ethylene oxide groups and the polymer latex described in formulation No. 3 of a preparation example of U.S. Pat. No. 3,525,620. Then, 1,2-bis(vinylsulfonylacetamido)ethane (hardener) was added to the resulting mixture such that it amounted to 2.6% by weight based on the total dry weight of the gelatin used in the composition (i.e., the total dry gelatin including that which was added to the non-photosensitive upper layer which will be described later). Finally, the compounds of the present invention were added to the resulting mixture in the form of an ethanol solution as shown in Table 7 to obtain a coating solution for a photosensitive silver halide emulsion layer.

On the other hand, a coating solution for a non-photosensitive upper layer was prepared separately by adding to a 5% gelatin solution sodium dodecylbenzenesulfonate (surfactant) and a polymethyl methacrylate latex (matting agent) having an average grain size of 3.0 to 4.0 μm.

Then, the above-described coating solution for the photosensitive silver halide emulsion layer and the coating solution for the non-photosensitive upper layer were applied to a polyester terephthalate base by the two-layer simultaneous coating method. The amount of silver coated was 3.0 g/m$^2$, and the thickness of the dried film of the non-photosensitive upper layer was 1.0 μm. Thus, Sample Nos. 701 to 710 were prepared.

Halftone images were formed on these samples by the following method:

A commercial negative gray contact screen (150 line/inch) was brought into close contact with the samples, which were exposed to white tungsten light for 10 sec. through an optical step wedge having a density difference of 0.1. Thereafter, each sample was developed in the following developer at 27° C. for 100 sec., followed by fixation, rinsing and drying by a conventional method.

| Composition of Developer: | |
|---|---|
| Sodium Carbonate (monohydrate) | 50 g |
| Formaldehyde-Hydrogensulfite Adduct | 45 g |
| Potassium Bromide | 2 g |
| Hydroquinone | 18 g |
| Sodium Sulfite | 2 g |
| 5-Nitroindazole | 3 mg |
| Water to make | 1 liter |

The following compounds were used for comparison in Table 7.

Comparative Compound (a): 1-Phenyl-5-mercaptotetrazole

Comparative Compound (b): 5-Methylbenzotriazole

Comparative Compound (c): 2-Methylthio-5-mercapto-1,3,4-thiadiazole

Table 7 shows the evaluation results of the quality of dot and the halftone. The quality of dot was evaluated by visual inspection in 4 grades, "A", "B", "C" and "D" expressing the best quality, practicable quality, quality inferior to the practicable limit and the worst quality, respectively. The halftone denotes the difference of log value of the amount of exposure giving blackened areas of 5% and 95%, a larger difference showing a softer halftone.

TABLE 7

| | Compound of General Formula (I) | | | |
|---|---|---|---|---|
| Sample No. | Structural Formula | Amount of Addition (mol/mol Ag) | Quality of Dot | Halftone |
| 701 | — | — | B | 1.13 |
| 702 | (I-34) | $2.6 \times 10^{-4}$ | A | 1.24 |
| 703 | (I-40) | $2.6 \times 10^{-4}$ | A | 1.25 |
| 704 | (I-20) | $2.6 \times 10^{-4}$ | A | 1.24 |
| 705 | Comparative Compound (a) | $6.5 \times 10^{-5}$ | C | 1.16 |
| 706 | Comparative Compound (a) | $1.3 \times 10^{-4}$ | D | 1.30 |
| 707 | Comparative Compound (b) | $6.5 \times 10^{-5}$ | C | 1.15 |
| 708 | Comparative Compound (b) | $1.3 \times 10^{-4}$ | D | 1.24 |
| 709 | Comparative Compound (c) | $6.5 \times 10^{-5}$ | C | 1.15 |

TABLE 7-continued

| Sample No. | Compound of General Formula (I) Structural Formula | Amount of Addition (mol/mol Ag) | Quality of Dot | Halftone |
|---|---|---|---|---|
| 710 | Comparative Compound (c) | $1.3 \times 10^{-4}$ | D | 1.23 |

As is evident from Table 7, the compounds of the present invention have a very large effect for softening the halftone without deteriorating the quality of the dots. In other words, when the halftone is made 0.1 or more softer than in the case of no addition of any compound by using Comparative Compounds (a), (b) and (c), the quality of dots is graded "D", but when the compounds of the present invention are used, the halftone is 0.1 to 0.2 softer than in the case of no addition of any compound and that the quality of dots is so good as to be graded "A".

EXAMPLE 8

Sample Nos. 701, 702 and 703 of Example 7 were subjected to exposure and development processing in the same manner as in Example 7 except that the development was conducted at 27° C. for three different times, 90, 100 and 110 sec. The results of 5 grade evaluation for the quality of dots are shown in Table 8, in which grade "5", "1" and "5" to "3.5" denote the best, the worst and practicable qualities, respectively.

TABLE 8

| Sample No. | Compound | Dot (%) | Development Time 90 Sec. | 100 Sec. | 110 Sec. |
|---|---|---|---|---|---|
| 701 | — | 5 | 3.5 | 4.0 | 4.5 |
| | | 95 | 4.5 | 4.0 | 3.5 |
| 702 | (I-34) | 5 | 4.0 | 4.5 | 4.5 |
| | | 95 | 4.5 | 4.5 | 4.0 |
| 703 | (I-40) | 5 | 4.0 | 4.5 | 4.5 |
| | | 95 | 4.5 | 4.5 | 4.0 |

Table 8 indicates that the quality of dots obtained for the samples to which the compounds of the present invention are added is better both at 5% and 95% dots and both at shorter and longer time than the standard development time (100 sec.), and that the latitude of development is wider than in the case of no addition of the compounds.

EXAMPLE 9

Each of Sample Nos. 701, 702 and 703 of Example 7 was placed on top of Manuscript (A) having white lines 50 μm wide on a black ground and Manuscript (B) having black lines 50 μm wide on a white ground, and exposed to white tungsten light for 10 sec. with a camera for plate making. Then, each sample was subjected to development processing in the same manner as in Example 1. The results are given in Table 9.

TABLE 9

| Sample No. | Compound | Width of Black Line Developed in Case of Manuscript (A) Being Used (μ) | Width of White Line Developed in Case of Manuscript (B) Being Used (μ) |
|---|---|---|---|
| 701 | — | 75 | 30 |
| 702 | (I-34) | 70 | 38 |

TABLE 9-continued

| Sample No. | Compound | Width of Black Line Developed in Case of Manuscript (A) Being Used (μ) | Width of White Line Developed in Case of Manuscript (B) Being Used (μ) |
|---|---|---|---|
| 703 | (I-40) | 65 | 40 |

Table 9 shows that the use of the compounds of the present invention permits a better reproducibility of the width of fine lines. From this result, it is obvious that, in practical plate making process, the latitude of exposure is larger in the case of use of a manuscript in which Minchow characters and Gothic characters are written together.

EXAMPLE 10

To a silver halide emulsion comprising 95 mol% of silver chloride and 5 mol% of silver bromide and containing $1 \times 10^{-4}$ mol of rhodium per mol of silver were added 2-hydroxy-4,6-dichloro-1,3,5-triazine sodium salt (hardener) and polyoxyethylene nonylphenyl ether containing 30 ethylene oxide groups in an amount of $1 \times 10^{-4}$ mol per mol of silver. The compounds of the present invention were also added in the amount given in Table 10 in the form of a methanol solution to the mixture. The resulting emulsion was coated on a polyethylene terephthalate film such that the amount of silver was 4.5 g/m$^2$.

After the film samples thus prepared were exposed to light by use of the manuscript comprising the constitution of FIG. 1 of U.S. Pat. No. 4,452,882 with a Model P-607 Printer manufactured by Dainippon Screen Co., Ltd., they were developed with the following developer at 38° C. for 20 sec., followed by fixation, rinsing and drying by a conventional method.

| Composition of Developer: | |
|---|---|
| Potassium Bromide | 2.0 g |
| Potassium Hydroxide | 20 g |
| Potassium Carbonate | 35 g |
| Potassium Sulfite | 80 g |
| Hydroquinone | 20 g |
| Triethylene Glycol | 30 g |
| Polyethylene Glycol (molecular weight: 4,000) | 2.0 g |
| 5-Nitroindazole | 0.1 g |
| Water to make | 1 liter (pH 11.7) |

The results are shown in Table 10.

TABLE 10

| Sample No. | Compound of General Formula (I) Structural Formula | Amount of Addition (mol/mol Ag) | Letter Image Quality |
|---|---|---|---|
| 1001 | — | — | 2 |
| 1002 | (I-28) | $1.3 \times 10^{-4}$ | 4 |
| 1003 | (I-34) | $1.3 \times 10^{-4}$ | 5 |

By letter image quality "5" in Table 10 is meant the quality of picture in which characters 30 μm wide can be reproduced when the manuscript as shown in FIG. 1 of U.S. Pat. No. 4,452,882 is subjected to proper exposure such that a dot area of 50% will produce a dot area of 50% on a photosensitive material for a contact film, which quality represents very good letter image quality. On the other hand, by letter image quality is meant the quality of picture in which only characters 150 μm or more wide can be reproduced when subjected to the same proper exposure, which quality represents unfavorable letter image quality. Grades 4 to 2 were set by functional evaluation between 5 and 1, grade 2 or more representing a level of practicability.

As is evident from Table 10, the compounds of the present invention exhibit a good quality of letter image quality.

EXAMPLE 11

The following experiment was conducted in order to compare the release rate and efficiency of the photographically useful groups from the oxidants for the compounds used in the present invention with those for hitherto known compounds.

Method of Experiment

For each of Samples (a) to (g), 100 ml of acetonitrile solution ($2\times10^{-3}$ mol/l) was prepared. Then, each 4 ml of these solutions was added in a short time to a mixed solution of 20 ml of Britton-Robinson buffer solution and 16 ml of methanol, and the solution was reacted. The concentrations of the released heterocyclic compounds PMT and DMET were measured with process of time by use of rapid liquid chromatography. The reaction rate was found from a calibration line prepared separately.

Under these experimental conditions, the reaction can be considered approximately pseudo-primary at the early stage. Therefore, the pseudo-primary reaction rate constant k' and the halflife were calculated, the results of which are shown in Table 11.

Sample (a):

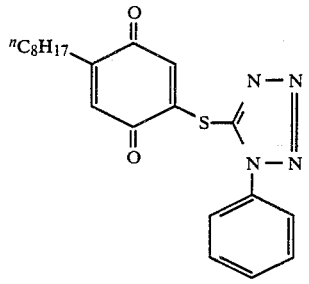

Comparative Compound 1

Sample (b):

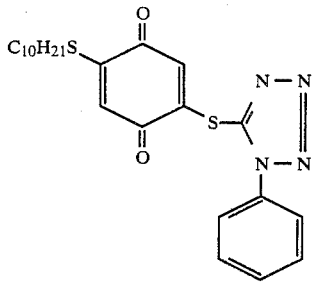

Comparative Compound 2

Sample (c):

-continued

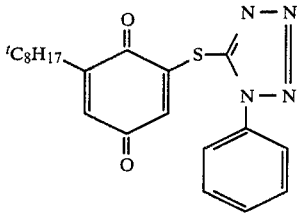

Comparative Compound 3

Sample (d):

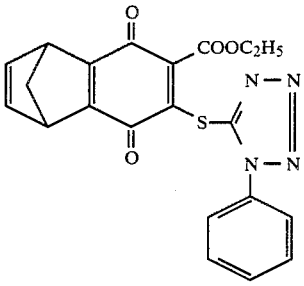

Oxidant of Compound Example I-25

Sample (e):

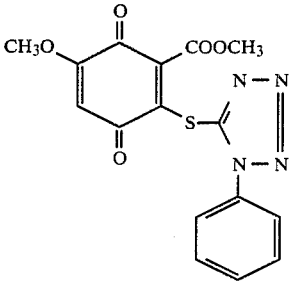

Oxidant of Compound Example I-9

Sample (f):

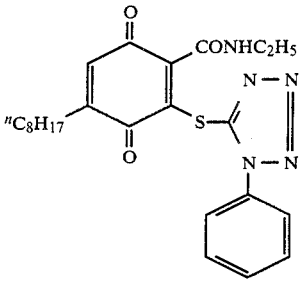

Oxidant of Compound Example I-7

Sample (g):

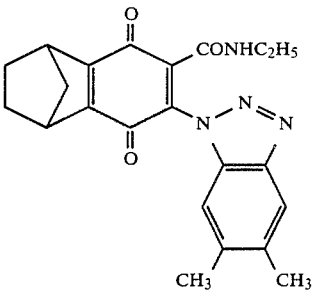

Oxidant of Compound Example I-36

Heterocyclic compounds to be released:

-continued

PMT

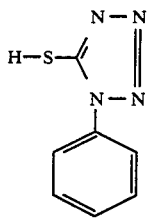

DMBT

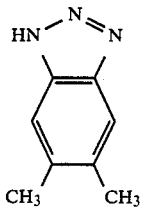

TABLE 11

| Sample No. | Pseudo-Primary Reaction Rate Constant k' at pH 10 k' ($sec^{-1}$) | Half Life at pH 10 (sec) | Release* Efficiency (%) |
|---|---|---|---|
| Sample (a) Comparative Example 1 | $9.17 \times 10^{-3}$ | 75.6 | 30 |
| Sample (b) Comparative Example 2 | $1.08 \times 10^{-2}$ | 64.2 | 51 |
| Sample (c) Comparative Example 3 | $2.25 \times 10^{-3}$ | 308.1 | 60 |
| Sample (d) Oxidant of Compound (I-25) according to the present invention | 4.62** | 0.15 | 92 |
| Sample (e) Oxidant of Compound (I-9) according to the present invention | 23.1** | 0.03 | 100 |
| Sample (f) Oxidant of Compound (I-7) according to the present invention | 3.47** | 0.2 | 98 |
| Sample (g) Oxidant of Compound (I-3) according to the present invention | 1.16** | 0.6 | 100 |

*Release Efficiency:

$$\frac{\text{Amount of released heterocyclic compound PMT (or DMBT) in case where reaction time increases indefinitely}}{\text{Amount of sample used for reaction}} \times 100$$

**The value of k' at pH 10 was so large that it was obtained by extrapolating from the value measured at pH 8.

It was found that Table 11 that the release rate from the oxidant for the compounds used in the present invention is $10^2$ to $10^3$ times as high as that for the hitherto known compounds and the release efficiency for the former compounds is also greatly improved in comparison with that for the latter compounds.

While the invention has been described in detail and with reference to specific embodiments thereof, it will be apparent to one skilled in the art that various changes and modifications can be made therein without departing from the spirit and scope thereof.

What is claimed is:

1. A silver halide photosensitive material comprising a support and at least one silver halide emulsion layer, wherein said emulsion layer or another layer contains a compound represented by formula (I)

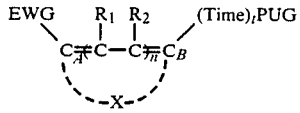

(I)

wherein X represents an atomic group forming a redox center of the benzene type having substituents by linking with $C_A$ and $C_B$, and which does not enable Time-PUG to be released until the redox center is oxidized by an oxidizing compound formed in the exposed areas during development processing; EWG represents an electron withdrawing group having a Hammet's $\sigma$ para value exceeding 0.3 selected from the group consisting of a cyano group, a nitro group, substituted or unsubstituted carbamoyl groups having from 1 to 30 carbon atoms, substituted or unsubstituted sulfamoyl groups having from 1 to 30 carbon atoms, substituted or unsubstituted alkoxycarbonyl group having from 1 to 30 carbon atoms, substituted or unsubstituted sulfonyl groups having from 1 to 30 carbon atoms, or substituted or unsubstituted acyl groups having 1 to 30 carbon atoms; $C_A$ and $C_B$ each represents a carbon atom; $R_1$ and $R_2$ each represents a hydrogen atom or a suitable substituent; Time represents a timing group connecting to $C_B$ through a sulfur, nitrogen, or selenium atom thereof, t is an integer of 0 to 1, and when t=0, Time is a chemical bond; PUG represents a photographically useful group and connects to $C_B$ through a sulfur, nitrogen, or selenium atom thereof when t=0; and n is an integer of 0 or 1.

2. A silver halide photosensitive material as in claim 1, wherein said compound represented by formula (I) is used in an amount of from $1\times10^{-7}$ to $1\times10^{-3}$ mol per mol of silver halide.

3. A silver halide photosensitive material as in claim 1, wherein PUG is a development inhibitor, and the amount of the compound represented by formula (I) is from $1\times10^{-7}$ to $1\times10^{-1}$ mol per mol of silver halide.

4. A silver halide photosensitive material as in claim 1, wherein PUG is a development inhibitor, and the amount of the compound represented by formula (I) is from $1\times10^{-6}$ to $5\times10^{-2}$ mol per mol of silver halide.

5. A silver halide photosensitive material as in claim 1, wherein PUG is a dye, and the amount of the compound represented by formula (I) is from $1\times10^{-3}$ to 10 mols per mol of silver halide.

6. A silver halide photosensitive material as in claim 1, wherein PUG is a dye, and the amount of the compound represented by formula (I) is from $1\times10^{-2}$ to 4 mols per mol of silver halide.

7. A silver halide photosensitive material as in claim 1, wherein PUG is a development accelerator, and the amount of the compound represented by formula (I) is from $1\times10^{-7}$ to $1\times10^{-1}$ mol per mol of silver halide.

8. A silver halide photosensitive material as in claim 1, wherein PUG is a development accelerator, and the amount of the compound represented by formula (I) is from $1\times10^{-6}$ to $1\times10^{-2}$ mol per mol of silver halide.

9. A silver halide photosensitive material as in claim 1, wherein in the formula (I) PUG comprises development inhibitors, development accelerators, fogging agents, couplers, coupler releasing couplers, diffusive or undiffusive dyes, desilverization accelerators, desilverization inhibitors, solvents for silver halides, competitive compounds, developing agents, auxiliary developing agents, fixation accelerators, fixation inhibitors, image stabilizers, color toning agents, processing-dependency improvers, dot improvers, color image stabilizers, desensitizers, chemical sensitizers, UV absorbers or fluorescent whitening agents, or precursors thereof.

10. A silver halide photosensitive material as in claim 1, wherein the formula:

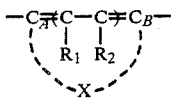

represents formulas selected from the group consisting of (a) to (t):

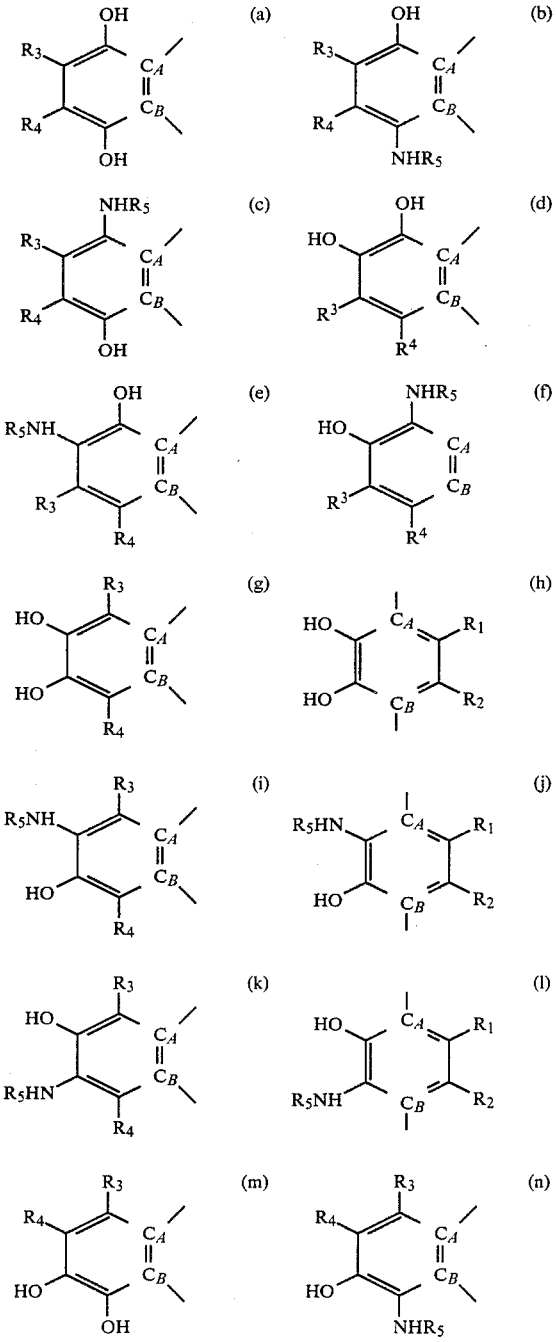

-continued

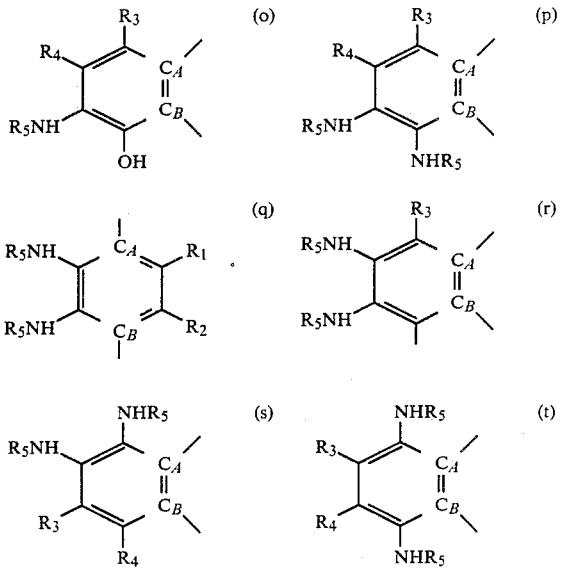

11. A silver halide photosensitive material as in claim 1, wherein Time is a combination of two or more formulae selected from the group consisting of compounds (T-1) to (T-10):

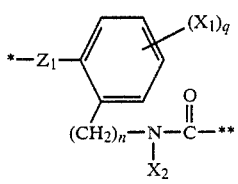

(T-1)

wherein $Z_1$ represents

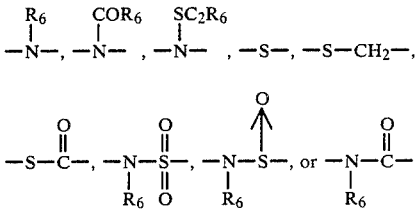

wherein $R_6$ is a hydrogen atom, an aliphatic, aromatic, or heterocyclic group; $X_1$ represents a hydrogen atom, an aliphatic, aromatic or heterocyclic group,

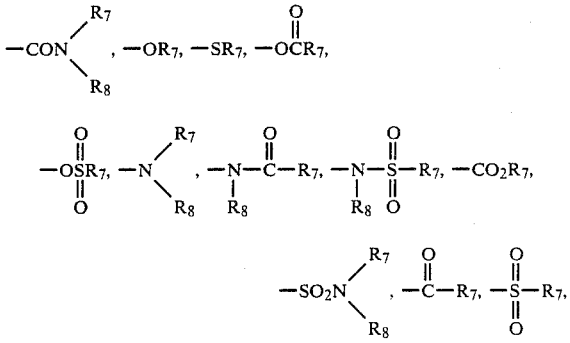

a cyano group, halogen atoms or a nitro group wherein $R_7$ and $R_8$ may be or may not be identical and express the same groups as described for $R_6$; $X_2$ represents the same groups as described for $R_6$; q represents an integer of from 1 to 4, and when q is 2 or more, the substituent represented by $X_1$ may be or may not be identical, and when q is 2 or more, $X_1$ may link to each other to form a ring; and n represents 0, 1 or 2;

(T-2)

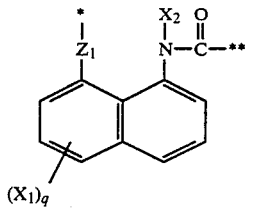

wherein $Z_1$, $X_1$, $X_2$ and q denote the same meanings as those defined for formula (T-1);

(T-3)

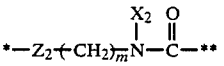

wherein $Z_2$ represents

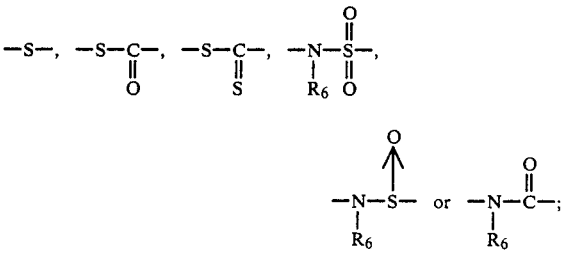

m is an integer of from 1 to 4, and $R_6$ and $X_2$ denote the same meanings as those defined for formula (T-1);

(T-4)

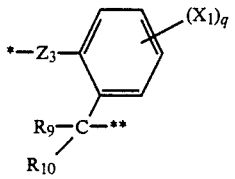

wherein $Z_3$ represents —S— or

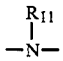

wherein $R_{11}$ expresses an aliphatic, aromatic, acyl, sulfonyl or heterocyclic group; $R_9$ and $R_{10}$ denote the same meanings as $R_6$ defined for formula (T-1); and $X_1$ and q denote the same meanings as those defined for formula (T-1);

(T-5)

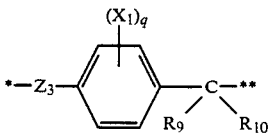

wherein $Z_3$, $X_1$, $R_9$, $R_{10}$, and q denote the same meanings as those defined for formula (T-4);

(T-6)

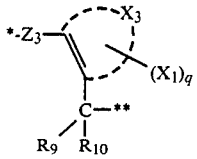

wherein $X_3$ is an atomic group which comprises at least one atom selected from the class consisting of carbon, nitrogen, oxygen and sulfur and which is necessary to form a 5- to 7-membered heterocycle, which may be further condensed with a benzene ring or a 5- to 7-membered heterocycle, and $R_9$, $R_{10}$, $Z_3$, $X_1$ and q denote the same meanings as those defined for formula (T-4);

(T-7)

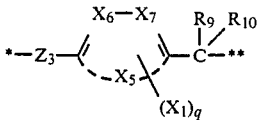

wherein $X_5$ is an atomic group which comprises at least one atom selected from the class consisting of carbon, nitrogen, oxygen, and sulfur and which is necessary to form a 5- to 7-membered heterocycle, which may be condensed further with a benzene ring or a 5- to 7-membered heterocycle, $X_6$ and $X_7$ is

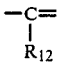

or —N= wherein $R_{12}$ expresses a hydrogen atom, an aliphatic or aromatic group; and $R_9$, $R_{10}$, $Z_3$, $X_1$ and q denote the same meanings as those defined for formula (T-4);

(T-8)

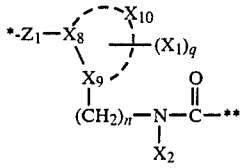

wherein $X_{10}$ is an atomic group which comprises at least one atom selected from the class consisting of carbon, nitrogen, oxygen, and sulfur and which is necessary to form a 5- to 7-membered heterocycle, which may be further condensed with a benzene ring or a 5- to 7-membered heterocycle, $X_8$ and $X_9$ are

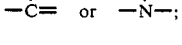

and $Z_1$, $X_1$, $X_2$, n and q denote the same meanings as those defined for formula (T-1);

(T-9)

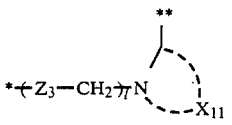

wherein $X_{11}$ denotes the same meaning as $X_{10}$ defined for formula (T-8); $Z_3$ denotes the same meaning as that defined for formula (T-4) and l expresses 0 or 1;

(T-10)

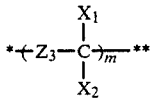

wherein $X_1$ and $X_2$ denote the same meanings as those defined for formula (T-1), $Z_3$ denotes the same meaning as that for formula (T-4) and m denotes the same meaning as that for formula (T-3).

12. A silver halide photosensitive material as in claim 1, wherein the silver halide emulsion layer comprises silver chlorobromide or silver chloroiodobromide containing at least 60% of silver chloride and 0 to 5% of silver iodide and polyalkylene oxides, and is for photo plate making.

13. A silver halide photosensitive material as in claim 1, wherein the silver halide emulsion layer further comprises hydrazine derivatives and is a monodispersion silver halide emulsion layer.

14. A silver halide photosensitive material as in claim 1, wherein the silver halide emulsion layer comprises multilayer or multicolor photographic material having at each one of red-sensitive emulsion layer, green-sensitive emulsion layer and blue-sensitive emulsion layer.

15. A silver halide photosensitive material as in claim 1, wherein the silver halide emulsion layer comprises a silver iodobromide or silver chloroiodobromide emulsion layer containing 0 to 50 mol% of silver chloride and up to 15 mol% of silver iodide.

16. A silver halide photosensitive material as in claim 1, wherein the silver halide emulsion layer comprises X-ray photosensitive material.

* * * * *